US007434918B2

(12) United States Patent
Sugahara

(10) Patent No.: US 7,434,918 B2
(45) Date of Patent: Oct. 14, 2008

(54) LIQUID TRANSPORTING APPARATUS AND METHOD FOR PRODUCING LIQUID TRANSPORTING APPARATUS

(75) Inventor: Hiroto Sugahara, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 435 days.

(21) Appl. No.: 11/261,223

(22) Filed: Oct. 27, 2005

(65) Prior Publication Data

US 2006/0152556 A1 Jul. 13, 2006

Related U.S. Application Data

(63) Continuation-in-part of application No. 10/310,750, filed on Dec. 5, 2002, now Pat. No. 6,971,738.

(30) Foreign Application Priority Data

| | | |
|---|---|---|
| Dec. 6, 2001 | (JP) | 2001-372104 |
| May 8, 2002 | (JP) | 2002-132195 |
| Sep. 27, 2002 | (JP) | 2002-284304 |
| Oct. 27, 2004 | (JP) | 2004-312840 |

(51) Int. Cl.
*B41J 2/045* (2006.01)

(52) U.S. Cl. ..... 347/71

(58) Field of Classification Search ..... 347/68, 347/70–72

See application file for complete search history.

(56) References Cited

U.S. PATENT DOCUMENTS

| | | | |
|---|---|---|---|
| 4,825,227 | A | 4/1989 | Fischbeck et al. |
| 6,450,626 | B2 | 9/2002 | Ikeda et al. |
| 6,604,817 | B2 | 8/2003 | Isono et al. |
| 6,971,738 | B2 | 12/2005 | Sugahara |
| 2003/0107622 | A1 | 6/2003 | Sugahara |

FOREIGN PATENT DOCUMENTS

| | | |
|---|---|---|
| JP | 9104109 | 4/1997 |
| JP | 2000-218780 | 8/2000 |
| JP | 3128857 | 11/2000 |
| JP | 2001-179969 | 7/2001 |
| JP | 2001-260349 | 9/2001 |
| JP | 2003338382 | 9/2003 |
| JP | 2004166463 A | 6/2004 |

*Primary Examiner*—An H Do
(74) *Attorney, Agent, or Firm*—Reed Smith LLP

(57) ABSTRACT

An ink-jet head 501 as a liquid transportation apparatus includes pressure chambers 514, and a piezoelectric layer 503 having individual electrodes 532 and a vibration plate 530. When W is a length in the radial direction of pressure chambers 514, and A is a length in the radial direction of portions of individual electrodes 532 to which a drive voltage is applied, the portions being formed at areas each overlapping with one side portion, in the radial direction, of the edge portion of one of the pressure chambers 514, the length A in the radial direction of individual electrodes 532 is determined based on a relationship between the value of A/(W/2) and an amount of deformation of the vibration plate 530 when the drive voltage is applied to the individual electrode 532, such that the amount of the deformation of the vibration plate 530 becomes great. Accordingly, a liquid transporting apparatus provided with the piezoelectric actuator which has excellent durability and more improved drive efficiency.

29 Claims, 41 Drawing Sheets

LIQUID TRANSPORTING APPARATUS AND METHOD FOR PRODUCING LIQUID TRANSPORTING APPARATUS

CROSS-REFERENCES TO RELATED APPLICATIONS

This application is a Continuation-In-Part Application of U.S. application Ser. No. 10/310,750 filed on Dec. 5, 2002 now U.S. Pat. No. 6,971,738 claiming the priority of Japanese patent Applications No. 2001-372104 filed on Dec. 6, 2001; No. 2002-132195 filed on May 8, 2002; and No. 2002-284304 filed on Sep. 27, 2002.

BACKGROUND OF THE INVENTION

1. Field of the Invention

The present invention relates to a liquid transporting apparatus which transport a liquid and a method for producing a liquid transporting apparatus.

2. Description of Related Art

As an example of conventional recording apparatus which performs recording on a recording medium such as paper, an ink-jet printer provided with an ink-jet head is known (for example, see Patent Document 1).

[Patent Document 1] Japanese Patent Publication No. 3128857

As shown in FIG. 47, the ink-jet head 420 is constructed of a stack in which an actuator plate 421 driven by a drive voltage generated in a driving circuit (not shown), a cavity plate 422 forming an ink channel for flowing an ink threre-through, and a nozzle plate 423 provided with nozzles 424 from which the ink is ejected are stacked in layers such that the piezoelectric actuator plate 421, the cavity plate 422 and the nozzle plate 423 are positioned at upper, middle and lower portions in the stack respectively. The cavity plate 422 is constructed of three layers 422*a* to 422*c* stacked on top of the each other. With the etching or the like, pressure chambers 430 for accommodating the ink are formed in the upper layer 422*a*, a manifold (now shown) for supplying the ink to the pressure chambers and communicating holes 432 are formed in the lower layer 422*c*, and communicating holes (now shown) for communicating the pressure chambers 430 and the manifold and communicating holes 431 for communicating the pressure chambers 430 and the nozzles 424 are formed in the middle layer 422*b*.

The piezoelectric actuator plate 421 is formed of a piezoelectric ceramic material made of a lead zirconate titanate (PZT) of ceramic material, and is provided with a plurality of piezoelectric ceramics layers 440 having the piezoelectric effect and a plurality of inner-side electrodes 445, 446, 447, 448, 449, 450 interposed between the ceramic layers. Each of the inner-side electrodes 445 to 450 is arranged in a portion corresponding to the central portion of one of the pressure chambers 430. The portions of the piezoelectric ceramic layers 440, sandwiched between the inner-side electrodes 445 to 450, serve as active portions 445, 456, 457, 458, 459 each of which extends in a direction in which the layers are stacked when a voltage is applied to the inner-side electrodes 445 to 450. As shown in FIG. 48, when a voltage is applied to the inner-side electrodes 445 to 450, in the piezoelectric actuator plate 421, which correspond to an arbitrary pressure chamber 430*a*, an electric field parallel to the polarization direction is generated in the active portion 455 to 459, then the active portions 455 to 459 extend in the direction in which the layers are stacked so that pressure is applied to the ink in the pressure chamber 430 for ejecting the ink.

However, as shown in FIG. 48, in the conventional technique as described above, the electrodes 445 to 450 are formed to substantially match the shape of the pressure chamber 430 in a plan view and the electrodes 455 to 450 are stacked on top of each other. Accordingly, there is an increase in the surface area of the portions of the piezoelectric ceramic layers 440 disposed between the electrodes 445 to 450, which give rise to problems such that a capacitance is increased, a larger electric current is required in order to rapidly drive the piezoelectric actuator, which in turn decreases the energy efficiency in the piezoelectric actuator.

In addition, when the active portions 455 to 459 deform to project downwardly toward a certain pressure chamber 430*a* for performing the ejection of the ink, the downward deformation of the active portions 445 to 459 produces an opposite reaction, which in turn causes a portion of the piezoelectric actuator plate 421 disposed above another pressure chamber 430*a* adjacent to the certain pressure chamber 430*a* to bend to project upwardly, with a portion above a partition wall 430*c* between these pressure chambers 430 (430*a* and 430*b*) functioning as a fulcrum P1. In addition, the opposite reaction applies force to the partition wall 430*c* so that the partition wall 430*c* tilts toward the pressure chamber 430*a*. In this way, the operation for electing ink from an arbitrary pressure chamber 430*a* also changes the volume in another pressure chamber 430*b* adjacent to the arbitrary pressure chamber 430*a*, which in turn causes the change in pressure in the ink in the adjacent pressure chamber 430*b*. When the ink is ejected from the adjacent pressure chamber 430*b*, there arises a problem of so-called cross talk in some cases in which the velocity and the volume of ejected ink droplets become varied or non-uniform, thereby lowering the printing quality of the ink-jet head 420.

SUMMARY OF THE INVENTION

The present invention is made to solve the abovementioned problems, an object of which is to provide a piezoelectric actuator, a fluid transporting apparatus and an ink-jet head which are capable of applying a sufficient amount of deformation to the piezoelectric material plate even when the surface area of piezoelectric material arranged between the electrodes is decreased; in which the deformation of the portion of the actuator, corresponding to one of the pressure chambers, is prevented from affecting other portion of the actuator corresponding to another pressure chamber; in which the printing quality can be enhanced and a satisfactory energy efficiency can be realized. Another object of the present invention is to provide a liquid transporting apparatus provided with a piezoelectric actuator which has excellent durability and in which the driving efficiency is further enhanced, and a method for producing such a liquid transporting apparatus.

According to a first aspect of the present invention, there is provided a liquid transporting apparatus including: a plate-shaped body including first and second surfaces which are separated from each other by a predetermined distance in a thickness direction and which extend in a predetermined planar direction substantially perpendicular to the thickness direction, and an operation portion having a first portion and a pair of second portions disposed symmetrically on either side of the first portion with respect to the planar direction; at least one electrode located in each of the second portions, the at least one electrode including at least one pair of electrodes to sandwich an active portion, the active portion being defined in each of the second portions between the pair of electrodes and located nearer to the first surface than the second surface in the thickness direction, at least the active portion in the plate-shaped body being formed from piezoelectric material, the at least one pair of electrodes generating an electric field for deforming the active portion in the planar direction, thereby archingly deforming each of the second portions in a direction from one to the other of the first and second portions, and consequently archingly deforming the first portion in an opposite direction from the other to the one of the first and second portions, thereby deforming the operation portion in the thickness direction; a fluid accommodating plate disposed to face one of the first surface and the second surface of the plate-shaped body, the fluid accommodating plate forming a fluid accommodating chamber, the operation portion of the plate-shaped body confronting the fluid accommodating chamber, volume of the fluid accommodation chamber changing in association with the deformation of the first portion and of the pair of second portions to transport fluid in the fluid accommodation chamber; a hole-defining portion defining an ejection hole in fluid communication with the fluid accommodating chamber, change in volume of the fluid accommodation chamber transporting the fluid in the fluid accommodation chamber through the ejection hole; wherein a value of A/(W/2) is not less than 0.33 and not more than 0.75 when W is a length in a radial direction of the fluid accommodating chamber, and A is a length in the radial direction of a portion of the at least one electrode, the portion being formed at an area which overlaps with one side portion in the radial direction of the at least one electrode and an edge portion of the fluid accommodating chamber, the edge portion being other than a central portion of the fluid accommodating chamber.

According to a second aspect of the present invention, there is provided a liquid transporting apparatus including: a channel unit having a plurality of pressure chambers each of which is arranged along a plane; and a piezoelectric actuator which selectively changes volumes of the pressure chambers to apply pressure to a liquid in the pressure chambers; wherein the piezoelectric actuator includes: a vibration plate joined to the channel unit to cover the pressure chambers; a piezoelectric layer which is arranged on a side of the vibration plate opposite to the pressure chambers and which is formed to overlap entirely with the pressure chambers as viewed in a direction perpendicular to the plane; a plurality of individual electrodes each of which is formed at an area of the piezoelectric layer, the area being in one surface of the piezoelectric layer and overlapping with an edge portion of one of the pressure chambers as viewed in the direction perpendicular to the plane, the edge portion being other than a central portion of one of the pressure chambers; and a common electrode which is formed on the other surface of the piezoelectric layer; wherein a value of A/(W/2) is not less than 0.33 and not more than 0.75 when W is a length in a radial direction of the pressure chambers, and A is a length of portions of the individual electrodes in the radial direction, the portions being formed at areas each overlapping with one side portion, in the radial direction, of the edge portion of one of the pressure chambers.

In the liquid transporting apparatus of the present invention, each of the individual electrodes in the piezoelectric actuator is arranged at the area overlapping with the edge portion of one of the pressure chambers. Accordingly, when a drive voltage is applied to one of the individual electrodes, a portion of the piezoelectric layer, which is sandwiched between the individual electrode and the common electrode and is along the edge portion of one of the pressure chambers is contracted in a direction parallel to the plane of the piezoelectric layer. As a result, the vibration plate and the piezoelectric layer are archingly deformed to project toward a side opposite to one of the pressure chambers, with the portion of the piezoelectric layer overlapping with the central portion of one of the pressure chamber as apex of the archingly deformation, thereby increasing the volume of the pressure chamber and generating a pressure wave inside the pressure chamber. Further, when the application of drive voltage to the individual electrode is stopped at timing when the pressure wave in the pressure chamber changes to positive in the pressure chamber, the vibration plate is restored to the initial or original shape, thereby reducing the volume inside the pressure chamber. However, at this time, the pressure wave generated with the increase in the volume of the pressure chamber and the pressure wave generated with the restoration of the vibration plate are combined and a substantial pressure is applied to the liquid in the pressure chamber. Therefore, it is possible to apply a substantial pressure to the liquid with a comparatively low drive voltage, thereby improving a drive efficiency of the piezoelectric actuator. Moreover, since the electric field is made to act on the piezoelectric layer by applying the drive voltage to the individual electrodes only at a timing of ink transportation, polarization deterioration hardly occurs in the piezoelectric layer, and accordingly the durability of the actuator is improved.

Further, when the value of A/(W/2) is within a range of not less than 0.33 to not more than 0.75 wherein W is the length in the radial direction of the pressure chambers (a length of the pressure chambers in a direction of a straight line passing through the center of surface area of the pressure chambers), and A is the length in the radial direction of portions of the individual electrodes, each of the portions overlapping with one side portion, in the radial direction, of the edge portion of one of the pressure chambers, then it is possible to deform the piezoelectric layer more greatly while suppressing the variation in the amount of deformation of the piezoelectric layer, thereby improving the driving efficiency of the piezoelectric actuator.

In the liquid transporting apparatus of the present invention, the value of A/(W/2) may be not less than 0.41 and not more than 0.69, and the value of A/(W/2) may be not less than 0.41 and not more than 0.55. In this manner, when the length A in the radial direction of the individual electrodes are small within the range of the value of A/(W/2) in the liquid transporting apparatus of the present invention, it is possible to make capacitance generated in the piezoelectric layer between the individual electrodes and the common electrode to be small while increasing the amount of deformation of the piezoelectric layer, thereby making the power consumption of the piezoelectric actuator to be small.

In the liquid transporting apparatus of the present invention, each of the pressure chambers may have a shape long in a predetermined direction; and each of the individual electrodes may be formed at least at two areas which are included the area which overlaps with the edge portion of one of the pressure chambers and which extend substantially in parallel to the predetermined direction. When each of the pressure chambers has a shape which is long in a predetermined direction, a length of the individual electrodes in a direction, which intersects the longitudinal direction (the predetermined direction) of the pressure chamber, greatly affects the amount of deformation of the piezoelectric layer. For this reason, the length A of the individual electrodes, each of which is formed at least in two areas which are included in the area overlapping with the edge portion of one of the pressure chambers and which extend in the longitudinal direction of one of the pressure chambers, the length being in the direction intersecting the longitudinal direction (corresponding to the radial direction in the liquid transporting apparatus of the present invention) of the pressure chamber, is made to have an appropriate value such that the amount of deformation of the piezoelectric layer is great. With this, it is possible to assuredly improve the driving efficiency of the piezoelectric actuator.

In the liquid transporting apparatus of the present invention, the vibration plate may be formed of a metallic material and may serve as the common electrode. In this case, there is no need to separately provide a common electrode in addition to the vibration plate. Further, in the liquid transporting apparatus of the present invention, the vibration plate may be insulative at least on a surface of the vibration plate opposite to the pressure chambers; and the common electrode may be formed on the surface of the vibration plate opposite to the pressure chambers. Alternatively, in the liquid transporting apparatus of the present invention, the vibration plate may be insulative at least on a surface of the vibration plate opposite to the pressure chambers; and the individual electrodes may be formed on the surface of the vibration plate opposite to the pressure chambers.

According to a third aspect of the present invention, there is provided a method for producing a liquid transporting apparatus provided with a channel unit having a plurality of pressure chambers each of which is arranged along a plane; and a piezoelectric actuator including a vibration plate which covers the pressure chambers, a piezoelectric layer arranged on a side of the vibration plate opposite to the pressure chambers, a plurality of individual electrodes each of which is formed at an area of the piezoelectric layer, the area being in one surface of the piezoelectric layer and overlapping with an edge portion of one of the pressure chambers as viewed in a direction perpendicular to the plane, the edge portion being other than a central portion of one of the pressure chambers, and a common electrode which is formed on the other surface of the piezoelectric layer, the method comprising: an electrode length determination step of determining a length A in a radial direction of the individual electrodes based on a relationship between an amount of deformation of the vibration plate when a voltage is applied to the individual electrodes and a value of A/(W/2) in which W is a length in the radial direction of the pressure chambers, and A is a length in the radial direction of portions of the individual electrodes, the portions being formed at areas each overlapping with one side portion, in the radial direction, of the edge portion of one of the pressure chambers; and an individual electrode formation step of forming the individual electrodes having the length A determined in the electrode length determination step.

In the electrode length determination step, the length A in the radial direction of the individual electrodes is determined to have an optimum value such that the amount of deformation of the vibration plate is great, the length A being determined based on the relationship between the amount of deformation of the vibration plate when a drive voltage is applied to the individual electrodes and the value of A/(W/2), which is a ratio of A to half value of W (W/2) wherein W is a length in the radial direction of the pressure chambers, and A is a length in the radial direction of portions of the individual electrodes, each of the portions being formed at an area overlapping with one side portion, in the radial direction, of the edge portion of one of the pressure chambers; and in the individual electrode formation step, the individual electrodes having the determined length A are formed. Accordingly, it is possible to deform the vibration plate more effectively, thereby improving the efficiency of the piezoelectric actuator.

The method for producing the liquid transporting apparatus of the present invention may include a piezoelectric layer formation step of forming the piezoelectric layer so as to entirely cover the pressure chambers. When the piezoelectric layer is formed so as to entirely cover the pressure chambers, the variation in the rigidities of the vibration plate and piezoelectric layer is small and roughly uniform in the area overlapping with the pressure chambers. Accordingly, even when the conditions such as the thickness of the vibration plate and/or the thickness of the vibration plate are changed, there is no change in the tendency of the vibration plate regarding the amount of deformation with respect to the length A in the radial direction of the individual electrodes. Namely, an optimal value for the length A in the radial direction of the individual electrodes, such that the amount of deformation of the vibration plate when voltage is applied to the individual electrodes is great, does not depend on the conditions other than the length W in the radial direction of the pressure chambers, i.e. the conditions such as the thickness of the vibration plate and/or the thickness of the piezoelectric layer. Therefore, it is easy to determine the optimal value for the length A in the radial direction of the individual electrodes.

The method for producing the liquid transporting apparatus of the present invention may include: a vibration plate thickness measurement step of measuring a thickness of the vibration plate; a piezoelectric layer formation step of forming the piezoelectric layer at areas on a surface of the vibration plate opposite to the pressure chambers, each of the areas overlapping with the edge portion of one of the pressure chambers, such that a plurality of openings are formed at locations overlapping with central portions of the pressure chambers respectively as viewed in the direction perpendicular to the plane; a piezoelectric layer thickness measurement step of measuring a thickness of the piezoelectric layer; and an opening length measurement step of measuring a length in the radial direction of the openings, each of the openings overlapping with one of the pressure chambers and being an area in which the piezoelectric layer is partially absent as viewed in the direction perpendicular to the plane; wherein in the electrode length determination step, the relationship between the amount of deformation of the vibration plate when the voltage is applied to the individual electrodes and the value of A/(W/2) may be determined based on the thickness of the vibration plate, the thickness of the piezoelectric layer, and the length in the radial direction of the openings; and the length A in the radial direction of the individual electrodes may be determined based on the determined relationship.

When the piezoelectric layer is not formed at a portion which overlaps with the central portion of the pressure chamber and at which the individual electrode is not arranged, the rigidity of the piezoelectric actuator differs at the area overlapping with the central portion of the pressure chamber and another area overlapping with the edge portion of the pressure chamber. Accordingly, the relationship between the value of A/(W/2) and the amount of deformation of the vibration plate when the voltage is applied to the individual electrodes depends on each of the thickness of the vibration plate, the thickness of the piezoelectric layer, and the length in the radial direction of the openings. Accordingly, in the present invention, the thickness of the vibration plate, the thickness of the piezoelectric layer, and the length of the openings are measured, and based on the results of measurement, the relationship between the value of A/(W/2) and the amount of deformation of the vibration plate when voltage is applied to the individual electrodes is determined. Accordingly, it is possible to appropriately determine the value of A such that the amount of deformation of the vibration plate becomes great.

In the liquid transporting apparatus of the present invention, the pair of electrodes in each of the second portions may be disposed in confrontation with each other to sandwich the active portion therebetween in a predetermined direction, the predetermined direction being either one of the planar direction and the thickness direction, the active portion being polarized in a direction parallel to the predetermined direction, the electric field generated between the confronting electrodes in the predetermined direction changing a length of the active portion in the planar direction, thereby bending the corresponding second portions in the direction from one to the other of the first surface and the second surface, and consequently bending the first portion in the opposite direction from the other to the one of the first surface and the second surface, thereby deforming the operation portion in the thickness direction; the plate-shaped body may include a piezoelectric layer which is formed of a piezoelectric material and which defines the first surface, and the pair of electrodes which is formed to sandwich the piezoelectric layer therebetween to define the active portion in the piezoelectric layer sandwiched between the electrodes; the pair of electrodes in each of the second portions may include a first surface electrode and a second surface electrode, the first surface electrode being disposed on the first surface, the second surface electrode of the pair of electrodes in each of the pair of second portions being integrated with a metal layer formed of metal, and the metal layer defining the second surface on a surface of the metal layer opposite to the other surface thereof facing the piezoelectric layer; the active portion may be defined in each of the second portions at a location between the first surface electrode and the second surface electrode, the first surface electrode and the second surface electrode generating the electric field for deforming the active portion in the planar direction.

In the liquid transporting apparatus of the present invention, the pair of electrodes in each of the second portions may be disposed in confrontation with each other to sandwich the active portion therebetween in a predetermined direction, the predetermined direction being either one of the planar direction and the thickness direction, the active portion being polarized in a direction parallel to the predetermined direction, the electric field generated between the confronting electrodes in the predetermined direction changing a length of the active portion in the planar direction, thereby bending the corresponding second portions in the direction from one to the other of the first surface and the second surface, and consequently bending the first portion in the opposite direction from the other to the one of the first surface and the second surface, thereby deforming the operation portion in the thickness direction; the plate-shaped body may include a plurality of operation portions made of a plurality of piezoelectric material portions, the piezoelectric material portions being arranged in the planar direction separately from one another in the planar direction, the piezoelectric material portions defining the first surface; the pair of electrodes in each of the second portions may include a first surface electrode and a second surface electrode, the first surface electrode being disposed on the first surface, the second surface electrode of the pair of electrode in each of the pair of second portions being integrated with a metal layer formed of metal, and the metal layer defining the second surface on a surface of the metal layer opposite to the other surface thereof facing the piezoelectric material portions; and the active portion may be defined in each of the second portions at a location between the first surface electrode and the second surface electrode, the first surface electrode and the second surface electrode generating the electric field for deforming the active portion in the planar direction.

BRIEF DESCRIPTION OF THE DRAWINGS

FIG. 32 (FIGS. 32A to 32D) shows a process for producing an ink-jet head, wherein

FIG. 44 (FIGS. 44A to 44D) shows a process for producing the ink-jet head of the eleventh embodiment, wherein

PREFERRED EMBODIMENT OF THE INVENTION

First Embodiment

Figure 1:
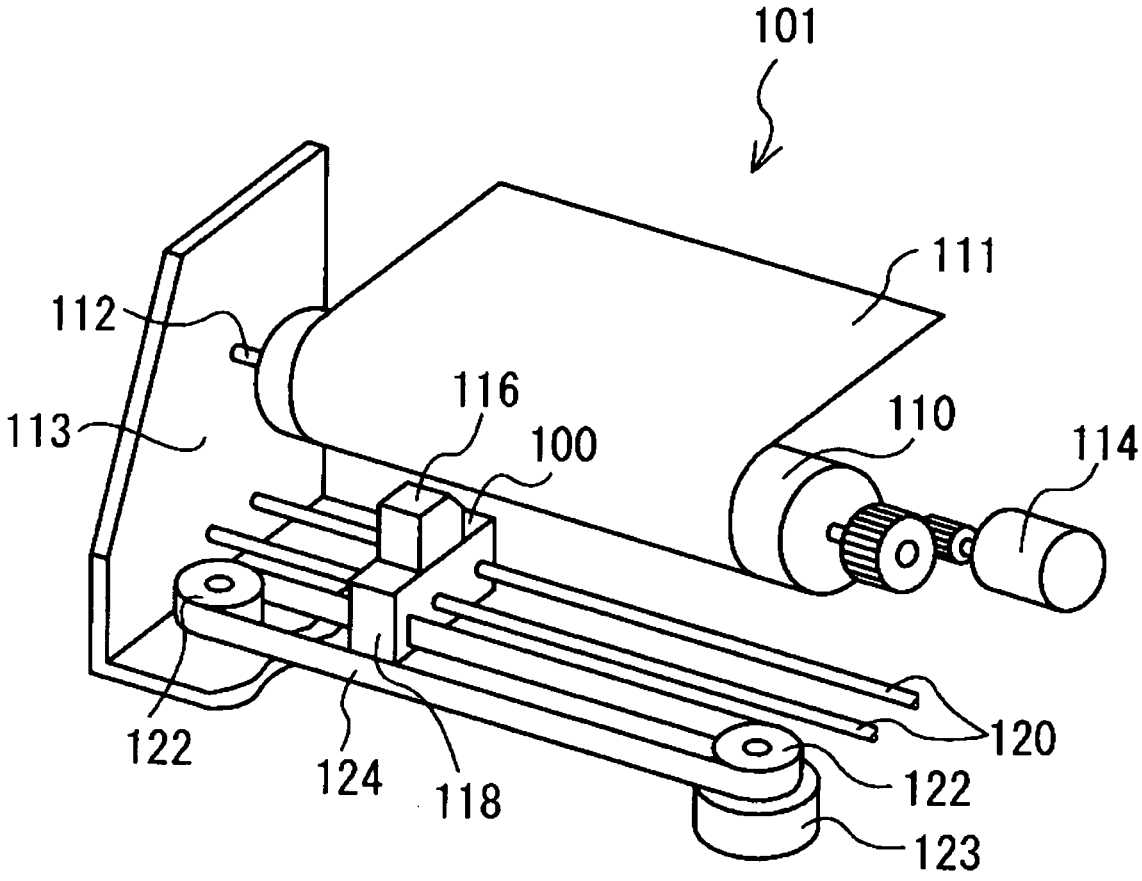
FIG. 1 is a perspective view of major portions of an ink-jet printer 101.

In the following, a first embodiment of the present invention will be explained with reference to the drawings. First, with reference to FIG. 1, an explanation will be given about a construction of an ink-jet printer 101 carrying an ink-jet head 100 as an example of a fluid transporting apparatus provided with a piezoelectric actuator. FIG. 1 is a perspective view of major portions of the ink-jet printer 101.

As shown in FIG. 1, the ink-jet printer 101 includes a platen roller 110 as a sheet transporting means to transport a sheet 111 as a recording objective, and a carriage 118 on which an ink-jet head 100 and an ink cartridge 116 to be filled with an ink are to be mounted. The ink-jet head 100 is arranged in the carriage 118 at a position facing the platen roller 110 to perform printing on the sheet 111. The platen roller 110 is rotatably attached to a frame 113 by a shaft 112, and is driven to rotate by a motor 114. The carriage 118 is slidably supported by two guide rods 120, which are arranged in parallel with the rotational axis of the platen roller 110, and is coupled to a timing belt 124 provided around a pair of pulleys 122. One of the pulleys 122 is driven in both forward and in reverse directions by a motor 123, thereby reciprocating the carriage 118 along the platen roller 110.

The sheet 111 is supplied from a sheet supply cassette (not shown) provided to the side of the ink-jet printer 101, and transported between the ink-jet head 100 and the platen roller 110. The ink-jet head 100 ejects ink onto the sheet 111 to perform a predetermined printing on the sheet 111. Afterward, the sheet 111 is discharged from the ink jet printer 101. It should be noted that mechanisms for supplying and discharging the sheet 111 are omitted in FIG. 1.

Figure 2:
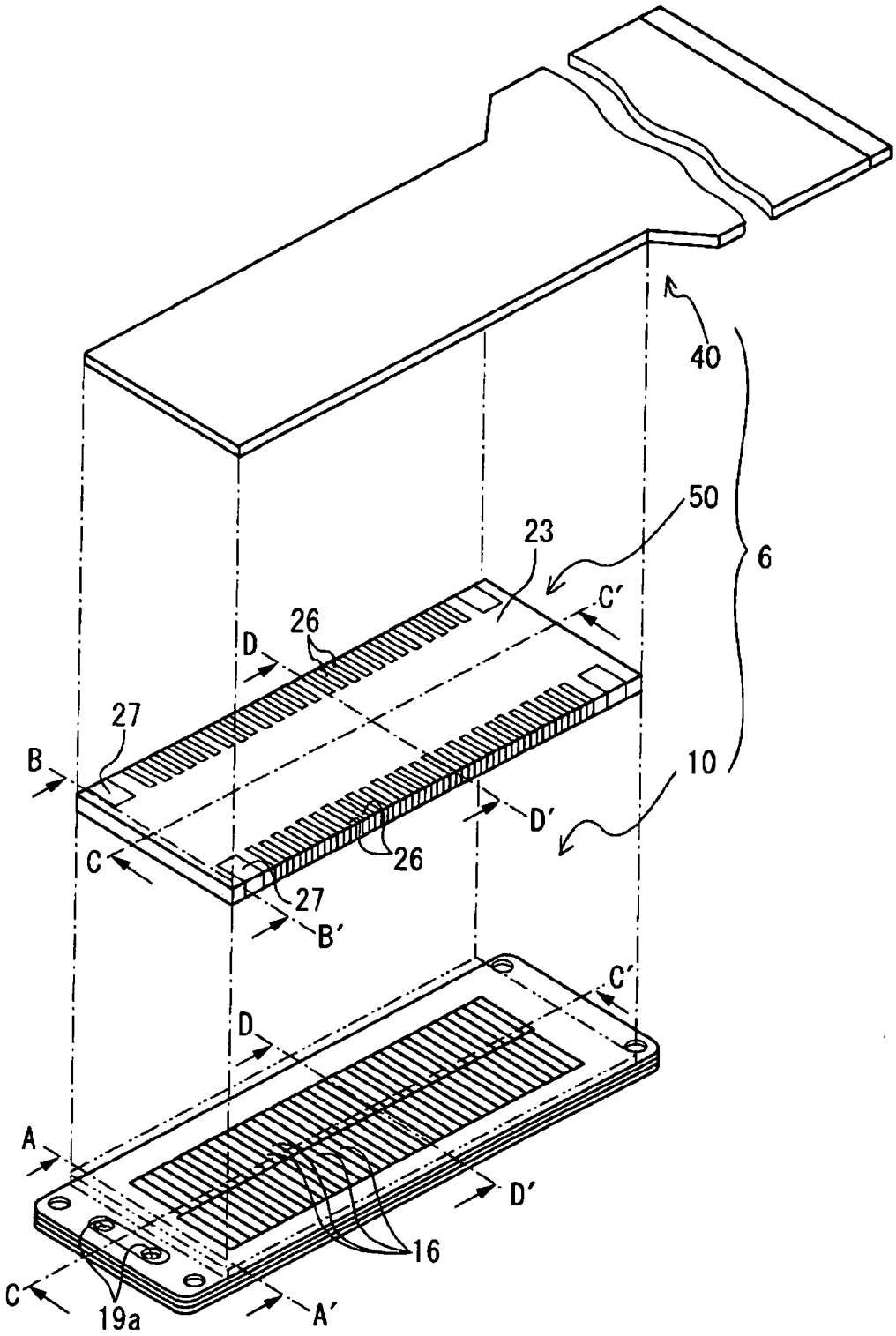
FIG. 2 is an exploded perspective view of an ink-jet head 100.
Figure 3:
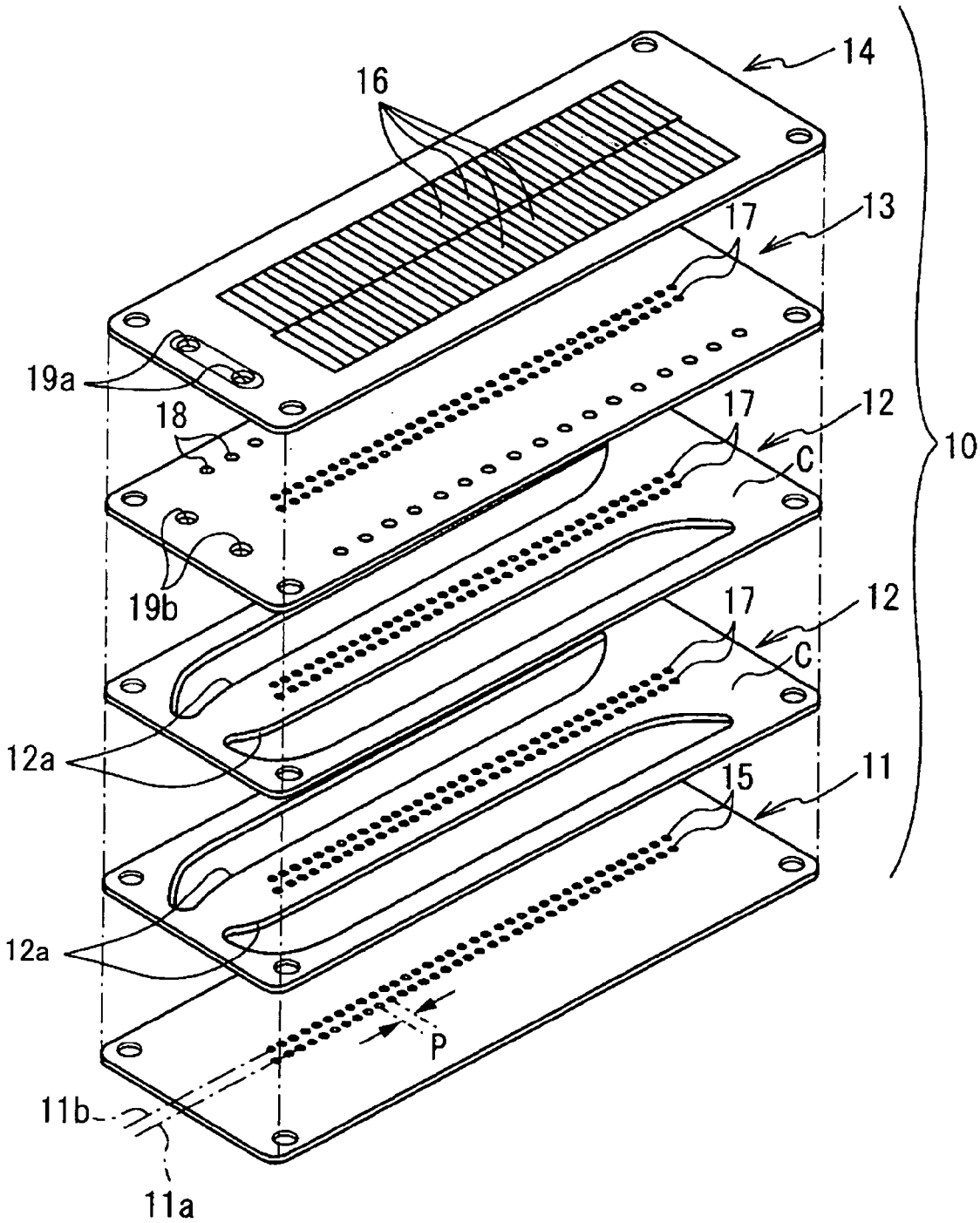
FIG. 3 is an exploded perspective view of a cavity plate 10.
Figure 4:
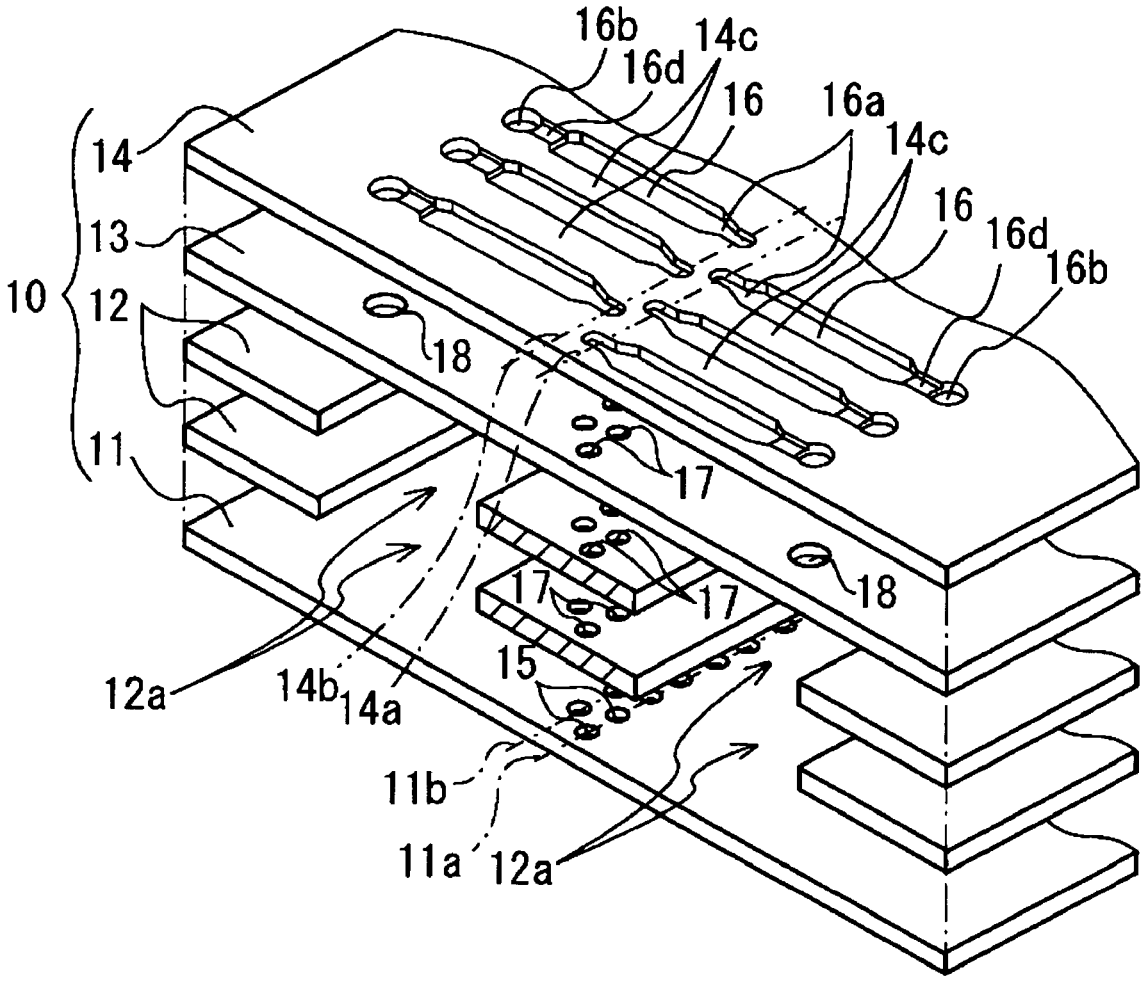
FIG. 4 is an exploded sectional perspective view of major portions of the cavity plate 10 as viewed in a direction of an arrow taken along a one-dot chained line A-A' in FIG. 2.
Figure 5:
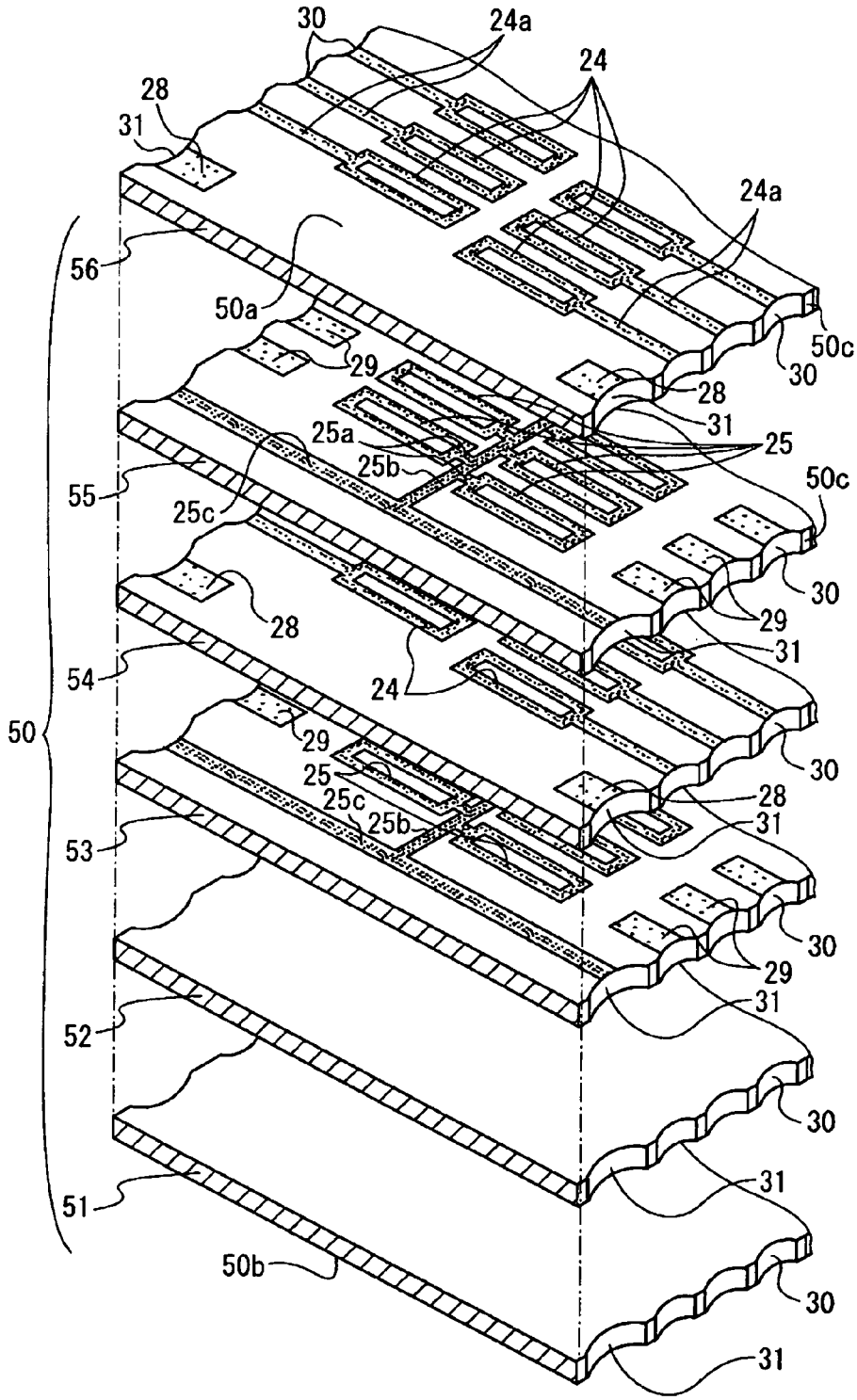
FIG. 5 is an exploded sectional perspective view of major portions of a piezoelectric actuator 50 as viewed in a direction of an arrow taken along a one-dot chained line B-B' (V-V) in FIG. 2.
Figure 6:
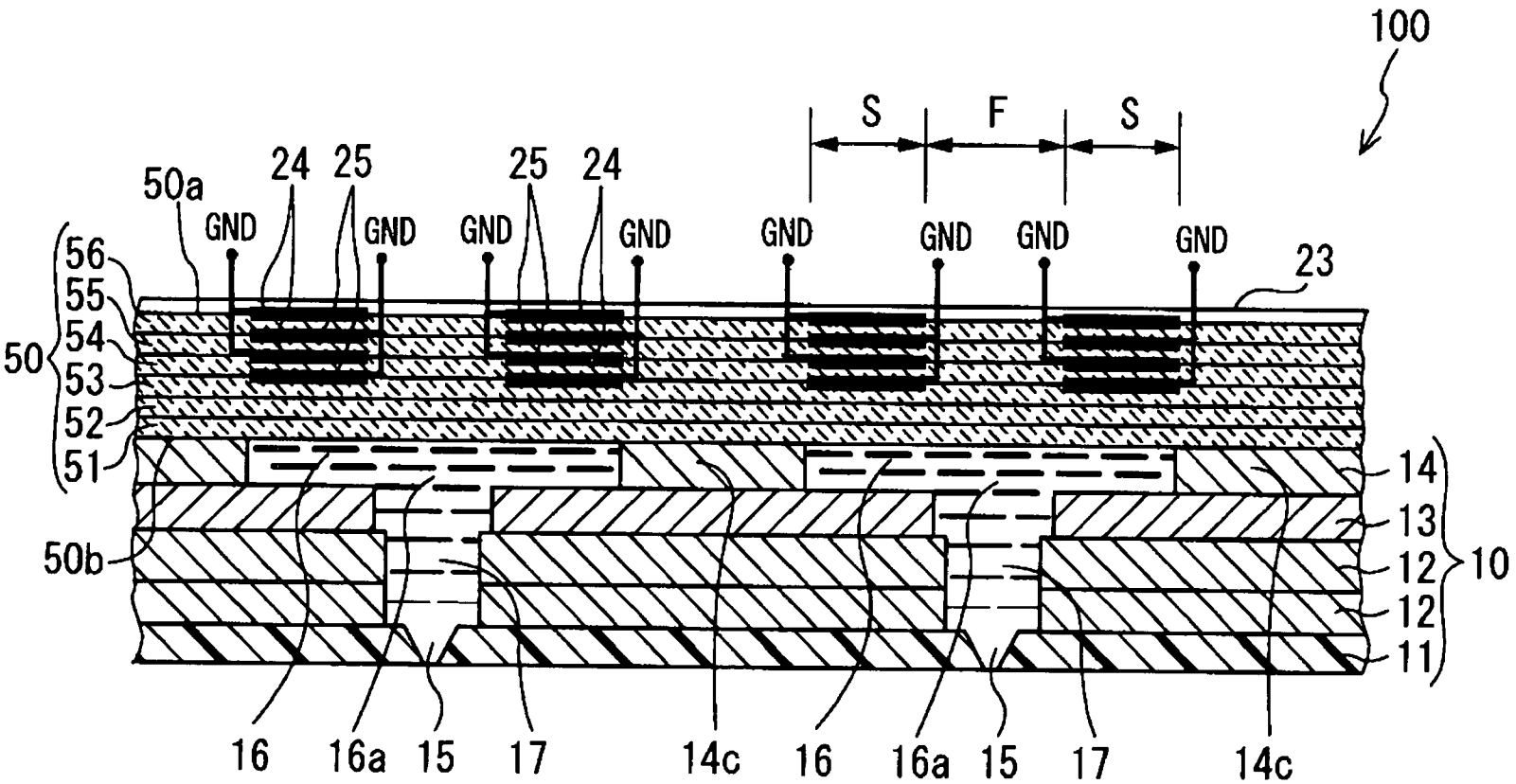
FIG. 6 is a partial sectional view of major portions of the ink-jet head 100 as viewed in a direction of an arrow taken along a one-dot chained line C-C' in FIG. 2.
Figure 7:
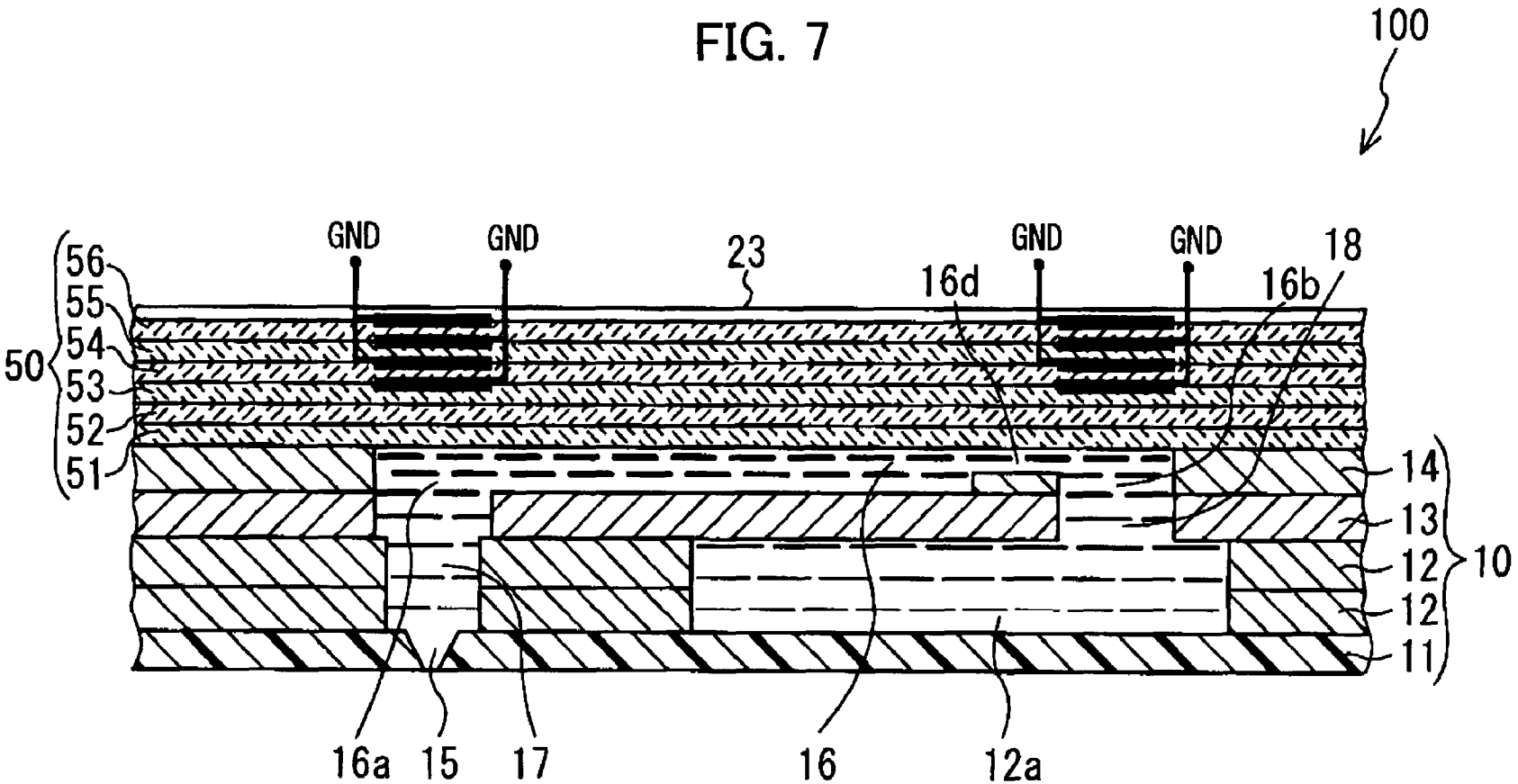
FIG. 7 is a partial sectional view of major portions of the ink-jet head 100 as viewed in a direction of an arrow taken along a one-dot chained line D-D' in FIG. 2.

Next, with reference to FIGS. 2 to 7, an explanation will be given about a construction of the ink-jet head 100 provided with a piezoelectric actuator 50 of the first embodiment. FIG. 2 is an exploded perspective view of the ink-jet head 100. FIG. 3 is an exploded perspective view of a cavity plate 10. FIG. 4 is an exploded sectional perspective view of major portions of the cavity plate 10 as viewed in a direction of an arrow taken along a one-dot chained line A-A' in FIG. 2. FIG. 5 is an exploded sectional perspective view of major portions of the piezoelectric actuator 50 as viewed in a direction of an arrow taken along a one-dot chained line B-B' in FIG. 2. FIG. 6 is a partial sectional view of the cavity plate 10 and the piezoelectric actuator 50 as viewed in a direction of an arrow taken along a one-dot chained line C-C' in FIG. 2. FIG. 7 is a partial sectional view of the cavity plate 10 and the piezoelectric actuator 50 as viewed in a direction of an arrow taken along a one-dot chained line D-D' in FIG. 2.

As shown in FIG. 2, the ink-jet head 100 is constructed of a cavity plate 10, a piezoelectric actuator 50, and a flexible flat cable 40 stacked on and joined to each other with an adhesive. The piezoelectric actuator 50 has a plate shape and is stacked on and adhered to the cavity plate 10 via adhesive or an adhesive sheet. The cavity plate 10 is constructed of a plurality of sheets stacked in a laminated state. The flexible flat cable 40 is stacked on and adhered to the upper surface of the piezoelectric actuator 50 so as to electrically connect the piezoelectric actuator 50 to an external device. The cavity plate 10, which is the lowermost layer of the stack, is provided with nozzles 15 (see FIG. 3) which are open on a lower surface of the cavity plate 10 and through which the ink is ejected downwardly.

As shown in FIG. 3, the cavity plate 10 is constructed of five thin metal plates, namely a nozzle plate 11, two manifold plates 12, a space plate 13 and a base plate 14 in which these five plates are stacked on each other in a laminated state and joined together with an adhesive. Each of these plates 11 to 14 is made of, for example, a 42% Nickel alloy steel plate (42 alloy) and has a thickness of about 50 μm to 150 μm.

As shown in FIGS. 4, 6, and 7, a plurality of narrow-width pressure chambers 16 are formed through the base plate 14. The pressure chambers 16 are juxtaposed in staggered rows on the base plate 14. The pressure chambers 16 extend in a direction perpendicular to center lines 14*a*, 14*b* which indicate the longitudinal direction of the base plate 14. The pressure chambers 16 are separated from one another by partition walls 14*c*. Ink supply holes 16*b* are formed also on the base plate 14 corresponding to the pressure chambers 16 respectively. Each of the ink supply holes 16 is formed through the base plate at a position on a right or left edge side of one of the pressure chambers in a short direction of the base plate 14. Throttle sections 16*d* are formed between the pressure chambers 16 and the ink supply holes 16*b* so as to connect the pressure chambers 16 and the ink supply holes 16*b* respectively. Ink supply holes 18 are formed through the space plate 13 at positions on left and right portions respectively in a short direction of the manifold plate 13. Each of the ink supply holes 16*b* communicates, through one of the ink supply holes 18, with one of common ink chambers 12*a* in the manifold plate 12. Each of the throttle sections 16*d* is formed with a smaller cross-sectional area than that of the pressure chamber 16, with respect to a direction perpendicular to a direction of the ink flowing through the throttle section 16*d*. The throttle sections 16*d* are formed to have the smaller cross-sectional area so as to increase the resistance in the channel. Further, small-diameter through-holes 17 are formed through the spacer plate 13 and the two manifold plates 12 in the same staggered pattern as the pressure chambers 16. Each of the pressure chambers 16 has an end portion 16*a*. Each of the small-diameter through-holes 17 is communicated with the end portion 16*a* of one of the pressure chambers 16. It should be noted that the pressure chamber 16 is the "fluid accommodating chamber" in the present invention, and the base plate 14 is the "fluid accommodating plate" in the present invention.

As shown in FIGS. 3, 6 and 7, the spacer plate 13 is formed with ink supply holes 19*b*, and the base plate 14 is formed with ink supply holes 19*a*. The ink supply holes 19*a*, 19*b* are for supplying ink from the ink cartridge 116 to common ink chambers 12*a* of the manifold plates 12. In the two manifold plates 12, two ink chambers 12*a* are provided along the longitudinal direction of the plate, with the arrays formed by the plurality of nozzles 15 in the nozzle plate 11 intervening between the ink common chambers. These common ink chambers 12*a* are formed through each of the manifold plates 12, and located within a plane parallel to a plane defined by the plurality of pressure chambers 16 in the base plate 14. Further, the common ink chambers 12*a* are formed in the two manifold plates 12 such that the common ink chambers 12*a* are positioned closer to the nozzle plate 11 than the pressure chambers 16, and that the common ink chambers extend longer than the pressure chambers 16 in a direction of the arrays defined by the plurality of nozzles 15.

Each of the ink common chambers 12*a* includes an end portion (C portion) disposed at a position apart from the ink supply holes 19*a*, 19*b*, and has a shape such that the cross-sectional area at the C portion is decreased at a fixed rate in a direction farther away from the ink supply holes 19*a*, 19*b*. This shape facilitates the discharge of residual air bubbles which tend to be trapped or collected in the end portion (C portion) in the common ink chambers 12*a*. The common ink chambers 12*a* are constructed such that the common ink chambers are sealed by the nozzle plate 11 and the spacer plate 13 stacked on either side of the two manifold plates 12.

The nozzles 15 are formed through the nozzle plate 11 aligned in staggered rows along center lines 11*a*, 11*b* which extend in the longitudinal direction of the nozzle plate 11. Each of the nozzles 15 has a small diameter of, for example, about 25 μm. The nozzles 15 in one of the rows are staggered from the nozzles 15 of the other row, and adjacent nozzles 15 of the same row are separated by a small pitch P. Each of the nozzles 15 corresponds to one of the through-holes 17 of the manifold plates 12. The nozzle 15 is the "ejection hole" and the nozzle plate 11 is the "hole-defining portion" in the present invention.

As shown in FIGS. 5 to 7, the piezoelectric actuator 50 is constructed of a stack of six piezoelectric sheets 51, 52, 53, 54, 55, 56 formed from a lead zirconate titanate (PZT) type piezoelectric ceramic material. On the upper surface of each of these piezoelectric sheets 54 to 56, electrodes, to be described later on, will be formed, for example, by screen printing using a conductive paste material or by deposition of a conductive material. The collective body, formed of the piezoelectric sheets 51 to 56, is the "plate-shaped body" in the present invention.

On the upper surfaces of the piezoelectric sheets 54 and 56, a plurality of drive electrodes 24 are provided in a staggered array in a one-to-one correspondence to the pressure chambers 16 in the cavity plate 10, extending in a direction perpendicular to the longitudinal direction of the piezoelectric sheet 54 or 56. Each of the drive electrodes 24 is formed so as to cover the surface area of the corresponding pressure chamber 16 in the planar direction of the cavity plate 10, and formed to have a circular shape to be arranged along an outer periphery of the corresponding pressure chamber 16. Each of the drive electrodes 24 includes a wiring portion 24*a* which is formed to extend from one end of each drive electrode 24. The wiring portions 24*a* are exposed in left or right side surfaces 50*c* in the longitudinal direction of the piezoelectric actuator 50, the side surfaces 50*c* being disposed on left or right sides perpendicular to top and bottom sides 50*a*, 50*b* of the piezoelectric actuator 50.

On the upper surfaces of the piezoelectric sheets 53 and 55, a plurality of common electrodes 25 are formed as a ground electrode which is common for the pressure chambers 16. The common electrodes 25 are arranged at positions corresponding to the drive electrodes 24 respectively, in a staggered array similar to the drive electrodes 24. The common electrodes 25 have the same shape as the drive electrodes 24, and include wiring portions 25*a* each of which extends from one end thereof. Each of the wiring portions 25*a* is connected to a common wiring portion 25*b* which extends along the center of the piezoelectric sheets 53 or 55 in the longitudinal direction of the piezoelectric sheets 53 or 55. The ends of the common wiring portion 25*b* are connected to common wiring portions 25*c* arranged to extend along both end portions in the longitudinal direction of the piezoelectric sheets 53 or 55. Both ends of the common wiring portion 25*c* are exposed in the left and right side surfaces 50*c* respectively, in the same manner as the wiring portions 24*a* of the drive electrodes 24.

It should be noted that electrodes 28, 29 serve as dummy patterns and are formed along both ends in the longitudinal direction of the piezoelectric sheets 53 to 56 at positions which correspond to the wiring portions 25*c*, 24*a*, respectively.

In the left and right side surfaces 50*c* of the piezoelectric actuator 50, first grooves 30 and second grooves 31 are formed so as to extend in the direction in which the piezoelectric sheets 51 to 56 are stacked. The first grooves 30 are formed to correspond to the wiring portions 24*a* of the drive electrodes 24 respectively. The second grooves 31 are formed to correspond to the both end portions of each of the common wiring portions 25*c* of the common electrodes 25. Although not shown in the drawings, side-surface electrodes are formed in the first and second grooves 30, 31. The side-surface electrodes in the first grooves 30 electrically connect the drive electrodes 24 and the dummy pattern electrodes 29 respectively, and the side surface electrodes in the second grooves 31 electrically connect the common electrodes 25 and the dummy pattern electrodes 28 respectively. As shown in FIG. 2, an insulating sheet 23 is adhered to the upper surface of the piezoelectric actuator 50 (on the side of the stacked piezoelectric sheet 56). Electrodes 26, 27 are provided on the insulation sheet 23, and the side surface electrodes 30, 31 are connected to electrodes 26, 27, respectively. That is, the drive electrodes 24 are electrically connected to the electrodes 26 respectively, and the common electrodes 25 are electrically connected to the electrodes 27 respectively. Each of the electrodes 26, 27 is connected to a corresponding contact point (not shown) of the flexible flat cable 40. It should be noted that the electrodes can be connected to the flexible flat cable 40 alternatively with electric through-holes penetrating through the piezoelectric sheets in the stacking direction, other than the above-described method for extending the electrodes.

The piezoelectric sheets 54, 56, which are formed with the drive electrodes 24, are stacked in alternation with the piezoelectric sheet 53, 55, which are formed with the common electrodes 25. Then, the sheets 51, 52, which are not formed with any electrodes, are stacked on the pressure chamber 16 side of the piezoelectric sheet 53. The stack of piezoelectric sheets 51 to 56 are then sintered into an integral block. In a well-known manner, the portions in the piezoelectric sheets 54 to 56, interposed between the electrodes 24, 25 in the stacked direction, are polarized by connecting the common electrodes 25 to ground (GND) and applying the drive electrodes 24 with a high, positive voltage for polarization through the electrodes 26, 27, the portions being polarized in a direction P from the drive electrodes 24 to the common electrodes 25 (see FIG. 8).

The electrodes 24, 25 of the piezoelectric actuator 50 are positioned in a circular manner along the outer periphery of the pressure chambers 16 in a plan view, as shown in FIGS. 6 and 7. In this piezoelectric actuator 50, the portion having the electrodes 24, 25 in a plan view is designated as "second portion" S, and the portion surrounded by the second portion S in a plan view is designated as "first portion" F, respectively. Namely, in the direction of cross section, a pair of second portions S (although the second portion is actually continuously formed in a circular manner) is disposed on both sides of a first portion F respectively. The electrodes 24, 25 are unevenly disposed in a thickness direction of each of the second portions S, at a location away from the corresponding pressure chamber 16. In the stack direction of the piezoelectric sheets 54 to 56, the portions which are sandwiched between the electrodes 24, 25 construct a pressure generating portion which deforms due to the piezoelectric effect when applied with a voltage, and first and second portion F, S construct an operation portion which deforms based on the deformation of the pressure generating portion.

The piezoelectric actuator 50 is joined to the cavity plate 10 such that the operation portions, each of which is formed of one first portion F and second portion S disposed on both sides of the first portion, correspond to the pressure chambers 16, respectively. At this time, the lower surface portions of the outer sides of the second portions S with respect to the first portions F (namely, portions in between adjacent operation portions) are positioned above partition walls 14*c* between the pressure chambers 16 and firmly attached to the partition walls 14*c*, respectively. In the present invention, the partition wall 14*c* constructs "fixed portion" in the present invention.

As shown in FIG. 6, in an initial condition, the drive electrodes 24 and the common electrodes 25 are all connected to ground (GND) and thus have an electric potential of 0V. Also, ink supplied from the common ink chambers 12*a* fills the pressure chambers 16 up to the end portions of the nozzles 15.

Figure 8:
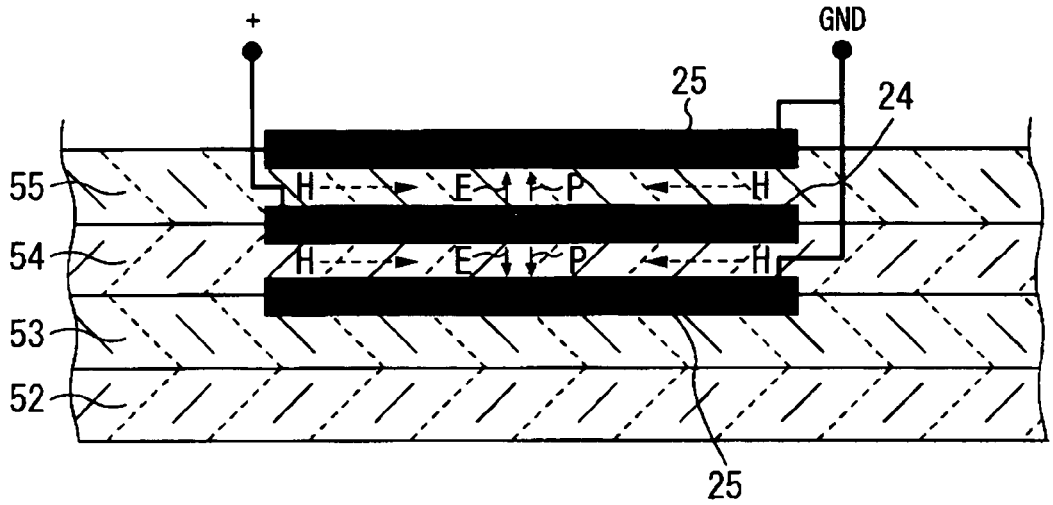
FIG. 8 is a partial enlarged sectional view of the piezoelectric actuator 50.
Figure 9:
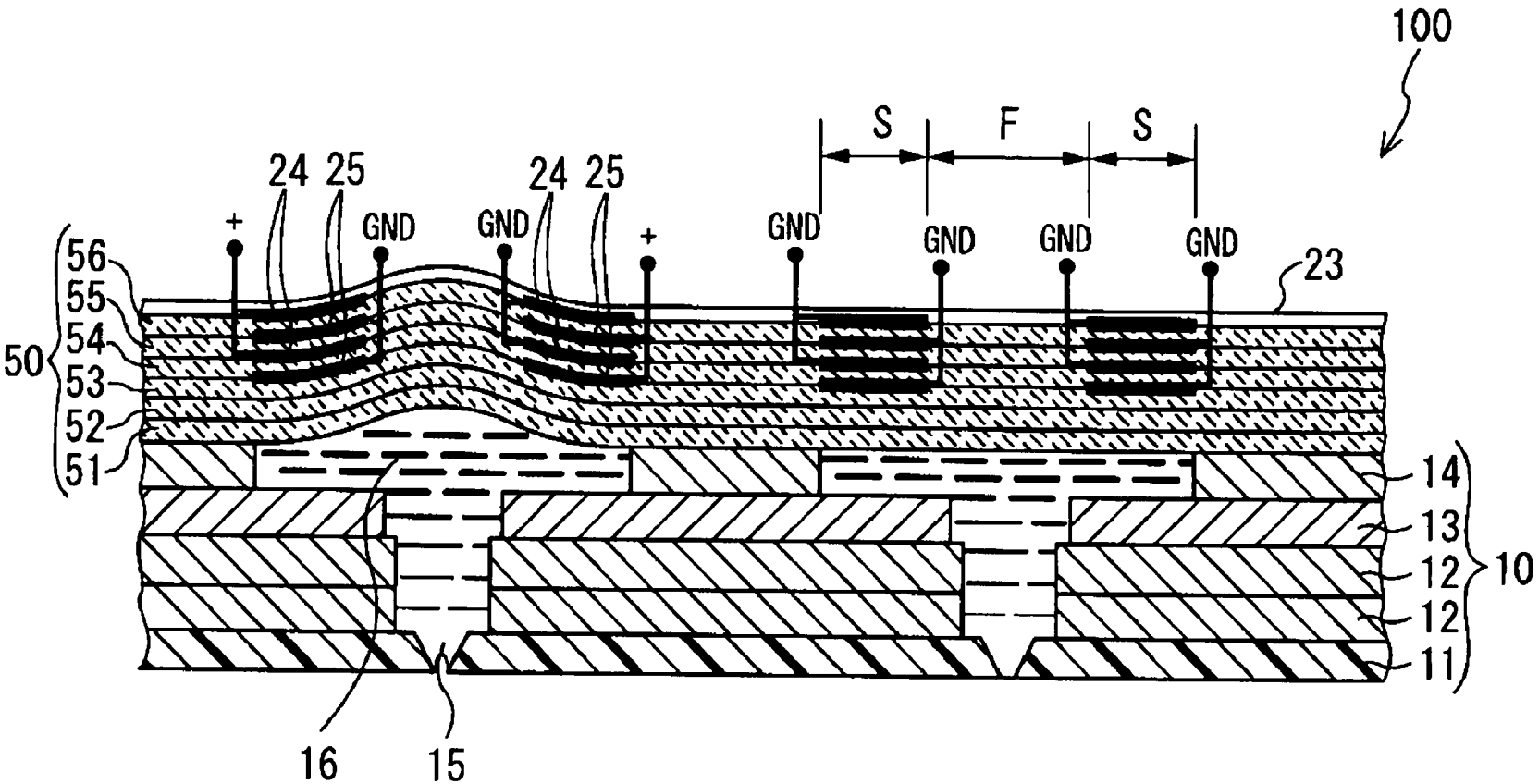
FIG. 9 is a sectional view of the piezoelectric actuator 50 corresponding to FIG. 6 when voltage is applied to the actuator.

When, according to a predetermined print data, ink is to be ejected from a nozzle 15 communicating with one of the pressure chambers 16, then as shown in FIG. 9, drive voltage is applied to a pressure-generating portion corresponding to the pressure chamber 16. That is, the drive voltage of, for example, 20V is applied to the electrodes 24 while the common electrodes 25 are maintained in connection with ground (GND). At this time, as shown in FIG. 8, since the direction P of polarization matches the direction E of the electric field, the piezoelectric vertical effect elongates the portions of the piezoelectric sheets 54 to 56, located between the electrodes 24 and 25, in the direction P of polarization. It is noted, however, that each of the portions of the piezoelectric sheet 54 to 56 between the electrodes 24 and 25 is sufficiently wider in the planar direction H, which is perpendicular to the direction P of polarization, than it is thick in the direction P of polarization. Therefore, the piezoelectric horizontal effect greatly contracts the portions of the piezoelectric sheet 54 to 56 in the planar direction H.

While the pressure generating portion contracts in the planar direction H, however, portions of piezoelectric sheets 51 to 53, which are sandwiched between no electrodes and which are located adjacent to the pressure generating portion in the stack direction, do not deform. Therefore, as shown in FIG. 9, the second portion S overall bends in an arch shape with the pressure-generating portion being positioned at the valley of the arch. At this time, since the second portion S is fixed to a partition wall 14*c* at the outer side thereof, the second portion S arches or bends, at the side nearer to the first portion F, greatly in a direction away from the cavity plate 10. Further, with respect to a pressure chamber 16, a pair of second portions S disposed along the outer periphery of the pressure chamber 16 bends symmetrically with respect to the center of the pressure chamber. Therefore, the bending action of the second portions S presses the corresponding first portion F to project upward in the direction substantially perpendicular to the planar direction of the piezoelectric actuator. Namely, both the first and second portions F, S bend in a direction that increases the volume of the pressure chamber 16. As a result, the pressure in the pressure chamber 16 reduces to a negative pressure so that ink is supplied to the pressure chamber 16 from the common ink chamber 12*a*.

Figure 10:
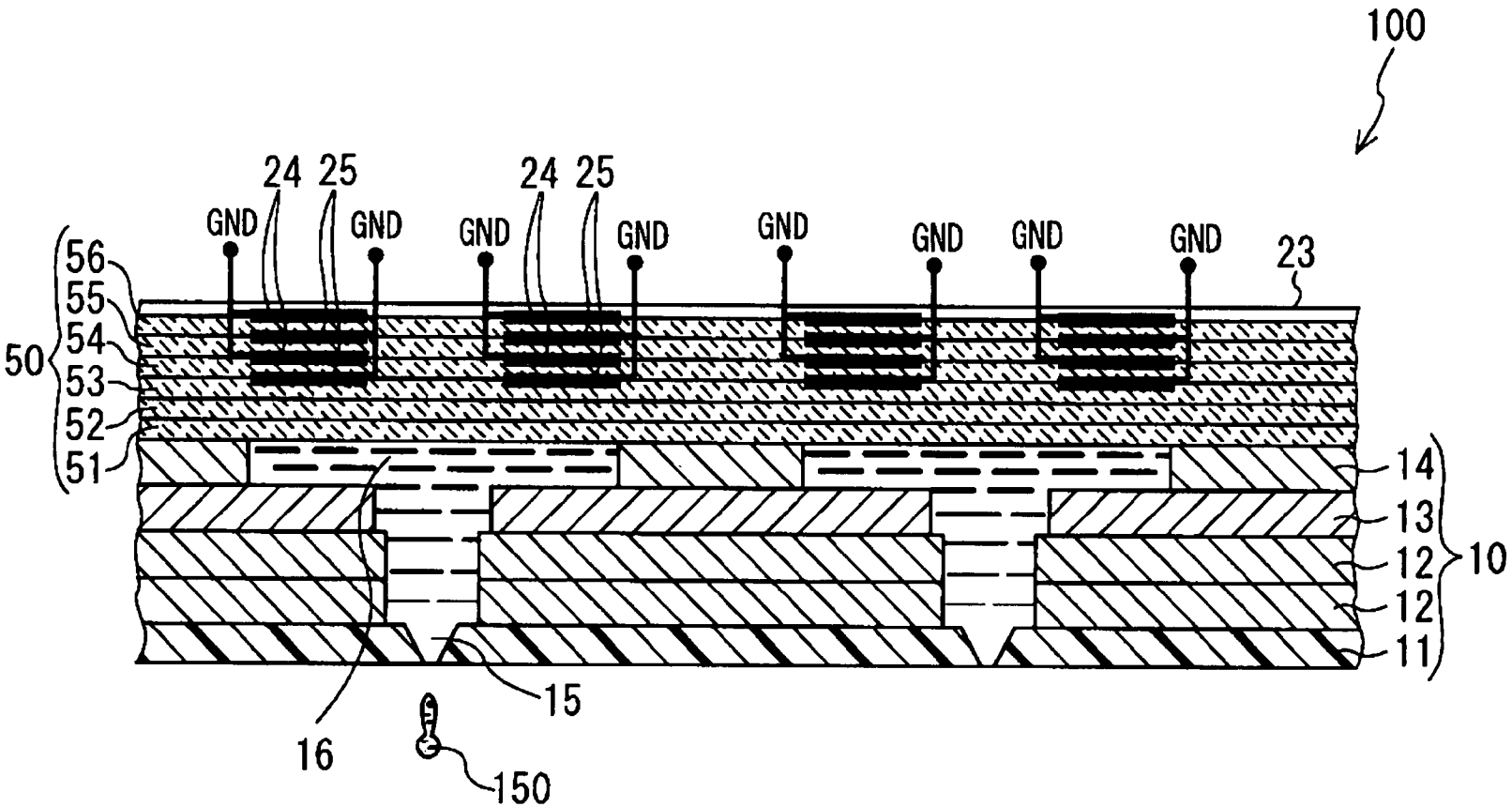
FIG. 10 is a sectional view of the piezoelectric actuator 50 corresponding to FIG. 6 when the application of the voltage to the actuator is stopped.

At this time, pressure waves are generated in the pressure chamber 16. As is well known, when the time required for the pressure waves to propagate one-way in the longitudinal direction of the pressure chamber 16 is elapsed, the pressure in the pressure chamber 16 switches to a positive pressure. Therefore, the voltage applied to the drive electrodes 24 is released to be switched to 0V at this timing. Then, as shown in FIG. 10, the pressure-generating portion of the piezoelectric actuator 50 returns to its initial condition before the deformation, and the first and second portions F, S also resiliently revert to the initial flat state.

At this time, the pressure from the positive pressure wave and the pressure generated when the piezoelectric actuator 50 reverts to its initial condition are synthesized to generate a relatively high pressure near a nozzle 15 corresponding to the pressure chamber 16, and an ink droplet 150 is ejected through the nozzle 15 as a result. In this way, the ink-jet head 100 of the present embodiment is capable of ejecting droplets by a so-called "pulling ejection". It should be noted that, among the six piezoelectric sheets 51 to 56 constructing the piezoelectric actuator 50 of the first embodiment, the three piezoelectric sheets 54, 55, 56 disposed on the side of the cavity plate 10 in this order need not to be formed of a piezoelectric material, and may be formed of, for example, a metallic material.

Second Embodiment

Figure 11:
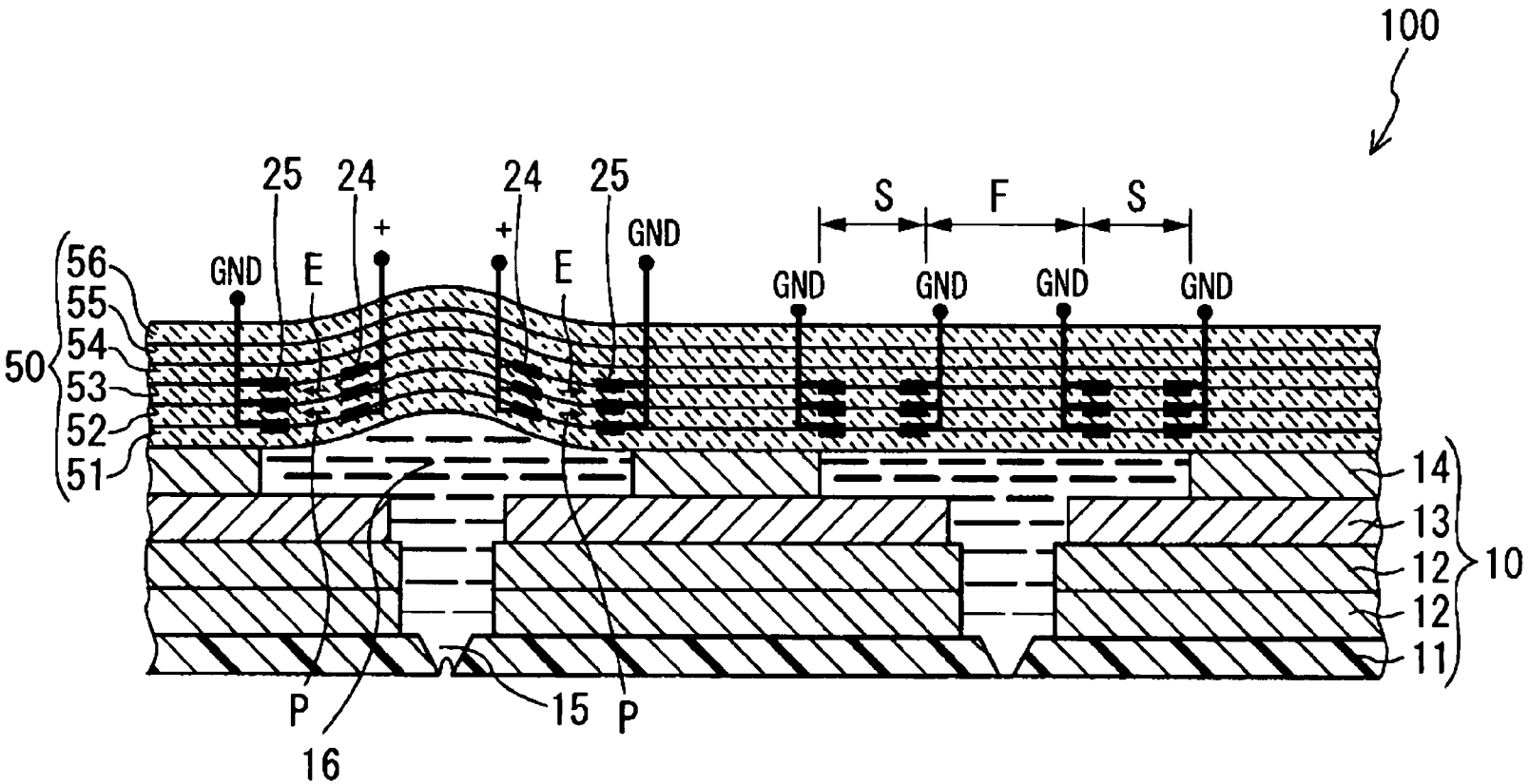
FIG. 11 is a partial sectional view of an ink-jet head 100 of a second embodiment.

Next, an ink-jet head 100 including a piezoelectric actuator 50 according to a second embodiment will be explained with reference to FIG. 11. It should be noted that the ink-jet head 100 of this embodiment includes a cavity plate 10 with the same configuration as the cavity plate 10 of the first embodiment.

In the same manner as in the first embodiment, the piezoelectric actuator 50 has a first portion F and a pair of second portions S corresponding to each of the pressure chambers 16. In this embodiment, in the second portions S, electrodes 24, 25 are arranged between adjacent layers of the piezoelectric sheets 51 to 53 which are located close to the pressure chambers 16 in the thickness direction of the piezoelectric actuator. The common electrodes 25 are arranged between the adjacent layers of the piezoelectric sheets 51 to 53 in the direction in which the piezoelectric sheets are stacked, along the outer periphery of each of the pressure chambers 16. The drive electrodes 24 are arranged between the adjacent layers of the piezoelectric sheets in the direction in which the piezoelectric sheets are stacked, at locations in which the drive electrodes 24 are spaced, from the corresponding electrodes 25 respectively, to the inner side in the planar direction. The piezoelectric sheets are polarized in the planar direction P of the piezoelectric sheets by applying a high, positive voltage to the drive electrodes 24 and by connecting the common electrodes 25 to ground (GND).

Thus, in the same way as in the above-described embodiment, in the piezoelectric actuator 50 in which the drive electrodes 24 and the common electrodes 25 are arranged in this manner, the drive electrodes 24 and the common electrodes 25 are initially connected to ground (GND) when a printing operation of the ink-jet printer 101 is to be started. Then, when ink is to be ejected, according to a predetermined print data, from a nozzle 15 corresponding to one of the pressure chambers 16, then, while maintaining the common electrodes 25 in connection with ground (GND), a drive voltage is applied to the drive electrodes 24 that correspond to the pressure chamber 16 that is in fluid communication with the nozzle 15. As a result, an electric field E, which is in the same direction as the polarization direction P, is generated from the inner-side drive electrodes 24 toward the outer-side common electrodes 25, thereby increasing, due to the piezoelectric vertical effect, the distance between the drive electrodes 24 and the common electrodes 25 respectively arranged in the planar direction of the piezoelectric actuator 50.

At this time, the piezoelectric sheets 54 to 56 in which no electrodes are arranged do not deform, and a unimorphic deformation is generated between the piezoelectric sheets 51 to 53 which attempt to elongate in the planar direction. That is, the second portion S archingly deforms, with its side of the piezoelectric sheets 54 to 56 as the inner side of the arch. However, as in the above-described embodiment, since the outer periphery of the pressure chamber 16 is fixed, the second portion S deforms greatly upward at its portion that is substantially nearer to the center of the pressure chamber 16. In association with this, the first portion F also archingly bends to protrude upward in a direction away from the pressure chamber 16. When application of voltage to the drive electrodes 24 is stopped, then the piezoelectric actuator 50 resiliently reverts to its flat condition, thereby applying pressure to the ink in the pressure chamber 16 to eject the ink from the nozzle 15.

Third Embodiment

Figure 12:
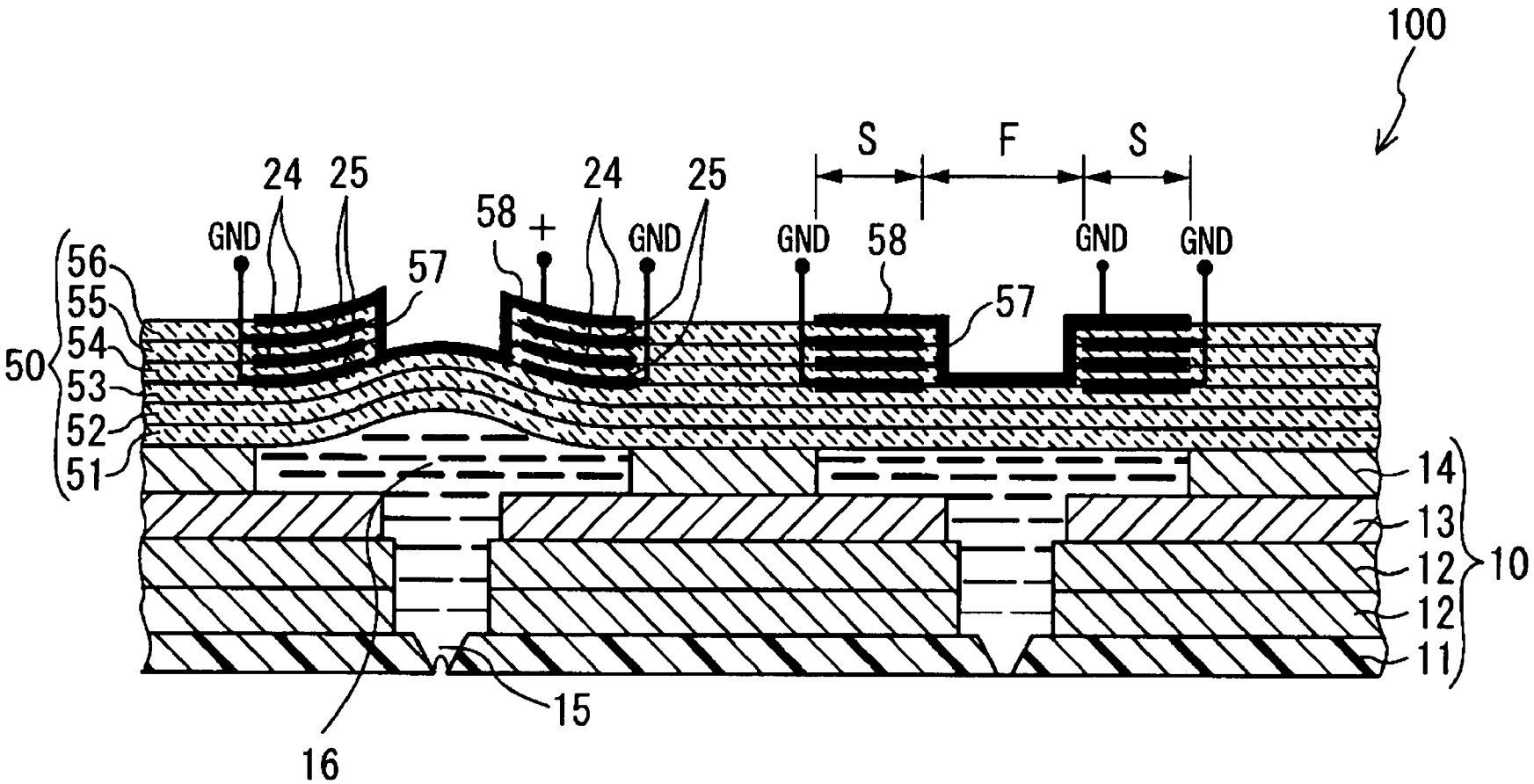
FIG. 12 is a partial sectional view of an ink-jet head 100 of a third embodiment.

Next, an ink-jet head 100 including a piezoelectric actuator 50 according to a third embodiment of the present invention will be explained with reference to FIG. 12. The piezoelectric actuator 50 of the present embodiment has a configuration similar to the piezoelectric actuator 50 of the first embodiment, except that a notch 57 is formed in the surface of each of the first portions F at a position shifted in the thickness direction of the piezoelectric actuator 50 in the direction in which the first portion F archingly deforms. In other words, the notch 57 is formed on the surface of each of the first portion F opposite to one of the pressure chambers 16. Further, a connection electrode 58 is formed, for example, by continuously depositing a conductive material on the inner surface of the notch 57 and on the surface of the piezoelectric actuator 50. A wiring which extends from either the drive electrodes 24 or the common electrodes 25 is connected to the connection electrode 58, and to an external power source through the connection electrode 58.

The notch 57 reduces thickness of the first portion F so that thickness of the first portion F is constructed of only a portion located nearer to the pressure chamber 16, thereby reducing the rigidity of the first portion F. Accordingly, the first portion F bends under deformation of the second portions S with smaller resistance. Thus, as the second portions deforms more greatly, the first portion F also deforms greatly and the volume of the pressure chamber 16 changes also greatly. Here, instead of providing the notch 57, other configurations can be provided so as to cause the piezoelectric actuator 50 deform easily. For example, the first portion F may be partially formed of a material that has low rigidity. Alternatively, a hollow portion may be formed in a part of the first portion F.

Fourth Embodiment

Figure 13:
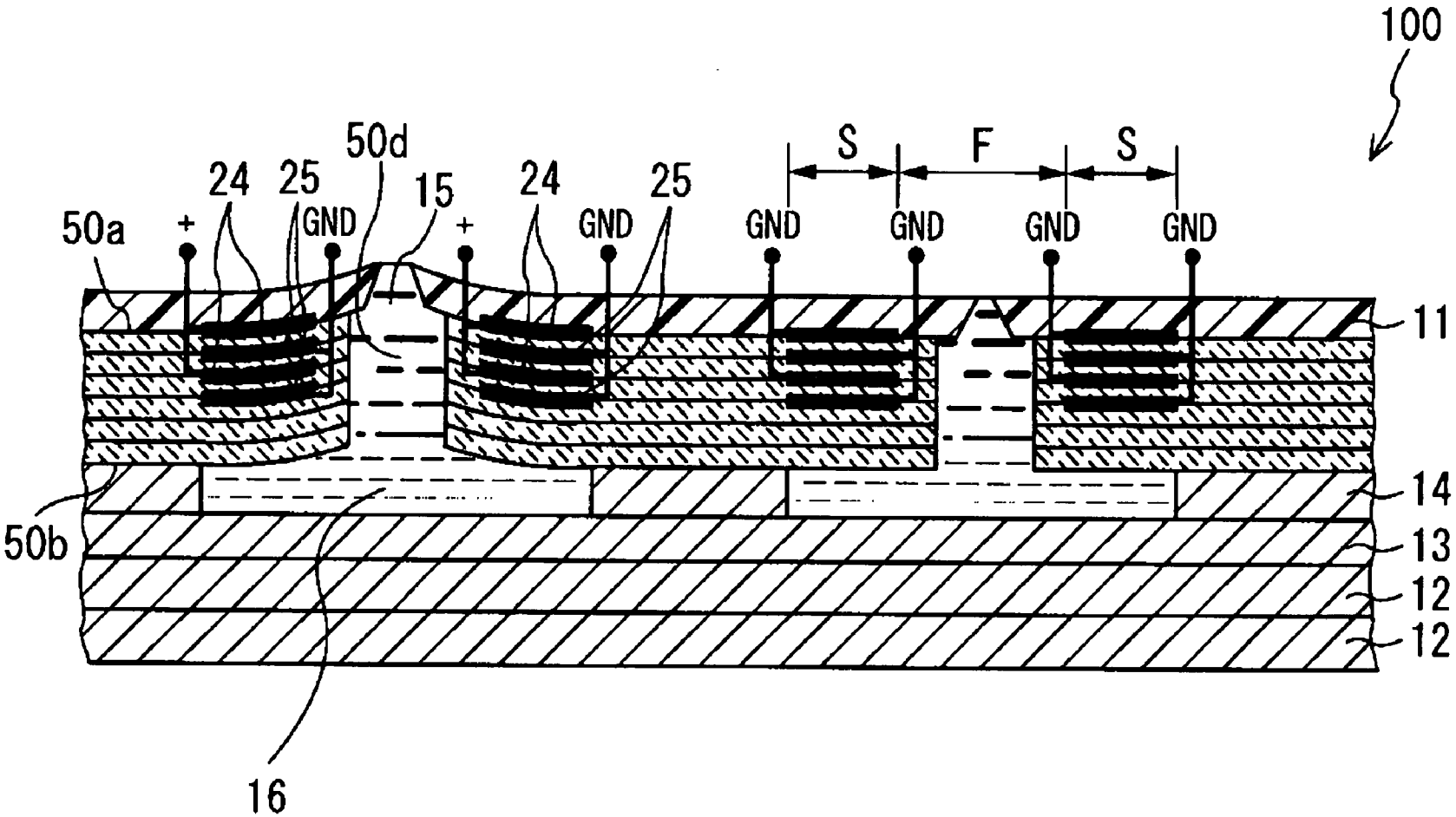
FIG. 13 is a partial sectional view of an ink-jet head 100 of a fourth embodiment.

Next, an ink-jet head 100 including a piezoelectric actuator 50 according to a fourth embodiment of the present invention will be explained with reference to FIG. 13. The piezoelectric actuator 50 of the present embodiment has a configuration similar to that of the piezoelectric actuator 50 of the first embodiment, except that a small-diameter through-hole **50*d* is opened through the piezoelectric sheets 51 to 56 at each of the first portions F. The nozzle plate 11 is adhered to the front surface 50*a* of the piezoelectric actuator 50, the surface 50*a* being opposite from the side of the piezoelectric actuator 50 where the pressure chambers 16 are located. Nozzles 15 are opened through the nozzle plate 11 at positions corresponding to the through-holes 50*d* connected to the pressure chambers 16 respectively, in order to bring the nozzles 15 into fluid communication with corresponding pressure chambers 16**.

In this embodiment, when voltage is applied to the piezoelectric actuator 50, the actuator 50 operates to deform itself in the same manner as the piezoelectric actuator 50 of the first embodiment. The opening portion of the nozzle 15 in the nozzle plate 11, which is joined to the piezoelectric actuator 50, also deforms in association with the deformation of the piezoelectric actuator 50, thereby increasing volume of the pressure chamber 16. When the piezoelectric actuator 50 reverts to its initial shape, then pressure is applied to the ink in the pressure chamber 16 and ink is ejected through the through-hole 50*d* and from the nozzle 15.

Fifth Embodiment

Figure 14:
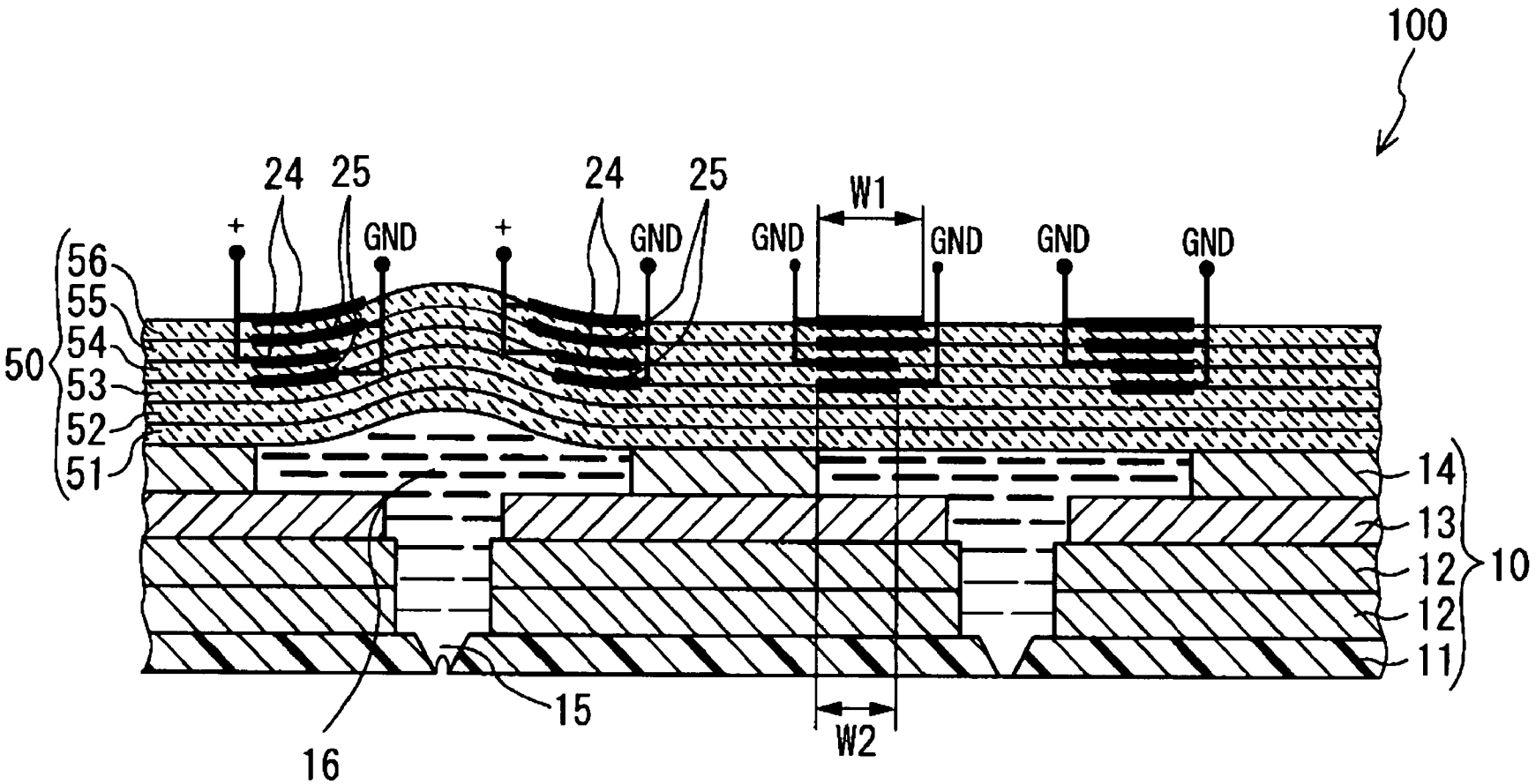
FIG. 14 is a partial sectional view of an ink-jet head 100 of a fifth embodiment.

FIG. 14 shows a fifth embodiment which has a basically similar configuration as that of the first embodiment, except that the widths of the electrodes 24, 25 are changed. In other words, as the electrodes 24, 25 are disposed upper in the drawing, namely nearer to the inner side of the arching deformation (bending), the widths W1 in the planar direction of the electrodes 24, 25 becomes larger, and as the electrodes 24, 25 are disposed lower in the drawing, namely nearer to the outer side of the arching deformation, the widths W2 in the planar direction of the electrodes 24, 25 becomes smaller. The electrodes 24, 25 are arranged such that their outer edges with respect to the corresponding pressure chamber 16 are aligned with each other in the thickness direction (the stacking direction) and such that their inner edges with respect to the corresponding pressure chamber 16 have a stepped configuration toward the inside of the corresponding pressure chamber 16.

It is necessary that as a pressure-generating portion is disposed nearer to the inner side of the arching deformation, the pressure-generating portion needs to have a larger amount of contraction force in the planar direction than another pressure-generating portion disposed nearer to the outer side of the arching deformation. However, the pressure-generating portion disposed nearer to the outside of the bending formation may have a small amount of contraction force. Therefore, with such an arrangement as described above, the total surface area of the electrodes 24, 25 can be decreased while maintaining the amount of arching deformation, thereby greatly decreasing the amounts of capacitance and reducing the current.

Sixth Embodiment

Figure 15:
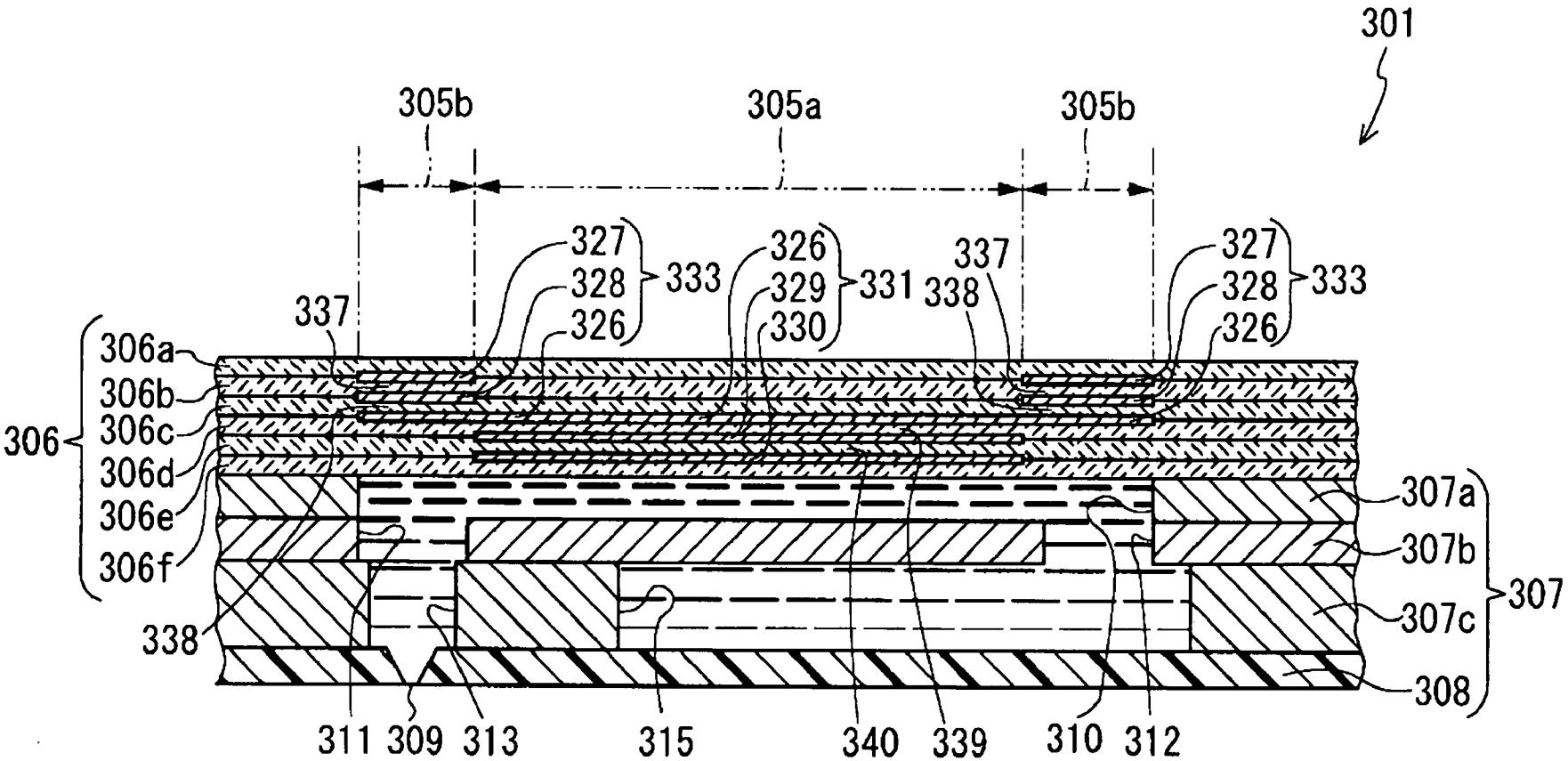
FIG. 15 is a sectional view of an ink-jet head 301 of a sixth embodiment, substantially parallel to the longitudinal direction of a pressure chamber 310.
Figure 16:
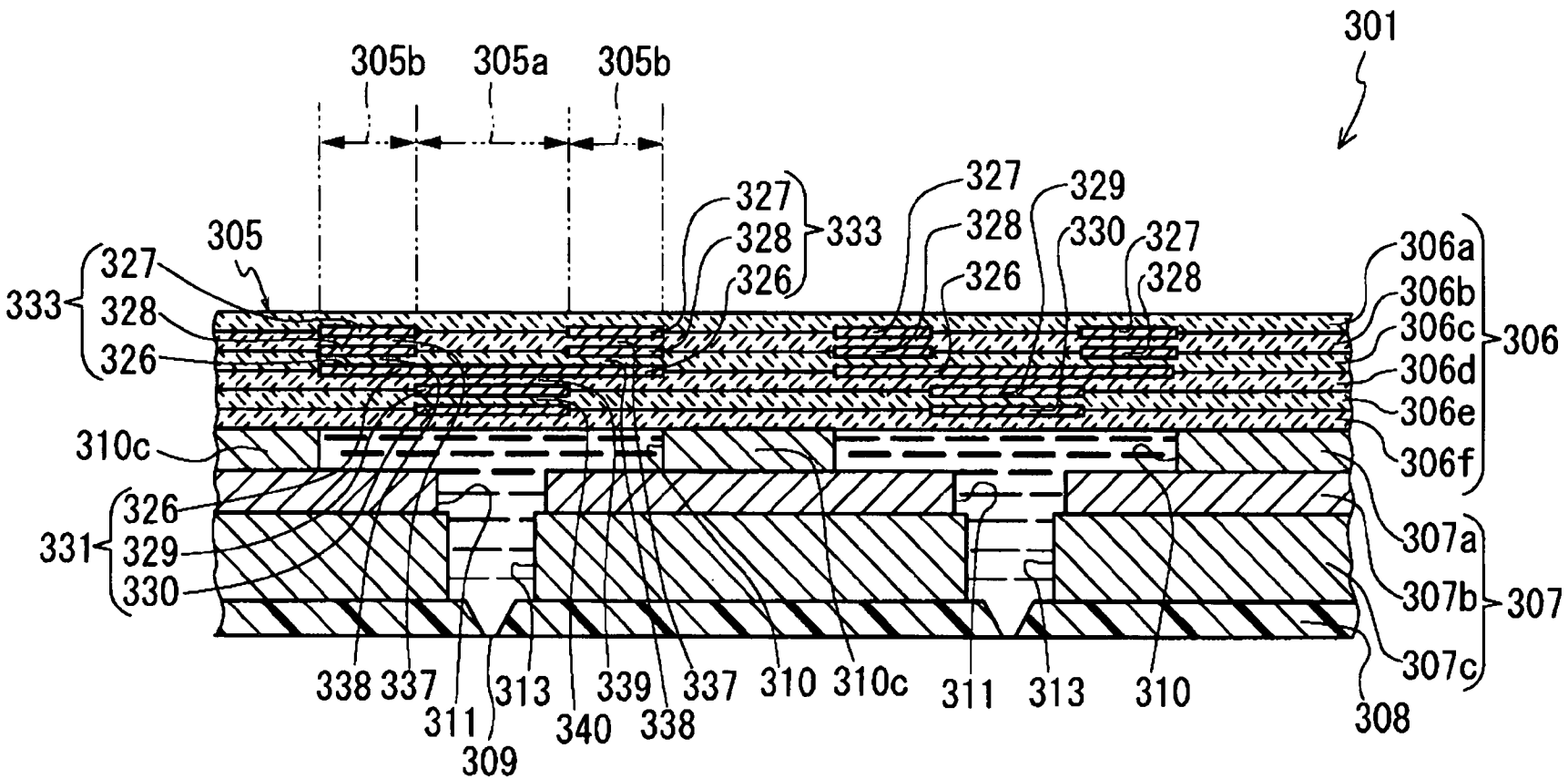
FIG. 16 is a sectional view of the ink-jet head 301 of the sixth embodiment, along a direction in which the pressure chambers 310 are arranged.
Figure 17:
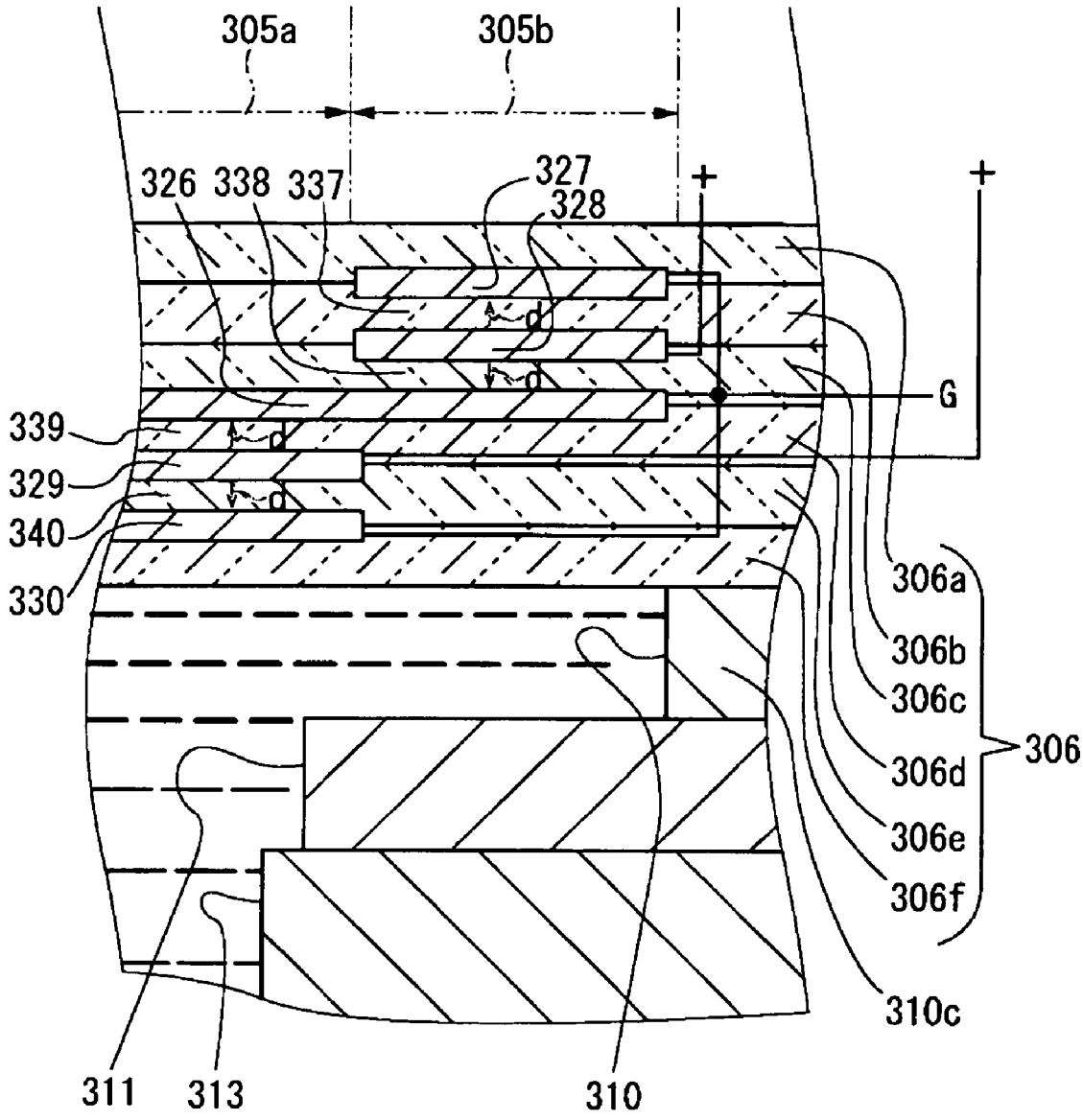
FIG. 17 is an enlarged view of a portion of a piezoelectric actuator plate 305 and the pressure chamber 310 shown in FIG. 16.

Next, a sixth embodiment of the present invention will be explained with reference to FIGS. 15 to 19. FIG. 15 is a sectional view of an ink-jet head 301 substantially parallel to the longitudinal direction of a pressure chamber. FIG. 16 is a sectional view of the ink-jet head 301 along a direction in which the pressure chambers are arranged. FIG. 17 is an enlarged view of a portion of a piezoelectric actuator plate 305 and the pressure chamber 310 shown in FIG. 16. As shown in FIGS. 15 and 16, the ink-jet head 301 is constructed of a piezoelectric actuator 306 and a cavity plate 307, as similar to the embodiment explained with reference to FIG. 6.

The cavity plate 307 has a construction basically similar to that of the cavity plate 10 explained with reference to FIG. 6. In the cavity plate 307, however, a first layer (uppermost layer) 307*a* and a second layer 307*b* correspond to the base plate 14 and the spacer plate 15, respectively, and a third plate 307*c* corresponds to the two manifold plates 12, 12. A plurality of pressure chambers 310 are formed in the first layer 307*a* and separated from each other by partition walls 310*c*. A manifold channel, namely a common ink channel 315, is formed in the third layer 307*c*. Each of the pressure chambers 310 is connected to the common ink chamber 315 via an ink supply hole 312 provided in the second layer 307*b*, and is connected to a nozzle 309 in a nozzle plate 308, which is the lowermost layer, via through holes 311, 313 provided in the second layer 307*b* and the third layer 307*c*, respectively. These pressure chambers and holes function similarly to those in the cavity plate 10.

The piezoelectric actuator 306 has a structure basically similar to that of the piezoelectric actuator 50 explained with reference to FIG. 6, namely the structure having electrodes 326 to 330 which will be described later and each of which is sandwiched between a plurality of piezoelectric sheets 306*a* to 306*f* in a laminated form.

In this embodiment, electrodes 327, 328, 326 are provided to be sandwiched between first to fourth layers 306*a* to 306*d* at a portion 305*b* (hereinafter referred to as "second portion") corresponding to a periphery portion of each of the pressure chambers 310 (in FIG. 15, the second portion is a circular portion formed of both edges in the longitudinal direction of each of the pressure chambers 310; in FIG. 16, the second portion is a circular portion formed of left and right ends of each of the pressure chambers 310). The electrodes 327, 328 are circular along the periphery of one of the pressure chambers 310. Further, electrodes 326, 329, 330 are provided to be sandwiched between third to sixth layers 306*c* to 306*f* at a portion 305*a* (hereinafter referred to as "first portion") which is surrounded by the second portion 305*b* and which corresponds to the central portion of each of the pressure chambers 310. The piezoelectric actuator 306 is firmly fixed to the partition walls 310*c* at portions which are outside of the second portions 305*b* with respect to the first portions 305*a* respectively.

The electrodes 326, 329, 330 disposed in the first portion 305*a* configure a first electrode group 331 in which the electrodes face with each other in the stacking direction of the piezoelectric sheets 306*d* to 306*f*. The electrodes 327, 328, 326 disposed in the second portion 305*b* configure a second electrode group 333 in which the electrodes face with each other in the stacking direction of the piezoelectric sheets 306*a* to 306*c*. The electrode 326 extends to span across both the first and second portions, and is disposed as a common electrode shared by both of the first and second electrode groups 331, 333.

The portions of the piezoelectric sheets 306*b* to 306*e*, sandwiched by the electrodes 326 to 330, are alternately polarized in the stacking direction (direction of arrows "d") by alternately connecting the electrodes 326 to 330 to the positive power source (+) and ground (G) in the stacking direction as shown in FIG. 17, and then applying a high voltage for polarization in a publicly known manner. The portions sandwiched by the electrodes 326 to 330 construct active portions 337 to 340 which deform when being applied with a drive voltage. Accordingly, the first portion 305*a* has active portions 339, 340 in the piezoelectric actuator 306 on a side nearer to the pressure chamber 310 and has the inactive layers 306*a* to 306*c* on the side of the actuator opposite to the pressure chamber. On the other hand, the second portion 305*b* has active portions 337, 338 in the piezoelectric actuator 306 on the side opposite to the pressure chamber 310 and has the inactive layers 306*d* to 306*f* on the side of the actuator nearer to the pressure chamber.

Figure 18:
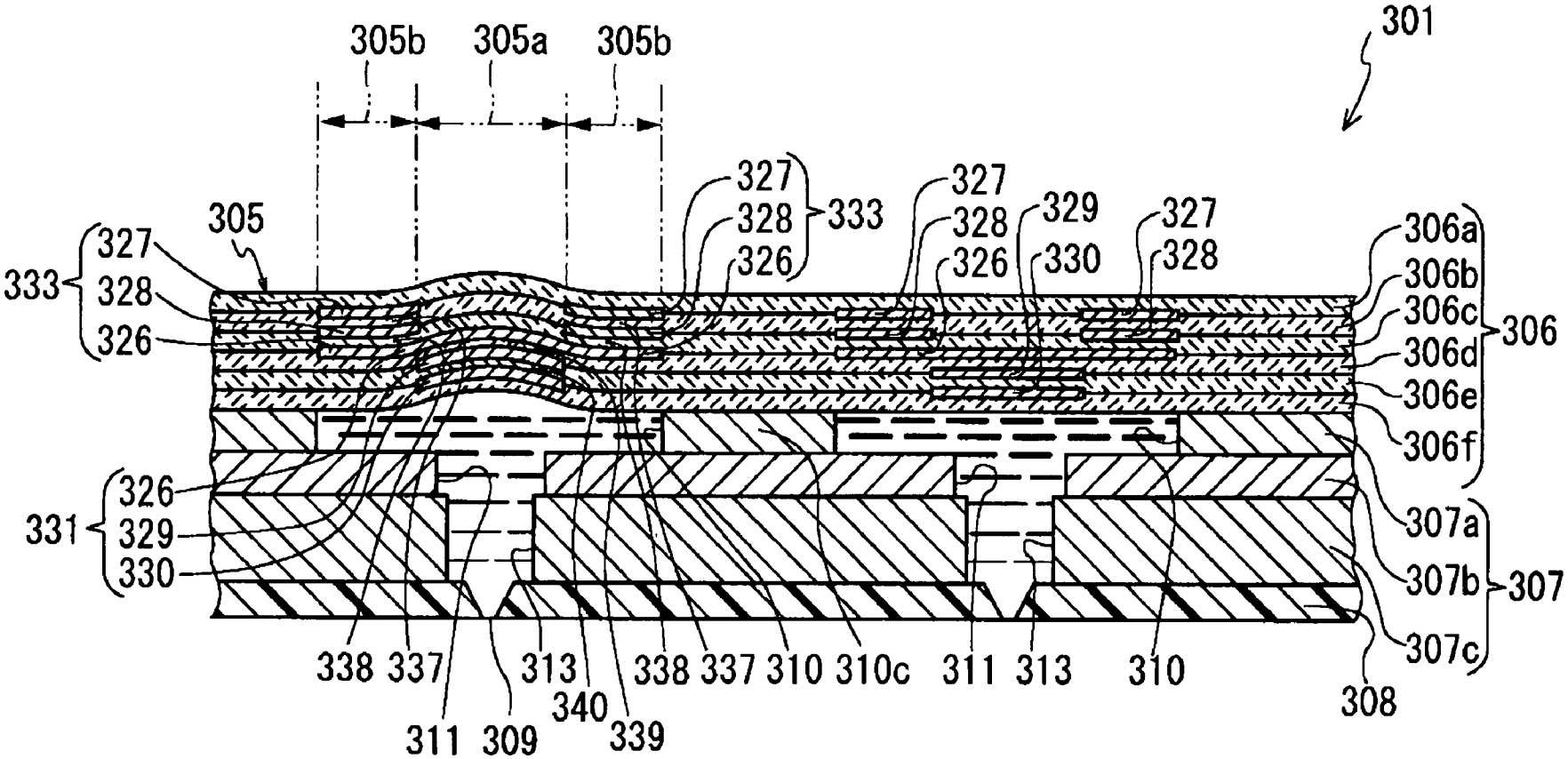
FIG. 18 is a sectional view showing a state when the piezoelectric actuator plate 305 of FIG. 16 is deformed.

When, as shown in FIG. 17, the electrodes 326 to 330 are alternately connected to the positive power source (+) and to ground (G) in the stacking direction in the same manner as during the polarization process, then a drive voltage, which is lower than the polarization voltage, is applied to the electrodes, an electric field that is parallel with the polarization direction "d" is generated in the active portions 337 to 340 so that the active portions 337 to 340 contract in a direction that is perpendicular to the direction in which the piezoelectric sheets are stacked, namely in a direction parallel to the plane of each of the layers. On the other hand, the inactive layers in each of the first and second portions 305*a*, 305*b* do not contract. Accordingly, the first portion 305*a* bends (arches) to project upward, and the second portion 305*b* bends (arches) to project downward, thereby increasing the volume of the pressure chamber 310 as shown in FIG. 18, as a result of which ink is drawn in from the common ink chamber 315. Afterward, when the application of voltage to each of the electrodes is stopped, the piezoelectric actuator 306 reverts to its initial flat condition as shown in FIG. 16. This reverting operation applies pressure to the ink in the pressure chamber 310 so that ink is ejected from the corresponding nozzle 309. It should be noted that although the active portions 337 to 340 also extend, concurrently with the above-described contracting operation, in the direction parallel to the polarization direction "d", the amount of extension is extremely small as compared to the amount of contraction because there are only a small number of piezoelectric layers in the stack. Therefore, the extension of the active portions hardly influences the ink ejection operation at all.

Figure 19:
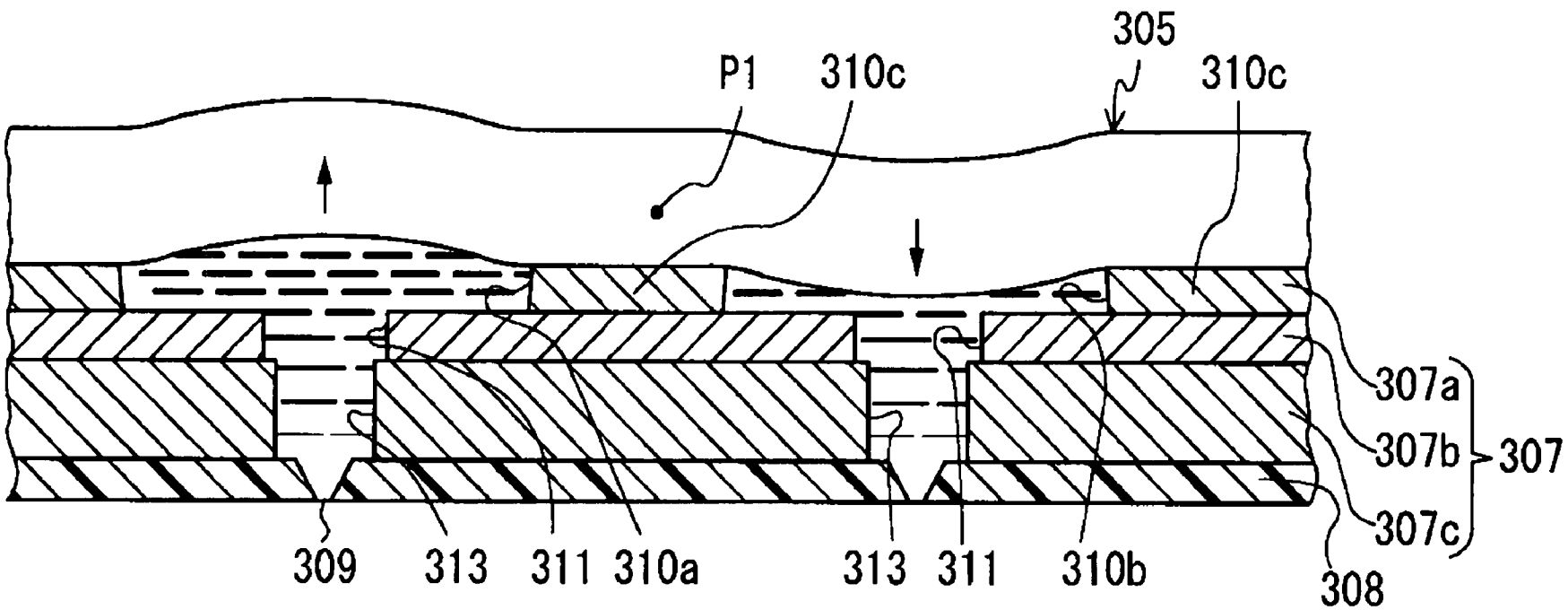
FIG. 19 is a reference drawing for explaining the operation in FIG. 18.

In this embodiment, if there were no electrodes 327, 328 in the second portion 305*b* and a voltage is applied only to the electrodes 326, 329, 330 in the first portion 305*a* corresponding to a pressure chamber 310*a*, then, as shown in FIG. 19, the application of voltage to the electrodes in the first portion 305*a* would entirely archingly bend a corresponding portion of the piezoelectric actuator 306 over the pressure chamber 310*a* to project upwardly. Due to the opposite reaction to this operation, as explained in the description of the related art, another portion of the piezoelectric actuator 306, which corresponds to a pressure chamber 310*b* adjacent to the pressure chamber 310*a*, would archingly bend to project downwardly, with a position above a partition wall 310*c* between the pressure chambers 310*a* and 310*b* being as a fulcrum P1. In addition, the partition wall 310*c* between the pressure chambers would also tilt. Namely, the cross talk is generated.

However, in the above-described embodiment, the second portion 305*b* archingly bends to project, at both sides of the first portion 305*a* protrudingly arch, the second portion 305*b* archingly bending in the direction opposite to the direction in which the first portion 305*a* protrudingly arch. This substantially cancels out the opposite reaction associated with deformation of the first portion 305*a*, thereby suppressing the influence to the portion of the piezoelectric actuator 306 corresponding to the adjacent pressure chamber 310*b* and the influence to the partition wall 310*c* between the pressure chambers. Accordingly, cross talk to adjacent pressure chambers is reduced, velocity and volume of ejected ink droplets are made substantially uniform, and printing quality is improved.

Seventh Embodiment

Figure 20:
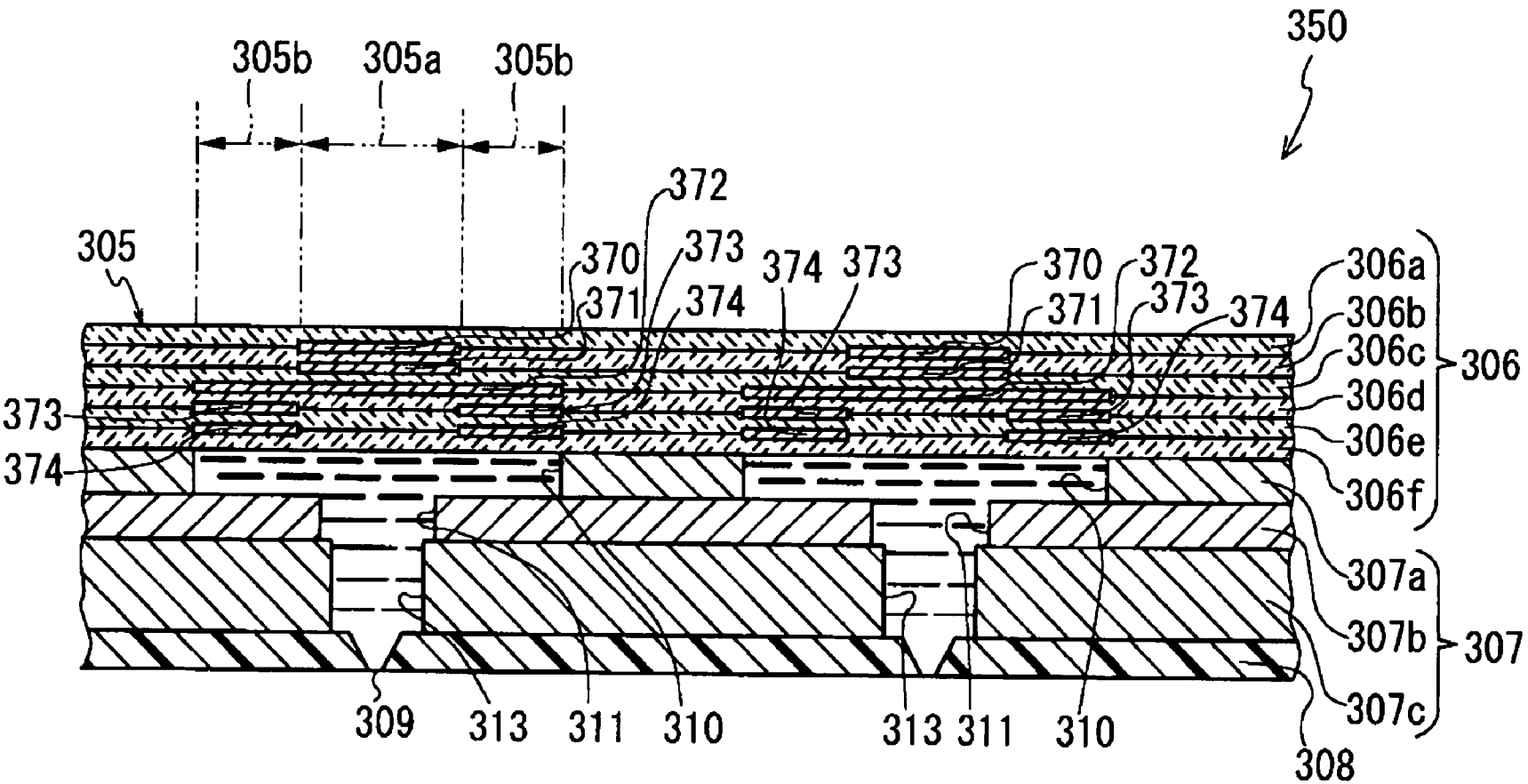
FIG. 20 is a sectional view of an ink-jet head of a seventh embodiment.
Figure 21:
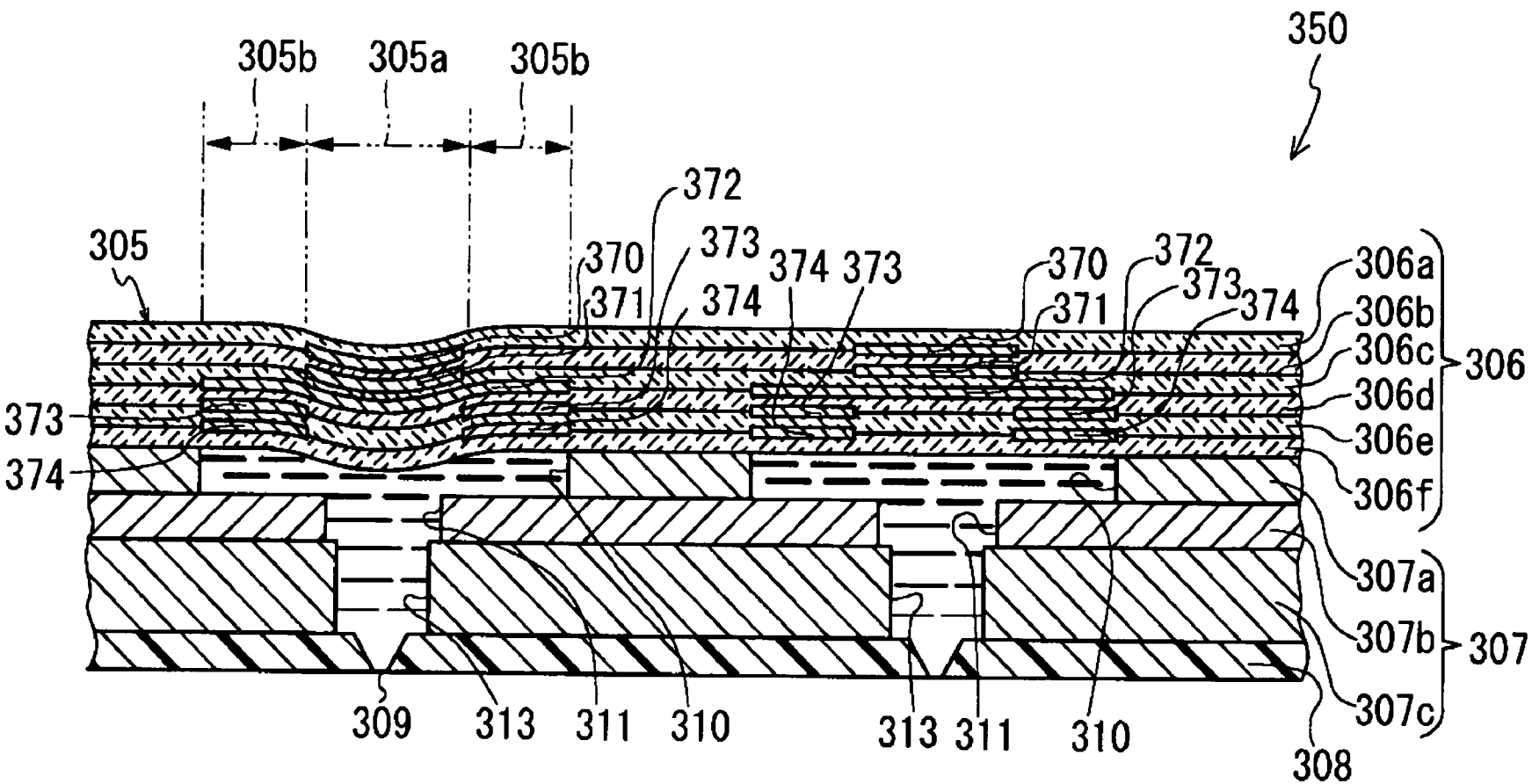
FIG. 21 is a sectional view showing a state when the piezoelectric actuator plate 305 in FIG. 20 is deformed.

FIGS. 20 and 21 show a seventh embodiment of the present invention. In this embodiment, electrodes 370, 371, 372 of the first portion 305*a* are arranged between the layers of the piezoelectric actuator 306 on the side opposite from the pressure chamber 310, and electrodes 372, 373 and 374 of the second portion 305*b* are arranged between the layers of the piezoelectric actuator 306 on the side nearer to the pressure chamber 310. Namely, in the seventh embodiment, the configuration of the piezoelectric actuator 306 is upside down from that of the sixth embodiment. In this case, when voltage is applied to the electrodes 370 to 374, the first and second portions deform respectively, as shown in FIG. 21, in a similar manner as in the sixth except that the manner of the deformation of the first and second portions is upside down from that of the sixth embodiment. As a result, the piezoelectric actuator 306 is bent toward the pressure chamber 310, thereby applying an ejection pressure to the ink.

Eighth Embodiment

Figure 22:
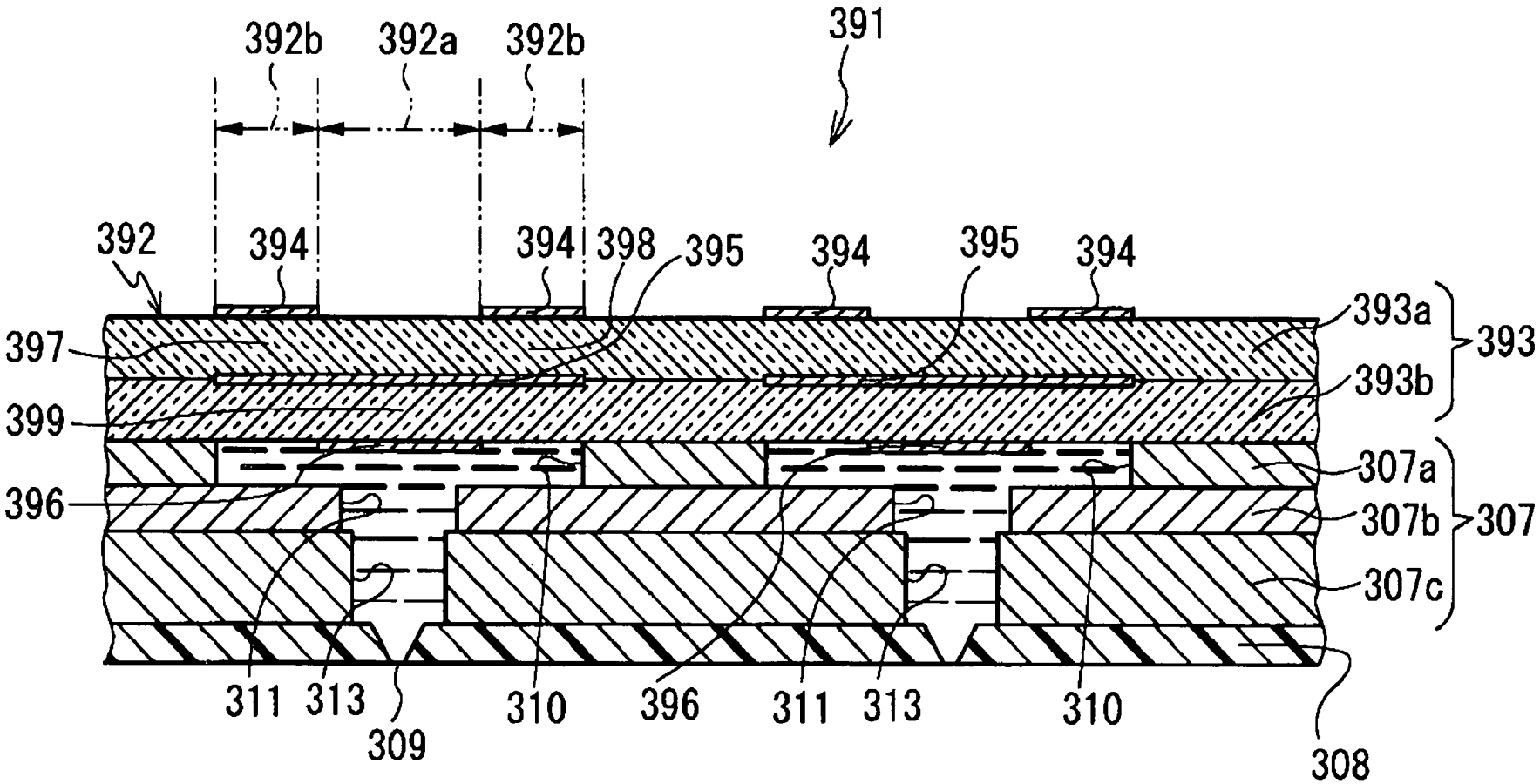
FIG. 22 is a sectional view of an ink-jet head of an eighth embodiment.

FIG. 22 shows an eighth embodiment of the present invention. In this embodiment, a piezoelectric actuator 392 is configured from two layers of piezoelectric sheets 393*a*, 393*b*. An electrode 395, which is common to both of the layers, is disposed to span across first and second portions 392*a* and 392*b*. An electrode 396, which faces the center of the common electrode 395, is provided on an outer surface of the first portion 392*a* in the layer 393*b* (as one of the two layers), and an electrode 394, which faces the periphery of the common electrode 395, is provided on an outer surface of the second portion 392*b* of the layer 393*a* (as the other of the two layers). A portion 399 of the first portion 392*a* sandwiched between the electrodes 395, 396 of the first portion 392*a*, and portions 397, 398 of the second portion 392*b* sandwiched between the electrodes 394, 395, are respectively polarized in a similar manner as in the sixth embodiment.

Then, by applying a drive voltage to the portion between the electrodes 395, 396 and to the portion between the electrodes 394, 395, in each of the first and second portions, the portions interposed between these electrodes contract in the direction perpendicular to the direction in which the layers are stacked, while the portions which are not interposed between electrodes do not contract. Accordingly, in the same manner as in the sixth embodiment, the first portion archingly bends to protrude, while at the same time the second portion archingly bends at both sides of the first portion to protrude in the opposite direction to that of the first portion. In the configuration shown in FIG. 22, similar to the sixth embodiment, the volume of the pressure chamber 310 is first increased and then the piezoelectric actuator 392 is reverted to the initial state, thereby ejecting the ink. However, the actuator can be configured to reduce the volume of the pressure chamber 310 to eject the ink, similar to the seventh embodiment.

In each of the sixth to eighth embodiments, the electrode in the first portion is added as compared with the first to fifth embodiments, and thus the capacitance is increased by the addition of electrode. However, these embodiments have no electrodes in the inactive portions in the first and second portions as compared with the configuration explained with reference to, for example, FIG. 12. Accordingly, it is possible to decrease the amounts of capacitance and current for the omitted electrodes in the inactive portions.

Ninth Embodiment

Figure 23:
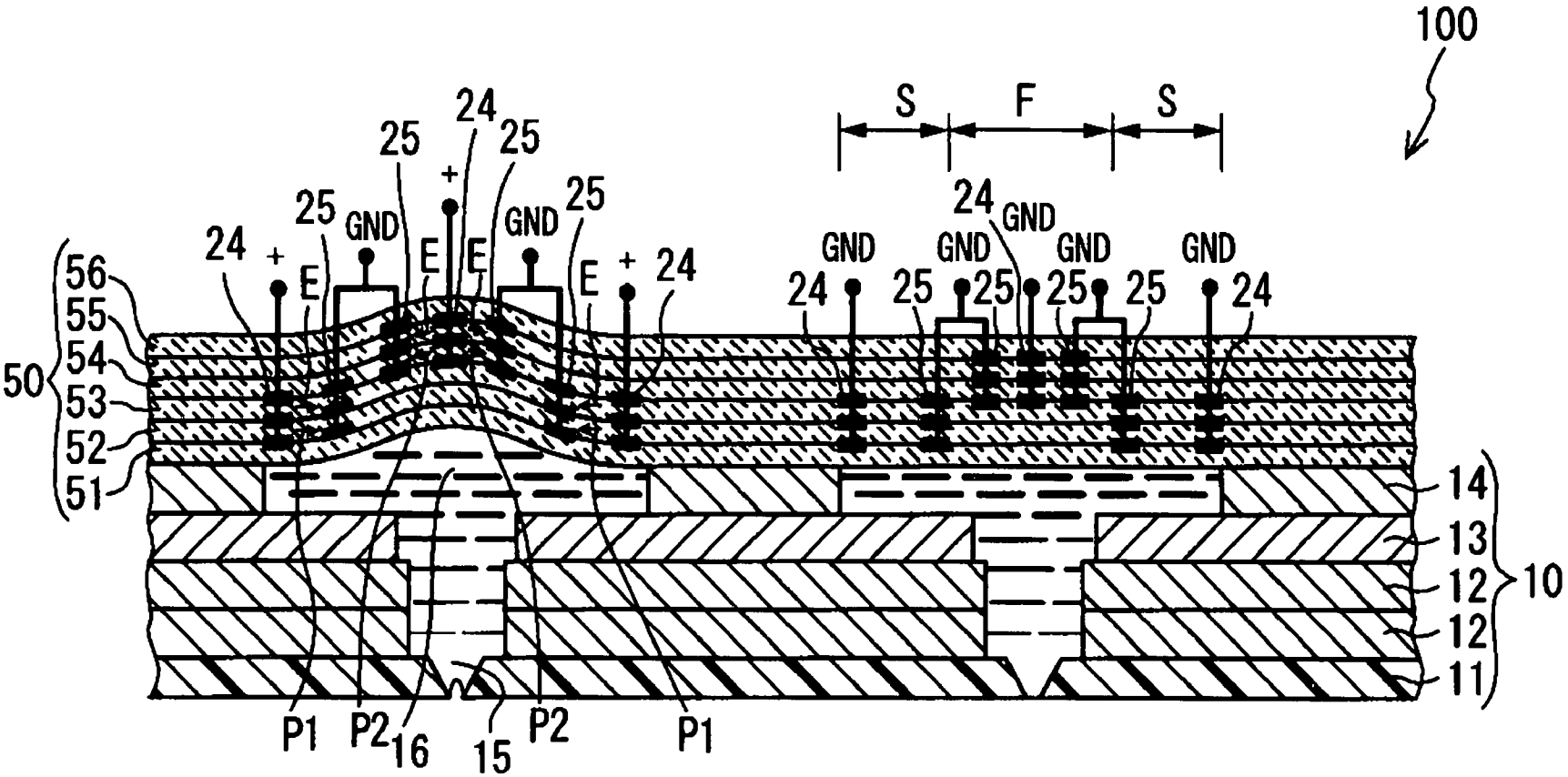
FIG. 23 is a partial sectional view of an ink-jet head 100 of a ninth embodiment.

Next, an ink-jet head 100 provided with a piezoelectric actuator 50 of a ninth embodiment will be explained with reference to FIG. 23. In this embodiment, the cavity plate 10 of the ink-jet head 100 of this embodiment is configured in the same manner as explained in the first and second embodiments.

The actuator 50 of the ninth embodiment has a first portion F and a pair of second portions S corresponding to each of the pressure chambers 16 similar to the embodiments explained above. In the ninth embodiment, the first portion F has electrodes 24, 25 in the piezoelectric sheets 54 to 56 which are disposed outwardly or farther from one of the pressure chambers 16 in the thickness direction of the piezoelectric actuator. The second portions S have electrodes 24, 25 in the piezoelectric sheets 51 to 53 which are disposed nearer to the pressure chamber in the thickness direction of the piezoelectric actuator.

In the first portion F, the drive electrodes 24 are disposed between the layers of the piezoelectric sheets 54, 55, 56 at positions facing the center of one the pressure chambers 16. Further, the common electrodes 25 are disposed at both sides of the drive electrodes 24 by a spacing distance in the planar direction of the piezoelectric sheets. In the piezoelectric actuator 50 of the ninth embodiment, the piezoelectric sheets 54, 55, 56 in the first portion F are polarized in a direction of P2 shown in FIG. 23, by applying a high, positive voltage to the drive electrodes 24 and connecting the pairs of common electrodes 25 to ground (GND), each of the pairs being disposed to interpose one of the drive electrodes 24.

In the second portions S, the drive electrodes 24 are arranged between the layers of the piezoelectric sheets 51, 52, 53 in the stack direction of the piezoelectric sheets, along the outer periphery of one of the pressure chambers 16. The common electrodes 25 are arranged between the layers of the piezoelectric sheets 51, 52, 53 in the stacking direction of the piezoelectric sheets, each of the common electrodes 25 being arranged by a spacing distance in the planar direction from one of the drive electrodes 24 toward the inside (toward the center of the associated pressure chamber 16). The piezoelectric sheets 51, 52, 53 are polarized in a planar direction P1 of the piezoelectric sheets by applying a high, positive voltage to the drive electrodes 24 and connecting the common electrodes 25 to ground (GND).

In the piezoelectric actuator 50 provided with the drive electrodes 24 and the common electrodes 25 in this manner, the drive electrodes 24 and the common electrodes 25 are all connected to ground (GND) in the initial condition when the printing operation of the ink-jet printer 101 is to be performed. When, according to predetermined print data, ink is to be ejected from a nozzle 15 communicating with one of the pressure chambers 16, drive voltage is applied to the drive electrodes 24 while the common electrodes 25 are connected to ground (GND), electric fields E in a direction from the drive electrodes 24 to the common electrodes 25 are generated in each of the first and second portions F, S, the electric fields E coinciding with the direction of polarization P1, P2, respectively, thereby increasing, due to the piezoelectric vertical effect, the distance between the drive electrodes 24 and the common electrodes 25 respectively arranged in the planar direction of the piezoelectric actuator 50.

At this time, the pair of second portions S is archingly bent, as similar to the second embodiment (FIG. 11), with its side of the piezoelectric sheets 54 to 56 as the inner direction of the arch, thereby lifting the first portion F in a direction away from the pressure chamber 16. At the same time, the first portion F is also archingly bent in a direction farther away from the pressure chamber 16, with its side of pressure chamber 16 as the inner side of the arch. Further, as in the embodiment described above, since the outer periphery of the second portion S is fixed onto the partition walls 14*c*, the volume of the pressure chamber 16 is thus increased. Then, when application of voltage to the drive electrodes 24 is stopped, then the piezoelectric actuator 50 resiliently reverts to its flat condition, thereby applying pressure to the ink in the pressure chamber 16 to eject the ink from the nozzle 15.

It is needless to say that various modifications or changes may be made or added to the present invention. For example, the drive electrode 24, the common electrode 25, the electrodes 327, 328, 373, 374, 394 may not be formed to have circular shape, but may be arranged as two parallel linear form. Alternatively, among these electrodes, one of the electrodes, facing each other with the piezoelectric sheet intervened therebetween, may be formed in a planar shape across the entire surface of the piezoelectric sheet. Still alternatively, the position of each of the pressure chambers, corresponding to the portion of the piezoelectric actuator to be archingly deformed by the pressure-generating portion, may not be a substantially center of the pressure chamber, but may be a position at which pressure can be applied to the ink in the pressure chamber.

Further, it is needless to say that the piezoelectric actuator 50 of the present invention may not be limited to the use only for an ink-jet head, but also may be employed for transporting various kinds of fluids. In addition, in each of the embodiments, it is configured that the volume of the pressure chamber (fluid accommodating chamber) is increased and then reverted to its initial state, thereby applying pressure to the ink (fluid). However, it is also possible to decrease the volume to apply the pressure. In such a case, the volume can be decreased, for example, by disposing the piezoelectric actuator 50 upside down with respect to the cavity plate 10 in the drawing. Further, in each of the embodiments, the elongating operation of the piezoelectric material can be changed to the contracting operation, thereby decreasing the volume.

Tenth Embodiment

Figure 24:
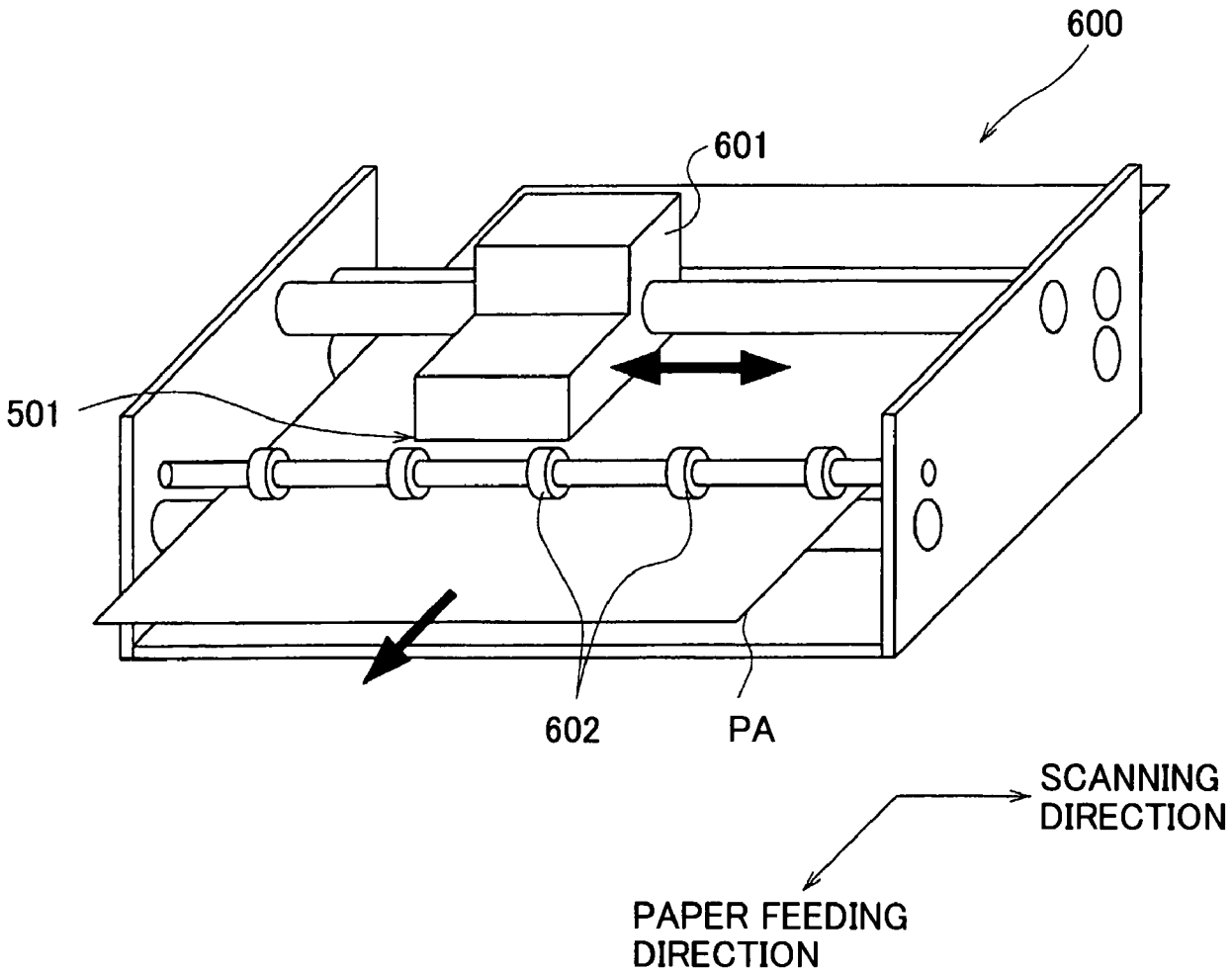
FIG. 24 is a schematic perspective view of an ink-jet head according to a tenth embodiment of the present invention.

Next, a tenth embodiment of the present invention will be explained. The tenth embodiment is an example in which the present invention is applied to an ink-jet head in which ink is discharged through nozzles. First, an ink-jet printer 600 provided with an ink-jet head 501 will be briefly explained. As shown in FIG. 24, the ink-jet printer 600 includes a carriage 601 movable in left and right direction in FIG. 24; a serial-type ink-jet head 501 (liquid transporting apparatus) which is arranged in the carriage 601 and which ejects ink onto a recording paper PA; and feeding rollers 602 which feed the recording paper PA in a forward direction in FIG. 24, and the like. The ink-jet head 501 moves integrally with the carriage 601 in the left and right direction (scanning direction) and discharges the ink onto the recording paper PA through ejection ports of nozzles 520 (see FIGS. 25 to 28) which are formed in the ink discharge surface on the lower side of the ink-jet head. The recording paper PA, on which the recording has been performed by the ink-jet head 501, is discharged in the forward direction (paper feeding direction) by the feeding rollers 602.

Next, the ink-jet head 501 will be explained. As shown in FIGS. 25 to 28, the ink-jet head 501 includes a channel unit 502 having ink channels formed therein, and a piezoelectric actuator 503 arranged on the upper surface of the channel unit 502.

First, the channel unit 502 will be explained. The channel unit 502 includes a cavity plate 501, a base plate 511, a manifold plate 512, and a nozzle plate 513. These four plates 510 to 513 are stacked and joined together in a laminated state. Among these plates, each of the cavity plate 510, the base plate 511 and the manifold plate 512 is a stainless steel plate with a substantially rectangular shape. Accordingly, the ink channels such as a manifold 517 and pressure chambers 514 which will be explained later on can be easily formed in the three plates 510 to 512 by means of etching. Further, the nozzle plate 513 is formed of a high-molecular synthetic resin material such as polyimide and is joined to the lower surface of the manifold plate 512. Alternatively, this nozzle plate 513 may also be formed of a metallic material such as stainless steel similar to the three plates 510 to 512.

Figure 25:
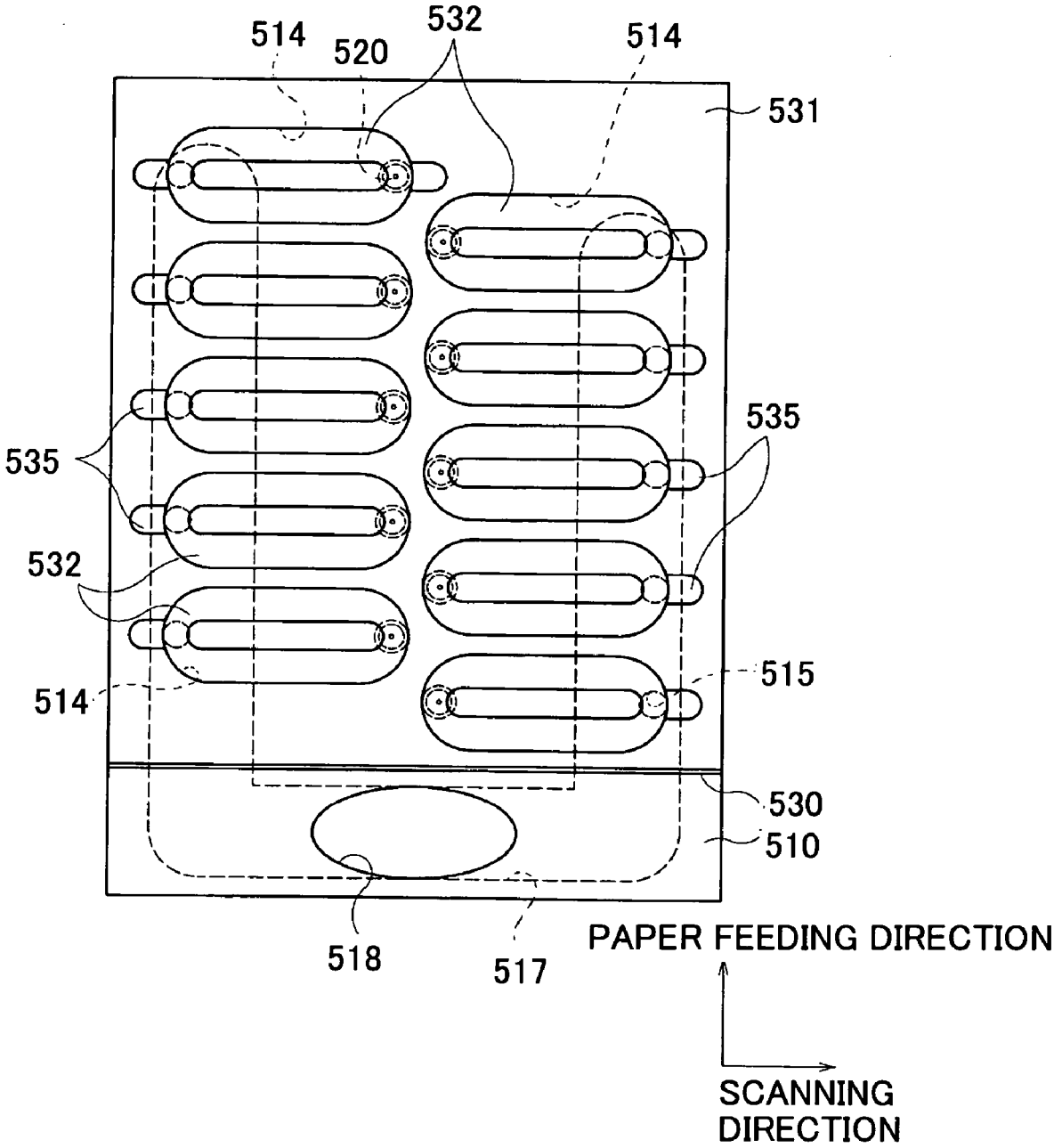
FIG. 25 is a plan view of an ink-jet head.
Figure 26:
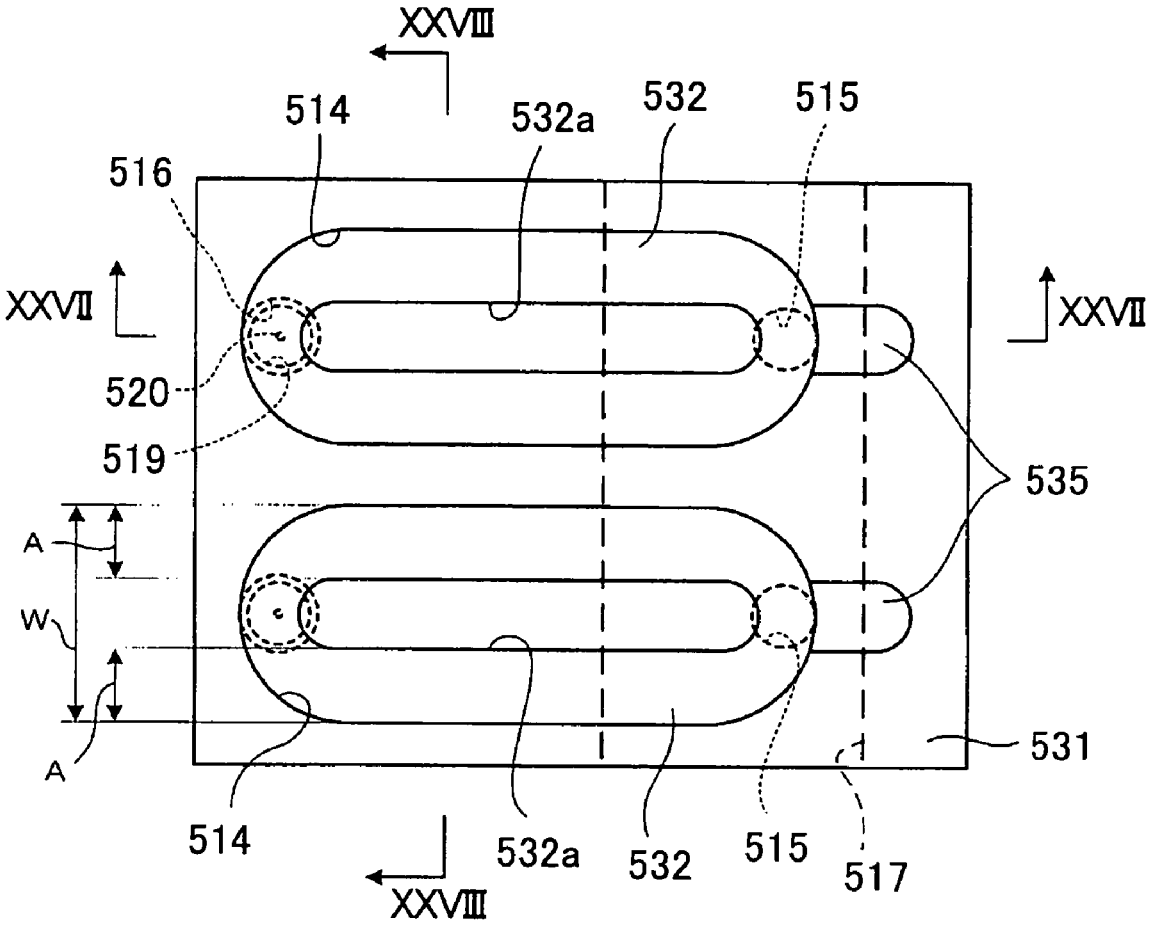
FIG. 26 is a partial enlarged view of FIG. 25.

As shown in FIGS. 25 and 26, a plurality of pressure chambers 514, arranged and arrayed along a plane, are formed in the cavity plate 510. These pressure chambers 514 are open upwardly, and covered by a vibration plate 530 which is to be joined to the upper surface of the cavity plate 510 as will be explained later. Each of the pressure chambers 514 is formed to have a substantially elliptic shape which is long in the scanning direction (left and right direction in FIG. 25) in a plan view, namely as viewed in a direction orthogonal to the plane on which each of the pressure chambers 514 are formed.

In base plate 511, communication holes 515, 516 are formed at positions overlapping in a plan view with both ends respectively in the longitudinal direction of one of the pressure chambers 514. In manifold plate 512, a manifold 517 is formed. The manifold 517 extends in two rows in the paper feeding direction (up and down direction in FIG. 25) and overlaps with a portion of each of the pressure chambers 514, the portion being the side in which the communication hole 515 is formed (right or left portion in each of the pressure chambers 514 in FIG. 25). To the manifold 517, ink is supplied from an ink tank (not shown) through an ink supply port 518 formed in the cavity plate 510. Further, communication holes 519 are formed at positions each of which overlaps in a plan view with an end of one of the pressure chambers 514, the end being opposite to the manifold 517 (left or light portion, in each of the pressure chambers 514 in FIG. 25). In the nozzle plate 513, a plurality of nozzles 520 are formed at positions each of which is overlaps in a plane view with a left or right end of one of the pressure chambers 514 in FIG. 25. The nozzles 520 are formed, for example, by performing an excimer laser processing on a substrate of high-molecular synthetic resin such as polyimide.

Figure 27:
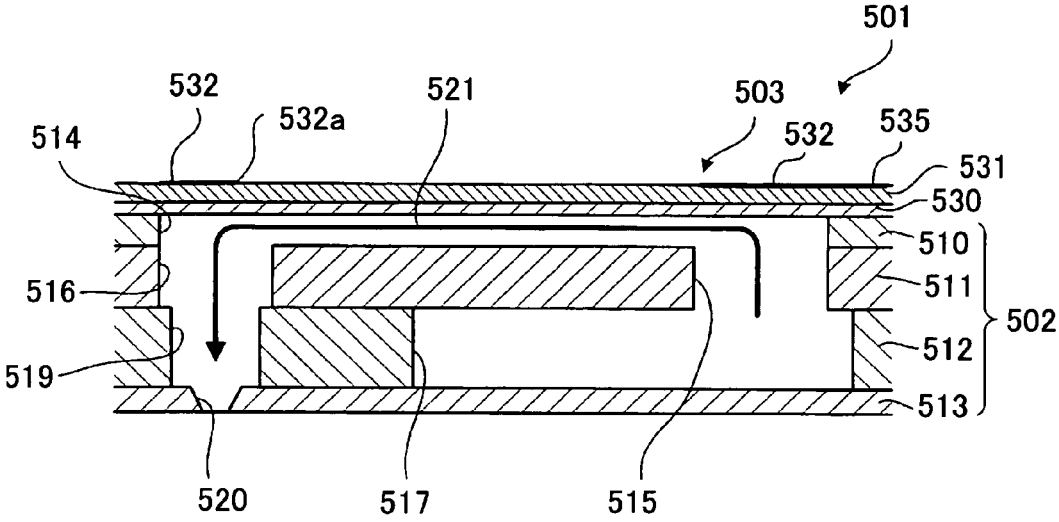
FIG. 27 is a sectional view of FIG. 26 taken along a line XXVII-XXVII.

As shown in FIG. 27, the manifold 517 communicates with the pressure chambers 514 via the communication hole 515, and the pressure chambers 514 communicate with the nozzles 520 via the communication holes 516, 519. Thus, the individual ink channels 521 from the manifold 517 to the nozzles 520 via the pressure chambers 514 are formed in the channel unit 521.

Next a piezoelectric actuator 503 will be explained. As shown in FIGS. 25 to 28, the piezoelectric actuator 503 includes an electrically conductive vibration plate 530 disposed on the surface of the channel unit 502, a piezoelectric layer 531 formed on the upper surface of the vibration plate 530 (surface opposite to the pressure chambers 514), and a plurality of individual electrodes 532 which are formed on the upper surface of the piezoelectric layer 531 to correspond to the pressure chambers 514 respectively.

The vibration plate 530 is formed of a metallic material (for example, an iron alloy such as stainless steel, a nickel alloy, an aluminum alloy or a titanium alloy) and has a substantially rectangular shape in a plane view. The vibration plate 530 is joined to the cavity plate 510 so as to cover the pressure chambers 514. The vibration plate 530 also serves as a common electrode which faces the individual electrodes 532 and causes electric field act in the piezoelectric layer 531 between the individual electrodes 532 and the vibration plate 530. The vibration plate 530 is always maintained at ground potential.

The piezoelectric layer 531 is composed of lead zirconate titanate (PZT) which is a ferroelectric solid solution of lead zirconate and lead titanate. The piezoelectric layer 531 is formed on the upper surface of the vibration plate 530 to entirely cover the plurality of pressure chambers 514. This piezoelectric layer 531 can be formed, for example, by an aerosol deposition method (AD method) in which particles of a piezoelectric material are ejected and deposited onto an objective surface for layer formation. The piezoelectric layer 531 can be also formed by other known method such as a sputtering method, a CVD (chemical vapor deposition) method, a sol-gel method, or a hydrothermal synthesis method. Alternatively, the piezoelectric layer 531 can be formed by cutting a piezoelectric sheet, obtained by calcinating a green sheet of PZT, into sheets of a predetermined size and then by bonding the cut sheet or sheets to the vibration plate 530.

Each of the individual electrodes 532 has a circular shape which is long in the scanning direction (left and right direction in FIG. 25) and in which a hole 532*a* is formed in the central portion of the individual electrode. Further, each of the individual electrodes 532 is formed to surround the central portion of one of the pressure chambers 514 at an area overlapping in a plan view with an edge portion of one of the pressure chambers 514, the edge portion being other than the central portion of the pressure chamber, such that the hole 532 overlaps in a plane view with the central portion of one of the pressure chambers 514. The individual electrodes 532 are formed of an electrically conductive material (for example, gold, copper, silver, palladium, platinum or titanium). Further, a plurality of terminals 535 extend in the scanning direction from right or left ends in FIG. 25 of the individual electrodes 532 respectively. These terminals 535 are connected to a driver IC (now shown) via a flexible wiring member (omitted in the drawing) such as a Flexible Printed Circuit (FPC). Drive voltage is selectively supplied from the driver IC to the individual electrodes 532 via the terminals 535 respectively. The individual electrodes 532 and the terminals 535 can be formed by a screen-printing, the sputtering method, an evaporation method, or the like.

Next, the operation of the piezoelectric actuator 503 upon discharging the ink will be explained. When a drive voltage is applied from the driver IC selectively to the plurality of individual electrodes 532, a potential difference is generated between the individual electrode 532 which is disposed on the piezoelectric layer 531 and to which the drive voltage is applied and the vibration plate 530 as the common electrode which is disposed under the piezoelectric layer 531 and maintained at ground potential, thereby generating an electric field in a vertical direction in a portion of the piezoelectric layer 531 sandwiched between the individual electrode 532 and the vibration plate 530. Consequently, the portion of the piezoelectric layer 531, which is positioned directly below the individual electrode 532 applied with the drive voltage, expand in a thickness direction in which the piezoelectric layer 31 is polarized and contract in a direction parallel to the plane of the piezoelectric layer and orthogonal to the polarization direction.

Figure 29:
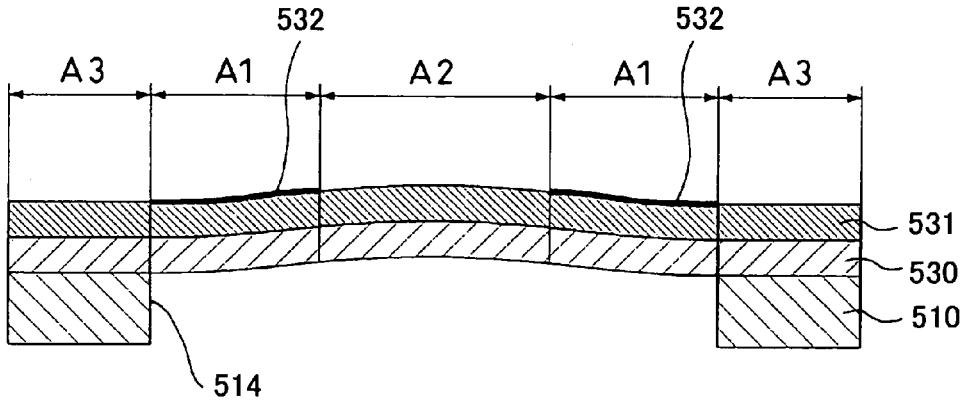
FIG. 29 is a drawing showing a state in which the piezoelectric layer and the vibration plate are deformed when driving voltage is applied to an individual electrode.

Here, as mentioned above, each of the individual electrodes 532 is formed at the area which overlaps in a plan view with the edge portion of one of the pressure chambers 514. Accordingly, as shown in FIG. 29, an area of the piezoelectric actuator 503 overlapping with the edge portion of the pressure chamber 514 becomes a driving zone A1 in which the piezoelectric layer 531 deforms by itself, and an area overlapping with the central portion of the pressure chamber 514 becomes a driven zone A2 which is deformed along with the deformation of the piezoelectric layer 531 in the driving zone A1 (zone which is forced to deform). Moreover, an area outside of the pressure chamber 514, at which the vibration plate 530 is joined to the cavity plate 510, becomes a constrained zone A3 in which the deformation of the vibration plate 530 is constrained. When the drive voltage is applied to the individual electrode 532, the piezoelectric layer 531 in the driving zone A1 on both sides in FIG. 29 is contracted in the direction parallel to the plane, whereas the vibration plate 530 is not contracted in the direction parallel to the plane. Due to this, the vibration plate 530 and the piezoelectric layer 531 of the driven zone A2 intervened between the driving zones A1 are deformed. The vibration plate 530 is deformed so as to project toward a side opposite to the pressure chamber 514 with the center of the driven zone A2 as an apex. As the vibration plate 530 is deformed, a volume inside the pressure chamber 514 increases and a pressure wave is generated in the pressure chamber 514.

Here, as it is hitherto known, when a time taken by the pressure wave generated due to the increase in the volume of the pressure chamber 514 for one way propagation in the longitudinal direction the pressure chamber 514 is elapsed, the pressure in the pressure chamber 514 is changed to a positive pressure. At this point, at the timing of the change of pressure in the pressure chamber to positive pressure, the driver IC stops applying the drive voltage to the individual electrode 532. As the driving electrode IC stops applying the driving voltage, the electric potential of the individual electrode 532 becomes the ground potential and the vibration plate 530 restores to the original shape and the volume inside the pressure chamber 514 decreases. At this time, however, the pressure wave generated with the increase in the volume of the pressure chamber 514 mentioned earlier and the pressure wave generated with the restoration of the vibration plate 530 are combined, thereby applying a substantial pressure to the ink in the pressure chamber 514 to discharge the ink from the nozzle 520. Therefore, by performing a so-called "pulling ejection", it is possible to apply a high pressure to the ink with a low drive voltage, and accordingly a drive efficiency of the piezoelectric actuator 503 is improved. Moreover, since the electric field is made to act on the piezoelectric layer 531 by applying the drive voltage to the individual electrodes 532 only at a timing of ink discharge, the polarization deterioration hardly occurs in the piezoelectric layer 531, and accordingly the durability of the actuator is improved.

In view of the driving efficiency, it is desirable that the piezoelectric actuator 503 is configured such that the piezoelectric layer 531 (vibration plate 530) is greatly deformed with a low drive voltage. The amount of deformation of the vibration plate 530, however, depends on the size of the individual electrodes 532 to which the drive electrode is applied to cause the electric field act in the piezoelectric layer 531. Specifically, the amount of deformation is greatly influenced by a length in a radial direction of portions of the individual electrodes 532, the portions each overlapping with the edge portion of one of the pressure chambers 514, the radial direction being a direction of a line passing through the area center of one of the pressure chambers 514. Accordingly, in the piezoelectric actuator 503 of this embodiment, a width direction length A at one side in the width direction orthogonal to the longitudinal direction of the pressure chamber 514 (see FIGS. 26, 28; hereinafter referred simply as "width"), is adopted as such a length in the radial direction of the individual electrodes 532, and the width A of the individual electrodes 532 is set to an optimum value such that a great amount of deformation of the vibration plate 530 can be obtained.

Figure 30:
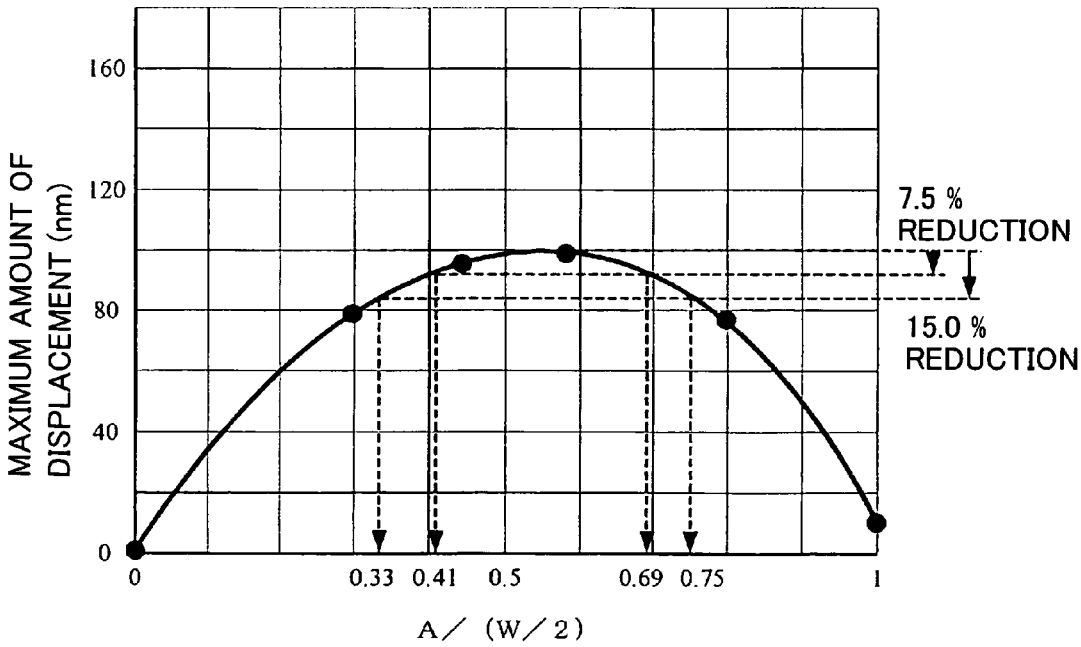
FIG. 30 is a graph showing a relationship between a value of A/(W/2) and a maximum amount of displacement of the vibration plate.

A method for determining the width A of the individual electrodes 532 will be explained. First, when the length of the pressure chambers 514 in the width direction (see FIGS. 26, 28; hereinafter referred to simply as "width") is W, the change of a maximum amount of displacement of the vibration plate 530 (amount of upward displacement at a position facing to the area center of the pressure chamber 514), when the width A of the individual electrode 532 is changed, is obtained through structural analysis and experimentation using the Finite Element Method (FEM) or the like. For example, FIG. 30 shows a relationship between the maximum amount of deformation of the vibration plate 530 (unit: nm) and a value of A/(W/2) which is a ratio of the width A of the individual electrode 532 to a half of the width W of the pressure chamber 514 (W/2) when the structural analysis using FEM was carried out wherein width W of a pressure chamber 514 is 419 μm, thickness Tv of the vibration plate 530 formed of stainless steel is 20 μm, thickness Tp of the piezoelectric layer 531 formed of PZT is 10 μm, and drive voltage applied to the individual electrode 532 is 20V.

Figure 28:
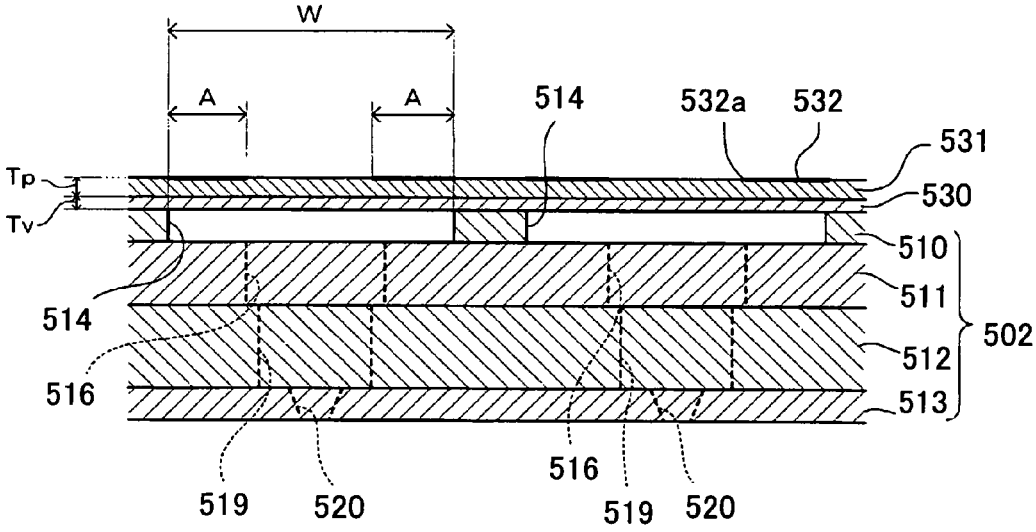
FIG. 28 is a sectional view of FIG. 26 taken along a line XXVIII-XXVIII.

Here, as shown in FIG. 28, since the piezoelectric layer 531 is formed on the upper surface of the vibration plate 530 so as to entirely cover the pressure chambers 514, the fluctuation in rigidity of the piezoelectric actuator 503 is small and roughly uniform in the area facing the pressure chambers 514. Accordingly, when conditions such as the thicknesses and/or elasticities of the vibration plate 530 and piezoelectric layer 531, or the drive voltage, are changed, the value of the maximum amount of displacement of the vibration plate 530 itself is changed but the tendency of the change in the maximum amount of displacement of the vibration plate 530, with respect to the width A of the individual electrode 532, is not changed. For example, in the graph of FIG. 30, the value of A/(W/2), at which the maximum amount of displacement of the vibration plate 530 becomes the peak value, does not depend on other conditions such as the thicknesses of the vibration plate 530 and the piezoelectric layer 531 or the drive voltage. In this case, as the maximum amount of the displacement of the vibration plate 530 is greater, the pressure to be applied to the ink in the pressure chamber 514 becomes greater with the same drive voltage. Accordingly, an optimum value of A/(W/2) is a value at which the maximum amount of displacement of the vibration plate 530 becomes the peak value (5.5), and the optimum value for the width A of the individual electrode 532 can be easily determined.

Figure 31:
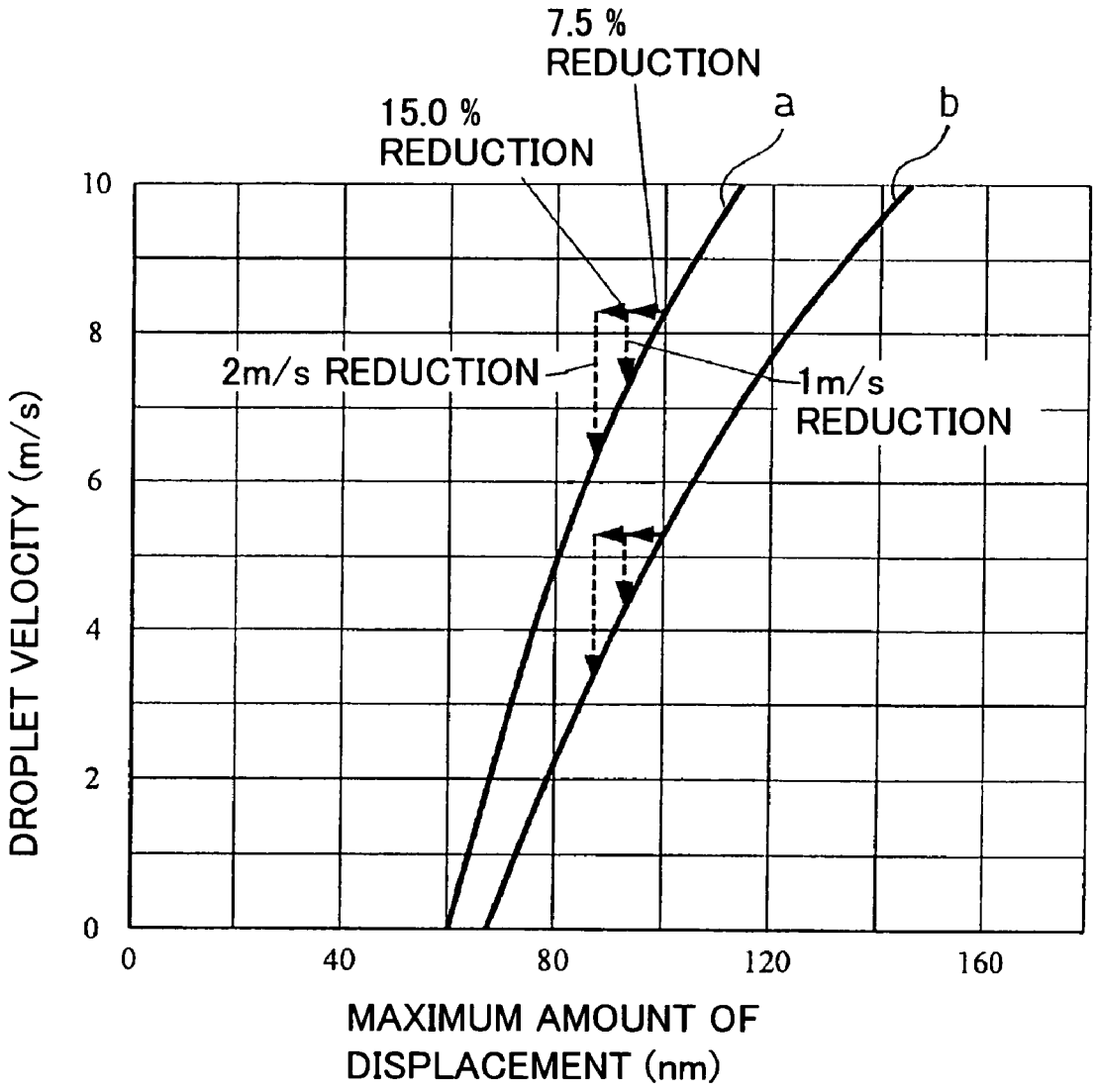
FIG. 31 is a graph showing a relationship between the maximum amount of displacement of the vibration plate and a velocity of ink droplet.

The width A of the individual electrodes 532, actually formed on the upper surface of the piezoelectric layer 531, deviates from the above-described optimum value in some cases due to the manufacturing error. In such a case, consequently, the maximum amount of displacement of the vibration plate 530 may vary among the pressure chambers 514, due to which the droplet velocity of the ink droplet discharged from the nozzles may vary among the plurality of nozzles 520. If the variation in the droplet velocity is great, the printing quality is deteriorated in some cases as a result. The inventor conducted experiments to discover the following relationship between the amount of displacement of the vibration plate 530 and the velocity of ink droplet discharged from the nozzle 520. According to this relationship, as shown in FIG. 31, when the amount of displacement of the vibration plate 530 is reduced by 7.5%, the velocity of droplet is reduced by 1 m/s. In piezoelectric actuators 503 of different types, although curves showing the relationship between the amount of displacement of the vibration plate 530 and the velocity of droplet are different as curve "a" and curve "b" in FIG. 31, this relationship itself holds for any type of piezoelectric actuator 503. In view of this, when the value of width A of the individual electrode deviates from the optimum value, the range of A, which is acceptable, is determined as follows.

In order to maintain a good print quality, it is desirable that the variation in the velocity of droplet is suppressed to be at least not more than 2 m/s. For this purpose, from the relationship shown in FIG. 31, it is necessary to suppress the variation in the maximum amount of displacement of the vibration plate 530 to be not more than 15%. Accordingly, it is desirable that the value of A/(W/2) falls within a range in which a value of 0.55, at which the maximum amount of displacement becomes the peak value, is intervened and in which the maximum amount of displacement is −15% with respect to the peak value, namely, within a range of not less than 0.33 to not more than 0.75 from the relationship shown in FIG. 30, such that the maximum amount of displacement of the vibration plate 530 is as great at possible and that the tolerance for the width A of the individual electrode 532 is broad.

Moreover, to maintain even better print quality, it is necessary in some cases to suppress the variation in the velocity of droplet to be not more than 1 m/s. In this case, it is desirable that the value of A/(W/2) falls within a range in which the value of 0.55, at which the maximum amount of displacement becomes the peak value, is intervened and in which the maximum amount of displacement is −7.5% with respect to the peak value, namely, within a range of not less than 0.41 to not more than 0.69 from the relationship shown in FIG. 30.

Further, when the value of width A of individual electrodes 532 is small, the capacitance generated in the piezoelectric layer 531 sandwiched between the individual electrodes 532 and the vibration plate 530 becomes smaller than a case in which the value of A is great, and thus the electric power consumed by the piezoelectric actuator 503 becomes small. Accordingly, it is desirable that the value of A/(W/2) falls in a range of not more than 0.55, at which the maximum amount of displacement is the peak value, and not less than 0.41.

Next, a method of producing the ink-jet head 501 will be explained.

Figure 32A:
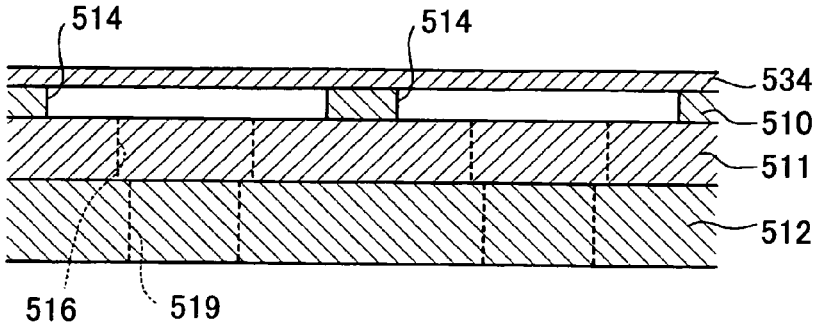
FIG. 32A shows a joining step of metallic plates.
Figure 32B:
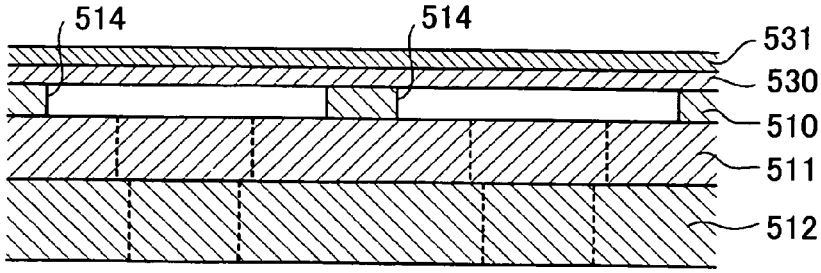
FIG. 32B shows a piezoelectric layer formation step.

First of all, as shown in FIG. 32A, four metal plates of a cavity plate 510, a base plate 511, a manifold plate 512, in which holes which are to form the pressure chambers 514 and manifold 517 or the like are formed, and the vibration plate 530 are joined together. Then, as shown in FIG. 32B, the piezoelectric layer 531 is formed on the upper surface of the vibration plate 530 by means of the AD method or the like, such that the piezoelectric layer 531 covers the plurality of pressure chambers 514 (piezoelectric layer formation step).

Figure 32C:
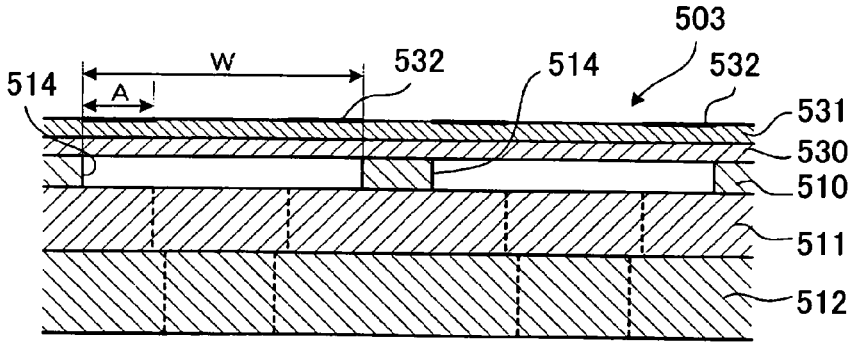
FIG. 32C shows an individual electrode formation step.
Figure 32D:
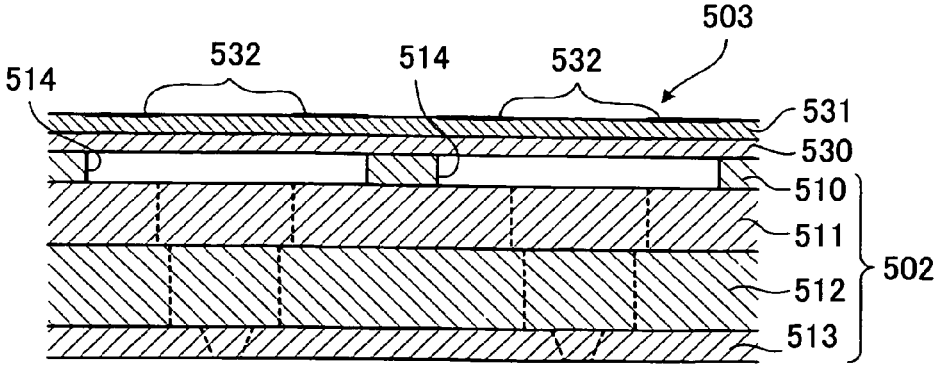
FIG. 32D shows a joining step of a nozzle plate.

Next, based on the relationship between the value of A/(W/2) and the amount of deformation (maximum amount of deformation) of the vibration plate 530 when a voltage is applied to the individual electrode 532, as shown in FIG. 30, a value of width A of the individual electrode 532 is determined such that the maximum amount of displacement of the vibration plate 530 becomes the peak value (namely, value of A/(W/2) is 0.55) (electrode length determination step). Then, as shown in FIG. 32C, the individual electrodes 532 having the determined value of A are formed, by means of screen-printing or the like, on the upper surface of the piezoelectric layer 531 at areas each of which overlaps with an edge portion of one of the pressure chambers 514 (individual electrode formation step). At this time, terminals 532 connected to the individual electrodes 532 respectively are simultaneously formed. Finally, as shown in FIG. 32D, a nozzle plate 513 is joined to the lower surface of the manifold plate 512, and thus the production of the ink-jet head 501 is completed.

It should be noted that the width A of the individual electrode 532 may be determined based on the relationship of FIG. 30 before the joining of the four metal plate of the cavity plate 510, the base plate 511, the manifold plate 512 and the vibration plate 530.

Further, when the nozzle plate 513 is a metal plate, this nozzle plate 513 may be also joined simultaneously with the other four metal plates (cavity plate 510, base plate 511, manifold plate 512 and vibration plate 530).

According to the method for producing the ink-jet head 501 of the tenth embodiment, the following effects can be obtained. Namely, since the individual electrodes 532 are formed at the areas each of which overlaps with the edge portion of one of the pressure chambers 514, the edge portion being an area other than the central portion of the pressure chamber, and the pulling ejection can be realized by applying the drive voltage to the individual electrodes 532 only at the timing when the ink is discharged. Accordingly, the drive efficiency of the piezoelectric actuator 503 is enhanced and the durability of the actuator is excellent. In addition, the width A of the individual electrodes 532 has a value such that the maximum amount of displacement of the vibration plate 530 is as great as possible within a range in which the variation in the droplet velocity can be suppressed and the satisfactory printing quality can be maintained. Accordingly, the drive efficiency of the piezoelectric actuator 503 is further improved.

Next, an explanation will be given about modified embodiments in which various changes are made to the tenth embodiment. Here, elements or components of the modified embodiments having the same configuration as those of the tenth embodiment are given the same reference numerals and the descriptions therefore are omitted as appropriate.

Figure 33:
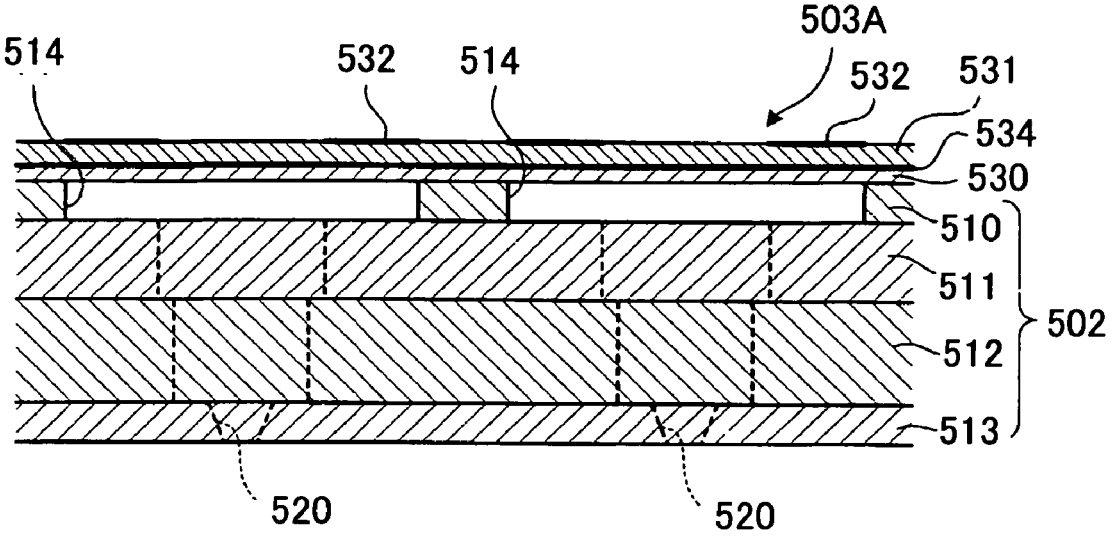
FIG. 33 is a sectional view of a first modified embodiment corresponding to FIG. 28.

[1] When the vibration plate is formed of an insulation material (for example, a silicon material in which a surface thereof is subjected to oxidation processing, a PZT material which is same as that for the piezoelectric layer 531, a ceramic material such as alumina or zirconia, or a synthetic resin material such as polyimide) (First Modified Embodiment). In this case, however, in a piezoelectric actuator 503A as shown in FIG. 33, a common electrode 534 is required on a surface of the insulative vibration plate 530A on a side opposite to the pressure chambers 514, such that the common electrode 534 is opposed to the individual electrodes 532 to generate an electric field in the piezoelectric layer 531 between the individual electrodes 532 and the common electrode 534.

Figure 34:
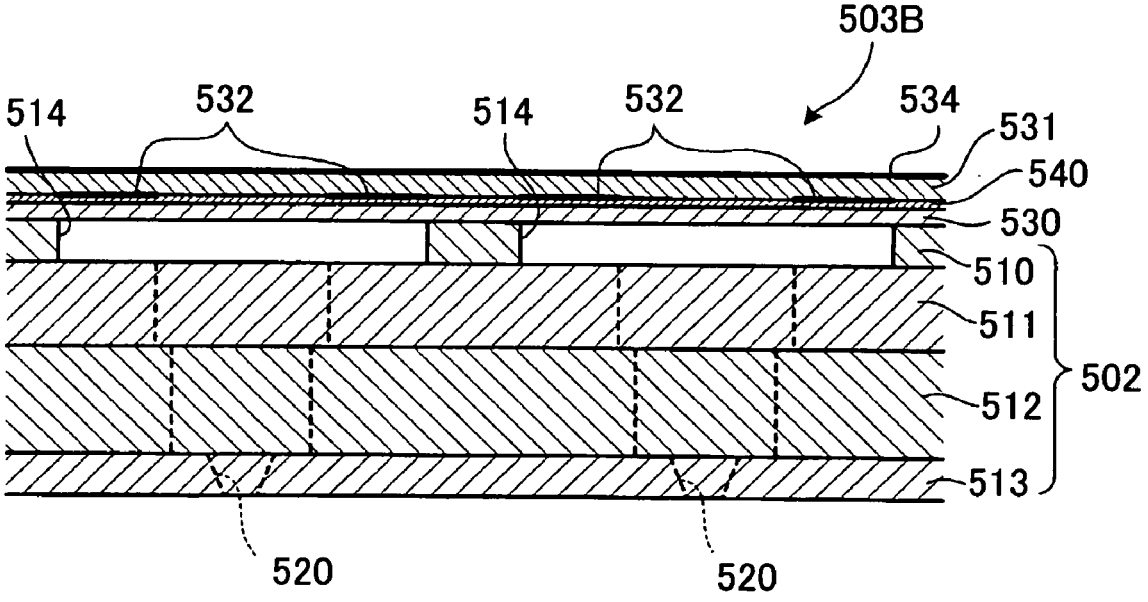
FIG. 34 is a sectional view of a second modified embodiment corresponding to FIG. 28.

[2] In the tenth embodiment, the individual electrodes are arranged on the piezoelectric layer 531 on the side opposite to the vibration plate 530. However, the individual electrodes may be arranged on the piezoelectric layer 531 on the side of the vibration plate 530, and the common electrode 534 may be arranged on the piezoelectric layer 531 on the side opposite to the vibration plate 530. In this case, however, when the vibration plate is formed of a metallic material, in a piezoelectric actuator 503B as shown in FIG. 34, it is necessary that the upper surface of the metallic vibration plate 530, where individual electrodes 530B are to be arranged, is made to be insulative, for example, by forming an insulating material layer 540 on the upper surface (surface opposite to the pressure chambers 514) of the metallic vibration plate 530, so that the individual electrodes 532B are insulated from one another (Second Modified Embodiment). This insulating material layer 540 can be formed of a ceramic material such as alumina or zirconia by using the AD method, the sputtering method, the CVD method or the sol-gel method, or the like.

Figure 35:
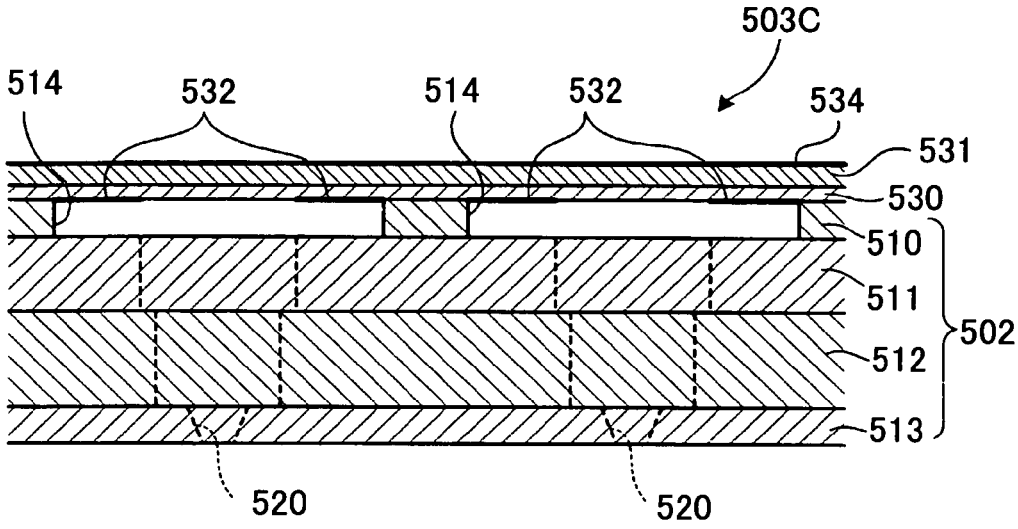
FIG. 35 is a sectional view of a third modified embodiment corresponding to FIG. 28.

On the other hand, when the vibration plate is formed of an insulation material such as a silicon material, PZT which is the same material of which the piezoelectric layer 531 is formed, a ceramic material such as alumina or zirconia, or a synthetic resin material or the like, then as shown in FIG. 35, it is sufficient in a piezoelectric actuator 503C that the individual electrodes 532 are directly arranged on the upper surface of a vibration plate 530. Accordingly, the individual electrodes 532 are insulated from one another by the insulative vibration plate 530. (Third Modified Embodiment)

Figure 36:
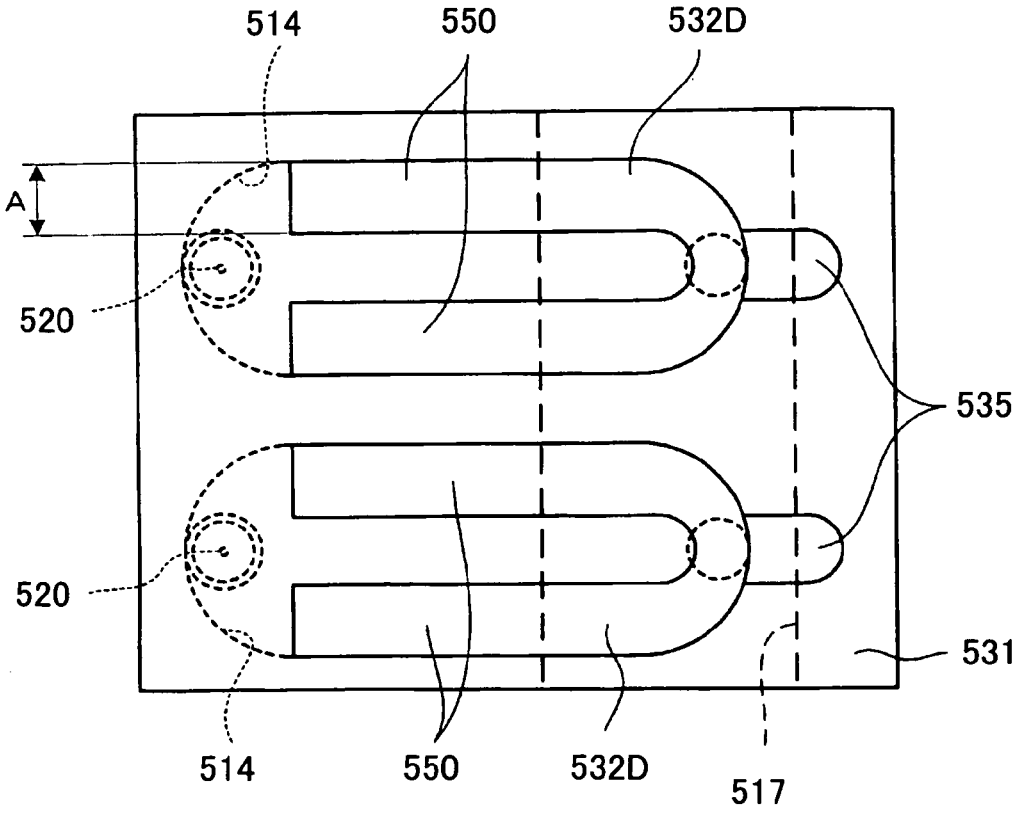
FIG. 36 is a partial enlarged plan view of an ink-jet head of a fourth modified embodiment.

[3] Each of the individual electrodes 532 does not have to be formed in an annular shape to surround the central portion of one of the pressure chambers 514 as in the above-described tenth embodiment. For example, as shown in FIG. 36, it is allowable that each of individual electrodes 532D does not completely surround the central portion of one of the pressure chambers 514 (Fourth Modified Embodiment). Here, in order to increase the amount of deformation of the vibration plate 530, it is desirable that each of the individual electrodes 532D is formed at least at two areas 550 which are included in the area overlapping with the edge portion of one of the pressure chambers 514, the two areas extending substantially parallel to the longitudinal direction (left and right direction in FIG. 36) of one of the pressure chambers 514. In this case, similar to the above-described tenth embodiment, the value of the width A of the portion of the individual electrode 532D formed in this area 550, is determined to be a value such that the amount of deformation of the vibration plate 530 becomes great.

Figure 37:
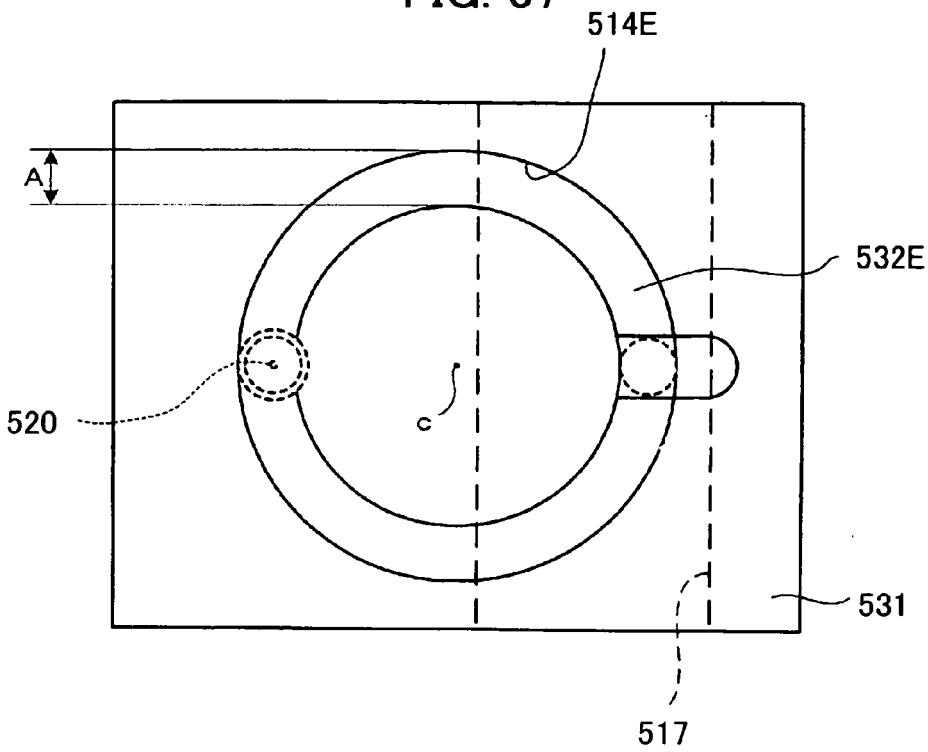
FIG. 37 is a partial enlarged plan view of an ink-jet head of a fifth modified embodiment.

[4] The shape of the pressure chambers is not limited to a substantially elliptic shape as in the abovementioned embodiment, and the pressure chambers may be formed in other shapes such as a circular shape, a rhombus, or a rectangular shape or the like (Fifth Modified Embodiment). For example, as shown in FIG. 37, when the shape of pressure chamber is circular, the length A in the radial direction (direction of a line passing through the center C of the surface area of a pressure chamber 514E) of an individual electrode 532E is determined to be an optimum value such that the maximum displacement of the vibration plate 530 becomes great.

Eleventh Embodiment

Next, an eleventh embodiment of the present invention will be explained. The eleventh embodiment is also an example in which the present invention is applied to an ink-jet head, and is similar to the tenth embodiment except for the configuration of the piezoelectric actuator. Here, elements or components of the eleventh embodiment having the same configuration as those of the tenth embodiment are given the same reference numerals and the descriptions therefore are omitted as appropriate.

Figure 38:
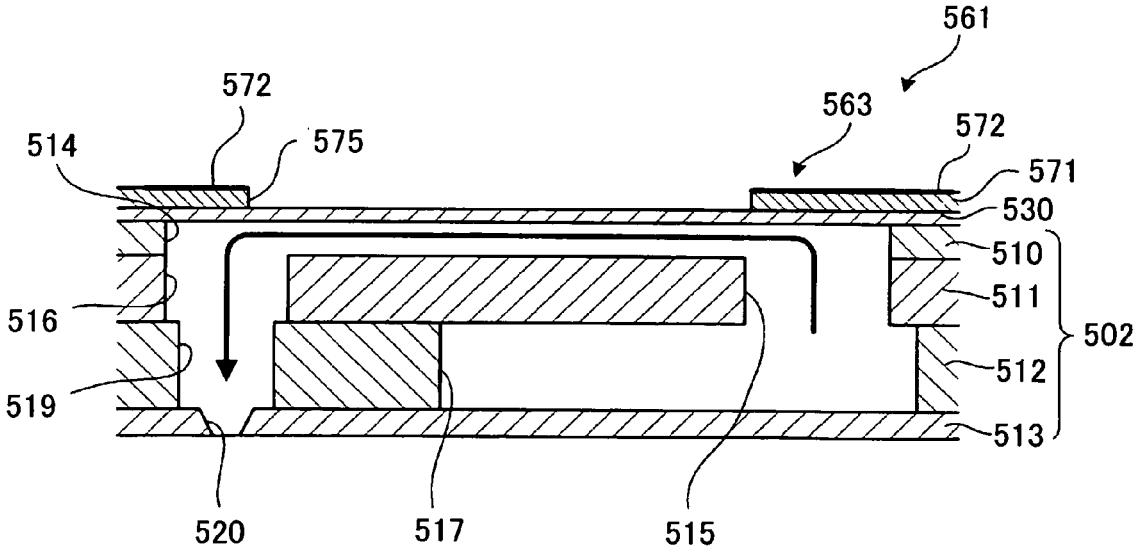
FIG. 38 is a sectional view of an ink-jet head of an eleventh embodiment corresponding to FIG. 27.
Figure 39:
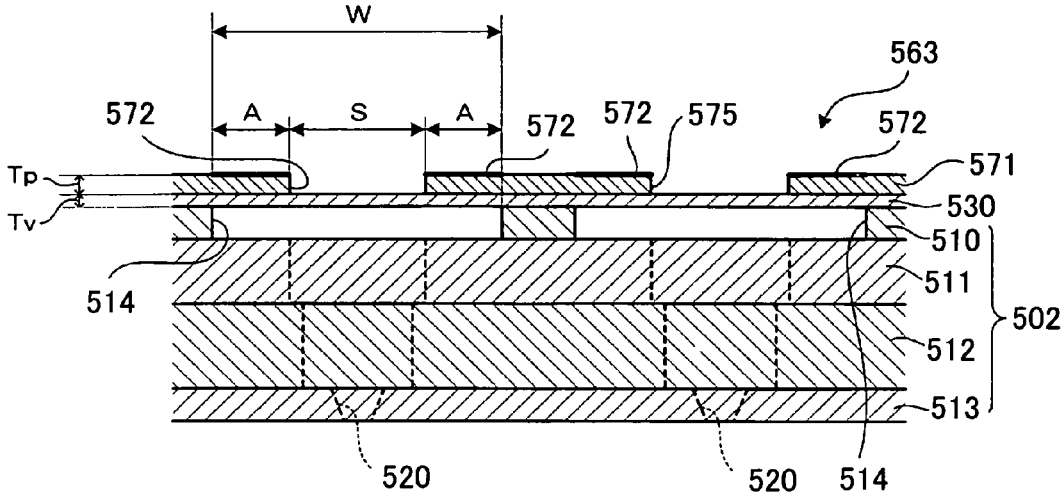
FIG. 39 is a sectional view of the ink-jet head of the eleventh embodiment corresponding to FIG. 28.

As shown in FIGS. 38 and 39, a piezoelectric actuator 563 of an ink-jet head 561 of this eleventh embodiment includes an electrically conductive vibration plate 530 arranged on the surface of a channel unit 502, a piezoelectric layer 571 formed on the upper surface of the vibration plate 530 (side opposite to a plurality of pressure chambers 514), and a plurality of individual electrodes 572 formed on the upper surface of the piezoelectric layer 571 corresponding to the pressure chambers 514 respectively.

Here, the piezoelectric actuator 563 of the eleventh embodiment is different from the piezoelectric actuator 503 (see FIGS. 27 to 29) of the tenth embodiment in that the piezoelectric layer 571 is formed on the upper surface of the vibration plate 530 at areas each of which overlaps in a plane view with the edge portion of one of the pressure chambers 514. On the other hand, openings 571 are formed at areas each of which overlaps with the central portion of one of the pressure chambers 514, and the openings 571 are areas in which the piezoelectric layer 571 is not partially formed.

Further, similar to the tenth embodiment, a length in the width direction (left and right direction in FIG. 39) of the individual electrode 572, the width direction being a direction orthogonal to the longitudinal direction of the pressure chamber 514, is set to be an optimum value such that the amount of deformation (maximum amount of displacement) of the vibration plate 530 becomes great.

Figure 40:
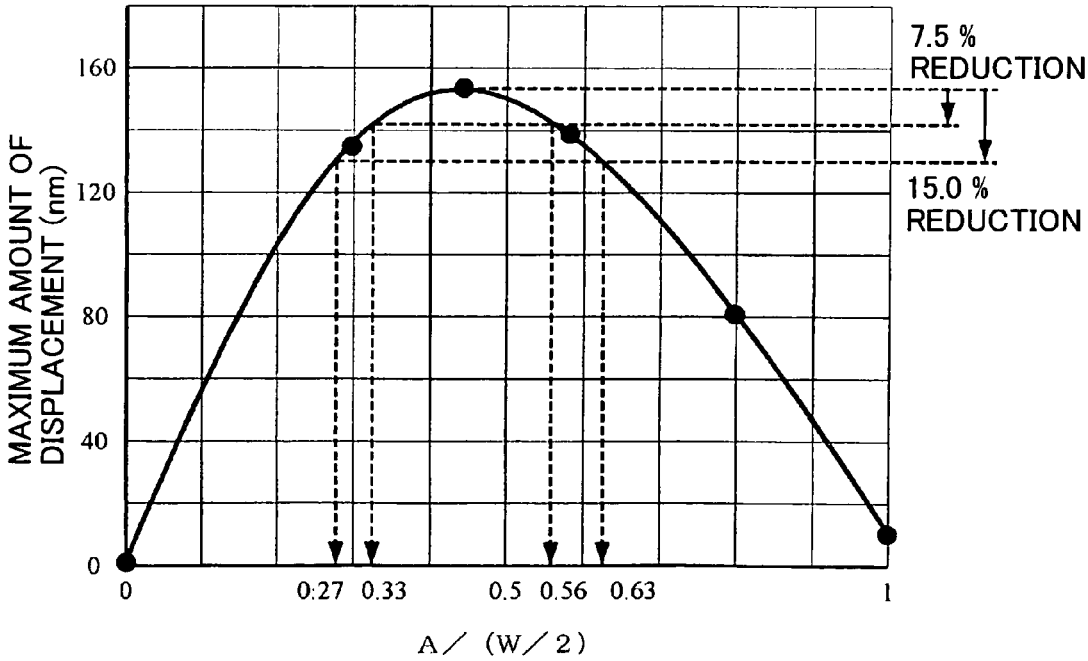
FIG. 40 is a graph showing a relationship between the value of A/(W/2) and the maximum amount of displacement of the vibration plate.

Similar to the tenth embodiment, FIG. 40 shows a relationship between the maximum amount of displacement of the vibration plate 530 and a value of A/(W/2) which is a ratio of the width A of the individual electrode 572 to a half of the width W of the pressure chamber 514 (W/2) when the structural analysis using FEM was carried out wherein width W of pressure chamber 514 is 419 μm, thickness Tv of the vibration plate 530 formed of stainless steel is 20 μm, thickness Tp of the piezoelectric layer 571 formed of PZT is 10 μm, and drive voltage applied to the individual electrode 532 is 20V. Accordingly, an optimum value of A/(W/2) is set to 0.44 which is a value at which the maximum amount of displacement of the vibration plate 530 becomes the peak value, and the optimum value for the width A of the individual electrode 532 is determined from this value. It should be noted that in the piezoelectric actuator 563 of the eleventh embodiment, the driven zones of the piezoelectric actuator 563, each of which overlaps with the central portion of one of the pressure chambers 514, is constructed only of the vibration plate 530. Accordingly, the rigidity of the driven zones becomes small, and consequently the maximum amount of displacement of the vibration plate 530 as a whole becomes greater than in the piezoelectric actuator 503 of the tenth embodiment (see FIGS. 27 to 29).

The width A of the individual electrodes 532 actually formed deviates in some cases from the above-described optimum value due to the manufacturing error. In such a case, for example, a range of the value A, which is acceptable, is determined as follows. When the variation in the velocity of droplet needs to be suppressed to be within a range of not more than 2 m/s, then, according to the empirical rule that when the maximum amount of displacement of the vibration plate 530 is reduced by 7.5%, the velocity of droplet is reduced by 1 m/s (see FIG. 31), the value of A/(W/2) may be in a range of not less than 0.27 and not more than 0.63 in which the maximum amount of displacement of the vibration plate 530 is within −15% of the peak value. Further, when the variation in the velocity of droplet needs to be suppressed in a more stringent range of not more than 1 m/s, then the value of A/(W/2) may be in a range of not less than 0.33 and not more than 0.56 in which the maximum amount of displacement of the vibration plate 530 is within −7.5% of the peak value.

In the piezoelectric actuator 563 of the eleventh embodiment, the piezoelectric layer 571 is formed on the upper surface of the vibration plate 530 at areas each of which overlaps with the edge portion of one of the pressure chambers 514, but the piezoelectric layer 571 is not formed on the upper surface of the vibration plate 530 at areas each of which overlaps with the central portion of one of the pressure chambers 514. Accordingly, there is a difference in the rigidity between these two kinds of areas. Since the rigidity in each of the two kinds of areas depends on the thickness Tv of vibration plate 530, the thickness Tp of piezoelectric layer 571 and a width S of opening 575, when any one of the three parameters Tv, Tp and S changes, there is a change in the tendency of the maximum amount of displacement, of the vibration plate 530, with respect to the width A of the individual electrode 572. Accordingly, the relationship between the value of A/(W/2) and the maximum amount of displacement of the vibration plate 530 as shown in FIG. 40 is determined in advance for each combination of the three parameters Tv, Tp and S, and then one relationship, which is included in the determined relationships between the value of A/(W/2) and the maximum amount of displacement of the vibration plate 530 and which corresponds to the values of Tv, Tp and S measured in the step of manufacturing the ink-jet head 561, is selected to determine an optimum value of A/(W/2) from the selected relationship. In the following, FIGS. 41 to 43 respectively show a tendency of change in the relationship between the value of A/(W/2) and the maximum amount of displacement of the vibration plate 530 when one of the thickness Tv of vibration plate 530, the thickness Tp of piezoelectric layer 571, and the width S of opening 575 is changed.

Figure 41:
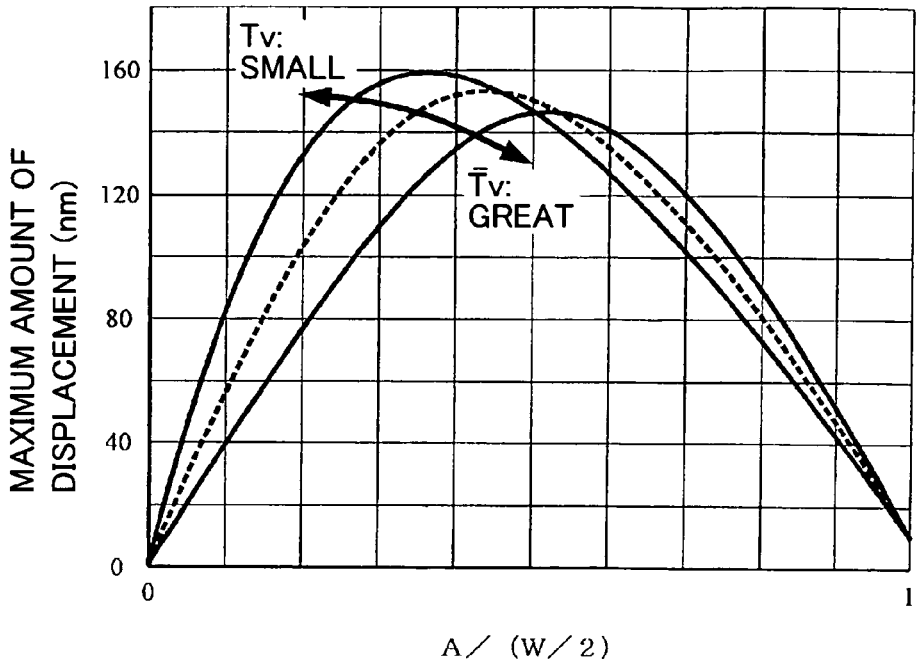
FIG. 41 is a graph showing a tendency of change in the maximum amount of displacement of the vibration plate when a thickness Tv of the vibration plate is changed.
Figure 42:
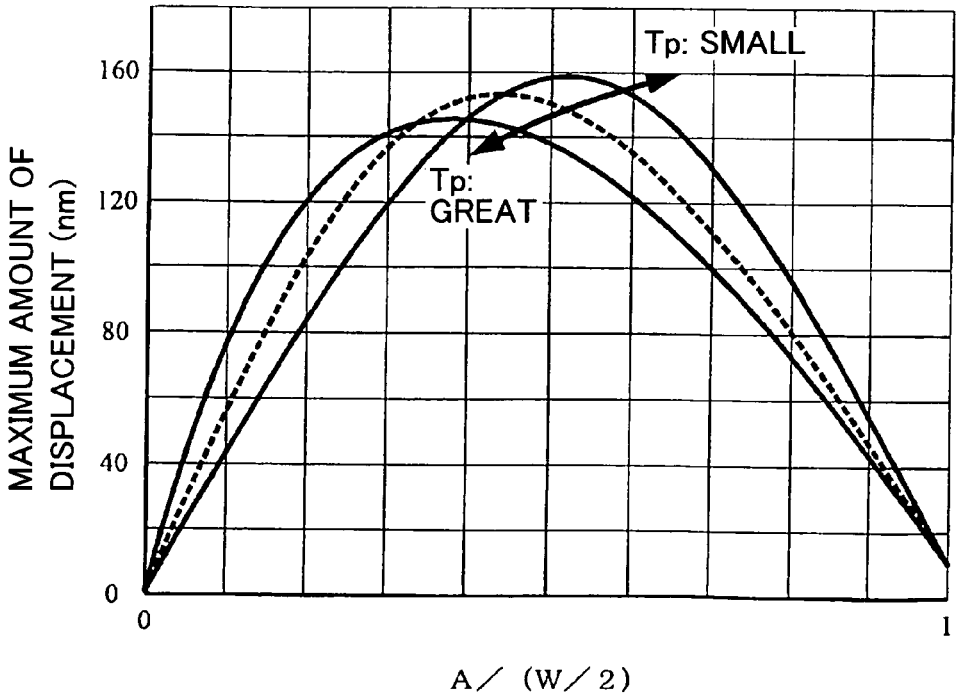
FIG. 42 is a graph the tendency of change in the maximum amount of displacement of the vibration plate when a thickness Tp of the piezoelectric layer is changed.
Figure 43:
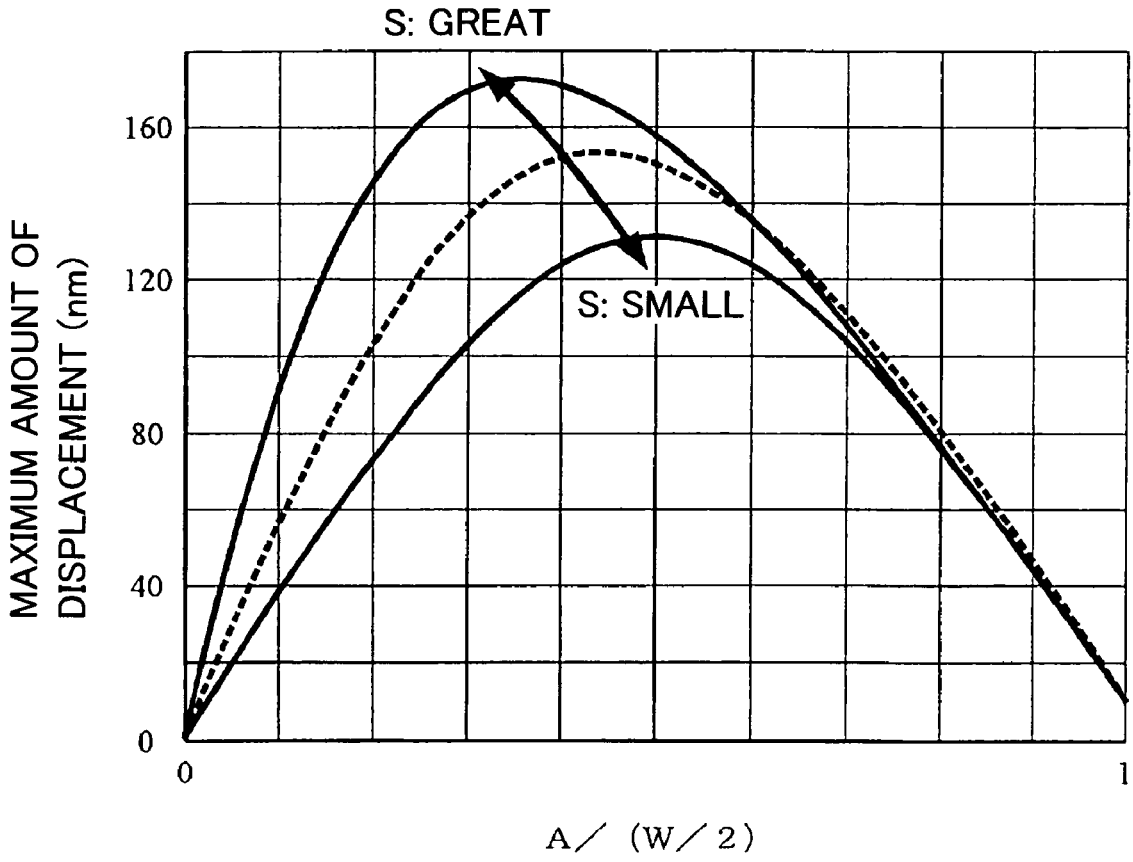
FIG. 43 is a graph showing the tendency of change in the maximum amount of displacement of the vibration plate when a width S of the opening is changed.

As shown in FIG. 41, when the thickness Tv of the vibration plate 530 becomes great, the value of A/(W/2) at which the maximum amount of displacement peaks becomes great. On the other hand, when Tv becomes small, the value of A/(W/2) at which the maximum amount of displacement peaks becomes small. As shown in FIG. 42, when the thickness Tp of the piezoelectric layer 571 becomes great, the value of A/(W/2) at which the maximum amount of displacement peaks becomes small. On the other hand, when Tp becomes small, the value of A/(W/2) at which the maximum amount of displacement peaks becomes great. Further, as shown in FIG. 43, when the width S of the opening 575 becomes great, the value of A/(W/2) at which the maximum amount of displacement peaks becomes small. On the other hand, when S becomes small, the value of A/(W/2) at which the maximum amount of displacement peaks becomes great.

In the following, a method for producing the ink-jet head 561 of the eleventh embodiment will be explained. First, the relationship between the value of A/(W/2) and the maximum amount of displacement of the vibration plate 530 as shown in FIG. 40 is determined for each combination of the thickness Tv of the vibration plate 530, the thickness Tp of the piezoelectric layer 571, and the width S of the opening 575.

Figure 44A:
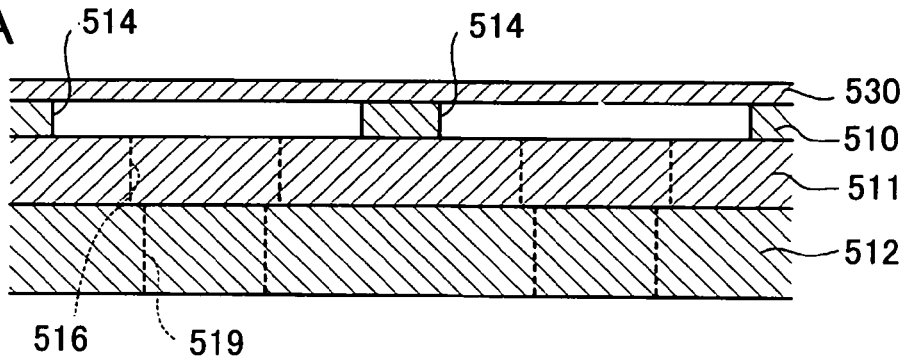
FIG. 44A shows a joining step of metallic plates.
Figure 44B:
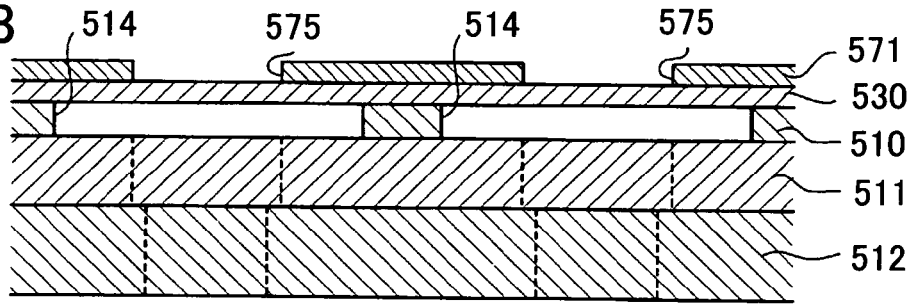
FIG. 44B shows a piezoelectric layer formation step.

Next, as shown in FIG. 44A, the thickness Tv of the vibration plate 530 is measured (step for measuring the thickness of the vibration plate 530), and then the four metal plate of the cavity plate 510, the base plate 511, the manifold plate 512 and the vibration plate 530 are joined altogether. Subsequently, as shown in FIG. 44B, the piezoelectric layer 571 is formed on the upper surface of the vibration plate 530 at areas each of which overlaps with the edge portion of one of a plurality of pressure chambers 514 by means of the AD method or the like, such that the plurality of openings 575 are formed at locations each of which overlaps with the central portion of one of the pressure chambers 514 (piezoelectric layer formation step). Then, the thickness Tp of the piezoelectric layer 571 is measured by using a laser displacement gauge or the like (step of measuring the thickness of the piezoelectric layer), followed by measuring the width S of the openings 575 each of which is formed at an area overlapping with the central portion of one of the pressure chambers 514 (opening length measurement step).

Figure 44C:
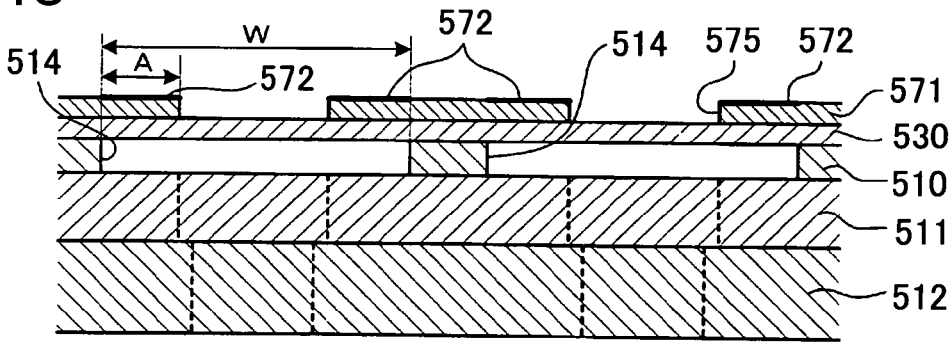
FIG. 44C shows an individual electrode formation step.
Figure 44D:
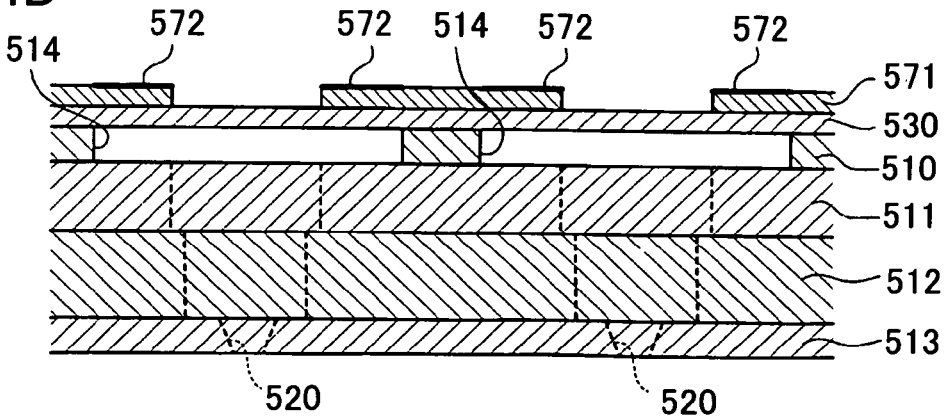
FIG. 44D shows a joining step of a nozzle plate.

Next, one relationship between the value of A/(W/2) and the maximum amount of displacement of the vibration plate 530, corresponding to the measured values of Tv, Tp and S, is selected from the relationships between the value of A/(W/2) and the maximum amount of displacement of the vibration plate 530 determined in advance for each of the combinations of the thickness Tv of the vibration plate 530, the thickness Tp of the piezoelectric layer 571 and the width S of the opening 575. Then, the width A of the individual electrodes 572 is determined based on the selected relationship such that the maximum amount of displacement of the vibration plate 530 becomes great (individual electrode length determination step). Next, as shown in FIG. 44C, the individual electrodes 571 having the determined value A are formed, with the screen-printing or the like, on the upper surface of the piezoelectric layer 571 at the areas each of which overlapping with the edge portion of one of the pressure chambers 514 (individual electrode formation step). Finally, as shown in FIG. 44D, the nozzle plate 513 is joined to the lower surface of the manifold plate 512, thus completing the production of the ink-jet head 561.

According to the method for producing the ink-jet head 561 of the eleventh embodiment, similar to the tenth embodiment, the width A of the individual electrodes 532 can be a value such that the maximum amount of displacement of the vibration plate 530 becomes great in a range not adversely affecting the printing quality. Accordingly, the drive efficiency of the piezoelectric actuator 563 is further improved. Further, the driven zones in the piezoelectric actuator 563, each of which overlaps with the central portion of one of the pressure chambers 514, are constructed only with the vibration plate 530. Accordingly, the rigidity in the driven zones becomes small, and thus the maximum amount of displacement of the vibration plate 530 becomes greater than in the piezoelectric actuator 503 of the tenth embodiment (see FIGS. 27 to 29).

It should be noted that also in the eleventh embodiment, each of the individual electrodes does not have to be formed in an annular shape to surround the central portion of one of the pressure chambers. For example, as the fourth modification of the tenth embodiment (see FIG. 36), it is allowable that each of individual electrodes does not completely surround the central portion of one of the pressure chambers. Further, the shape of the pressure chambers is not limited to a substantially elliptic shape, and the pressure chambers may be formed in other shapes such as, a circular shape, a rhombus, or a rectangular shape or the like.

Each of the above-explained tenth and eleventh embodiments is an example in which the present invention is applied to an ink-jet head which transports ink to the nozzles to discharge the ink through the nozzles. However, the liquid transporting apparatus, to which the present invention is applicable, is not limited to the ink-jet head. For example, the present invention can also be applied to a liquid transporting apparatus which transports a liquid such as a medicinal solution or a biochemical solution inside a micro total-analyzing system (μTAS), a liquid transporting apparatus which transports a liquid such as a solvent and a chemical solution inside a micro chemical system, and a liquid transporting apparatus which transports a liquid other than ink.

Twelfth Embodiment

Figure 45A:
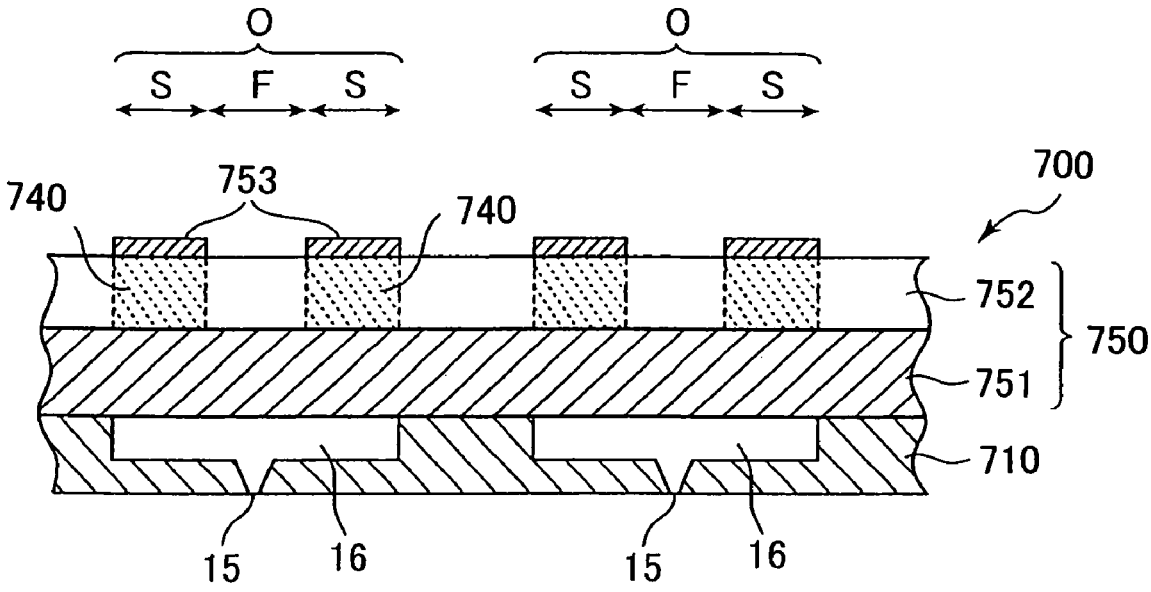
FIG. 45A is a partial sectional view of an ink-jet head 700 of a twelfth embodiment provided with a piezoelectric actuator 750 which has a metal layer 751.

Next, a twelfth embodiment of the present invention will be explained. In an ink-jet head 700 as the liquid transporting apparatus of the present invention, an actuator 750 includes a metal layer 751 and a piezoelectric layer 752, as shown in FIG. 45A. A plurality of operation portions O is provided in the piezoelectric layer 752 in one-to-one correspondence with the pressure chambers 16 respectively. In each of second portions S in each of the operation portions O, an electrode 753 is provided over the piezoelectric layer 752. An active portion 740 is formed between the electrode 753 and the metal layer 751 when a high, polarizing voltage is applied between the electrode 753 and the metal layer 751. In this embodiment, a cavity plate 710 makes contact with a surface of the metal layer 751. However, the cavity plate 750 may make contact with a surface of the piezoelectric layer 752.

Figure 45B:
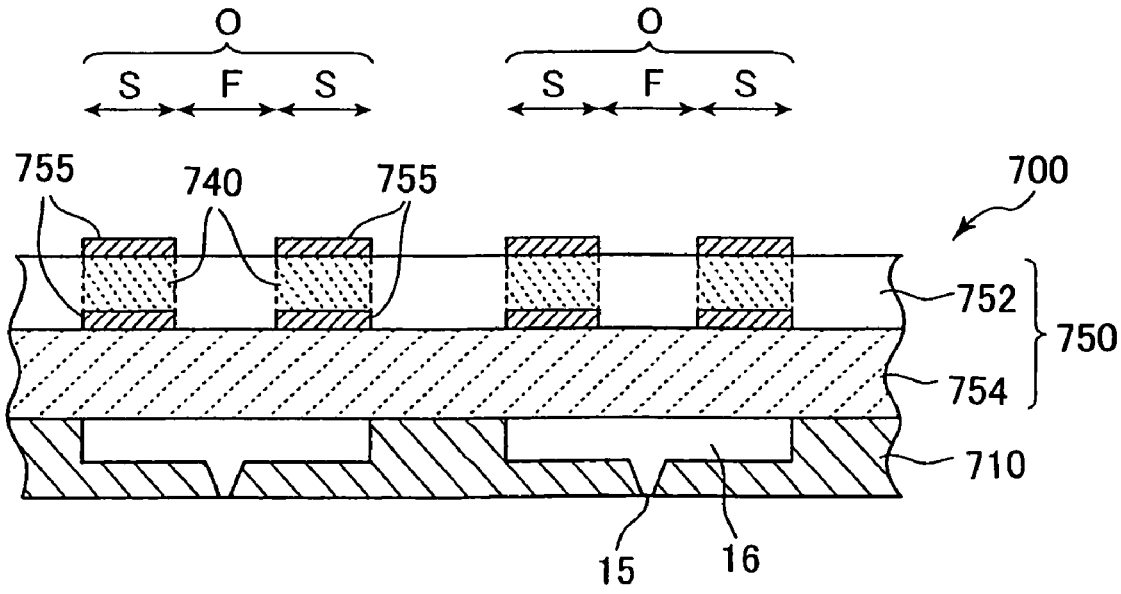
FIG. 45B is a partial sectional view of the ink-jet head 700 of the twelfth embodiment provided with the piezoelectric actuator 750 which has an insulation layer 754.

Similarly, as shown in FIG. 45B, the piezoelectric actuator 750 may be provided with an insulation layer 754 and the piezoelectric layer 752. The insulation layer 754 is formed of ceramic or resin. A plurality of operation portions O is provided in the piezoelectric layer 752 in one-to-one correspondence with the pressure chambers 16. In each of second portions S in each of the operation portions O, a pair of electrodes 755 is provided such that one electrode 755 of the pair is disposed over the piezoelectric layer 752 and the other electrode 755 of the pair is disposed over the insulation layer 754. An active portion 740 is formed between the pair of electrodes 755 when a high, polarizing voltage is applied between the electrodes 755 of the pair. In this embodiment, although the cavity plate 710 makes contact with a surface of the insulation layer 754, the cavity plate 710 may make contact with a surface of the piezoelectric layer 752.

Thirteenth Embodiment

Figure 46A:
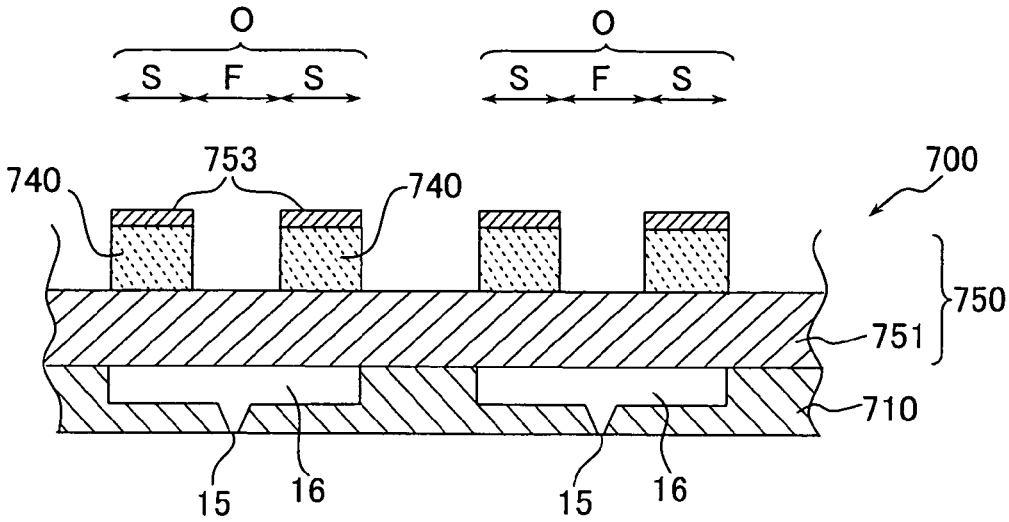
FIG. 46A shows a partial sectional view of an ink-jet head 700 of a thirteenth embodiment provided with a piezoelectric actuator 750 which has a metal layer 751.

Next, a thirteenth embodiment of the present invention will be explained. In an ink-jet head 700 as the liquid transporting apparatus of the present invention, the piezoelectric layer is not a single layer but is individually provided for each of the plurality of operation portions O. As shown in FIG. 46A, the plurality of operation portions O, each of which is formed of a piezoelectric material, may be formed individually from one another. The operation portions O are arranged in the planar direction over the metal layer 751 separately from one another in the planar direction. The electrode 753 is provided over each of the second portions S in each of the operation portions O so as to form an active portion between the electrode 753 and the metal layer 751. Here, although the cavity plate 710 makes contact with a surface of the metal layer 751, the cavity plate 710 may make contact with upper surfaces of the plurality of operation portions O.

Figure 46B:
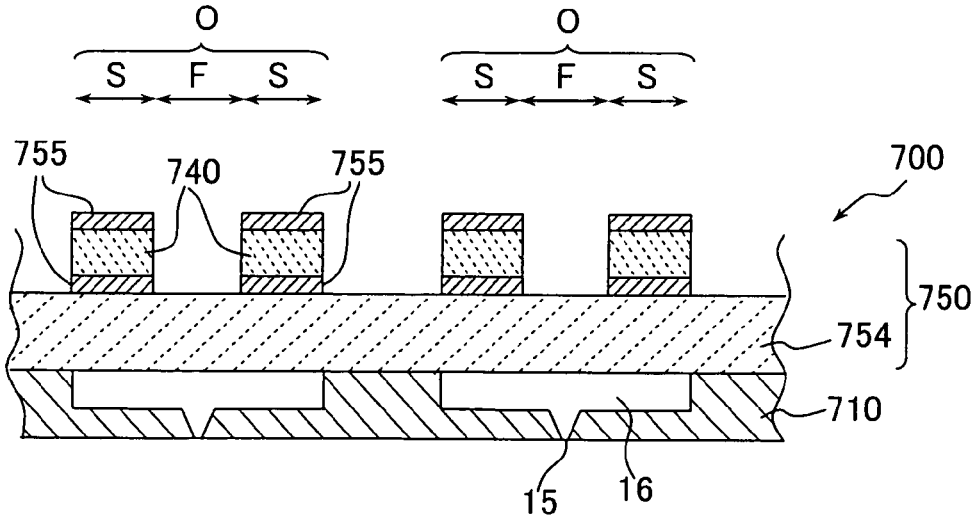
FIG. 46B shows the ink-jet head 700 of the thirteenth embodiment provided with the piezoelectric actuator 750 which has an insulation layer 754.
Figure 47:
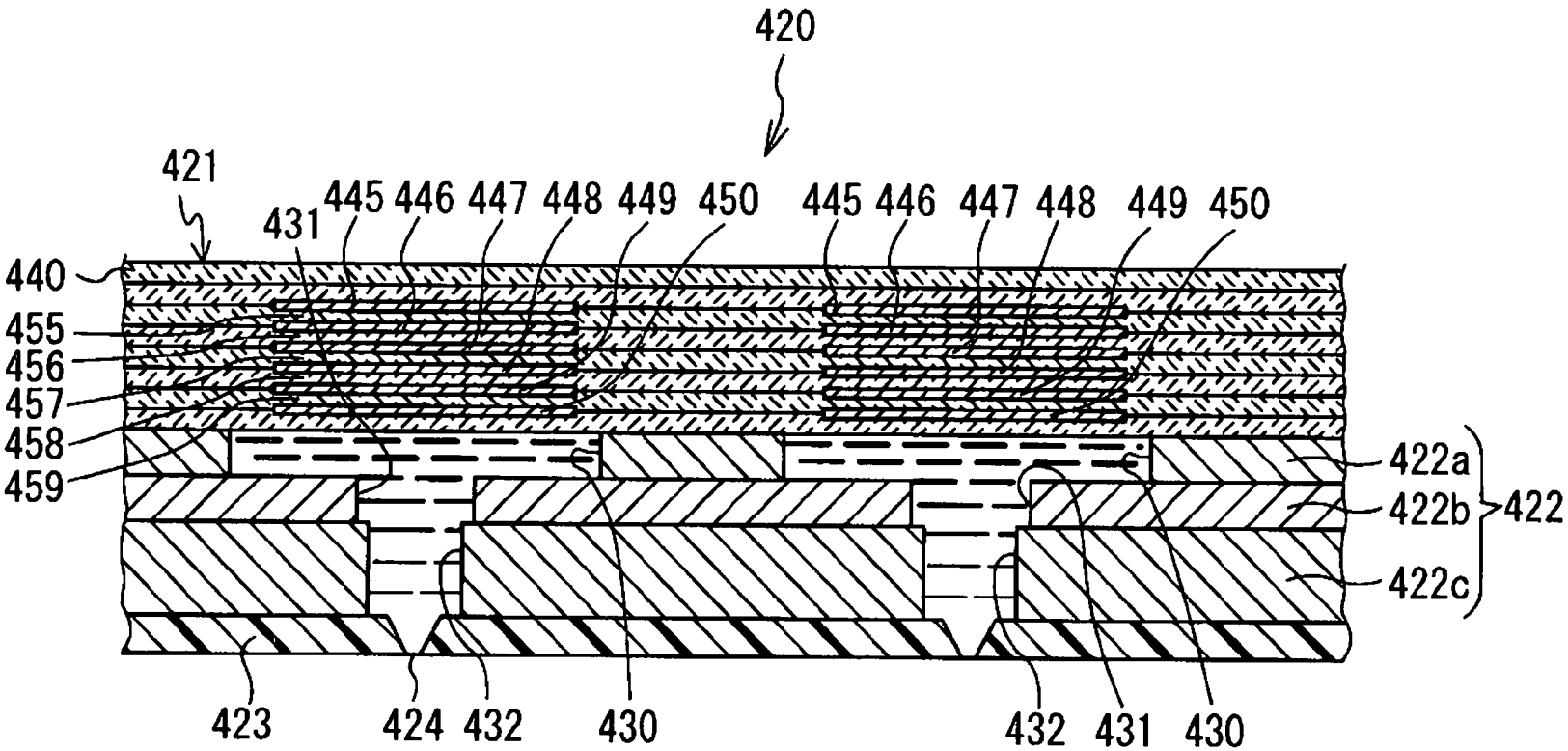
FIG. 47 is a sectional view of a conventional ink-jet head 420.
Figure 48:
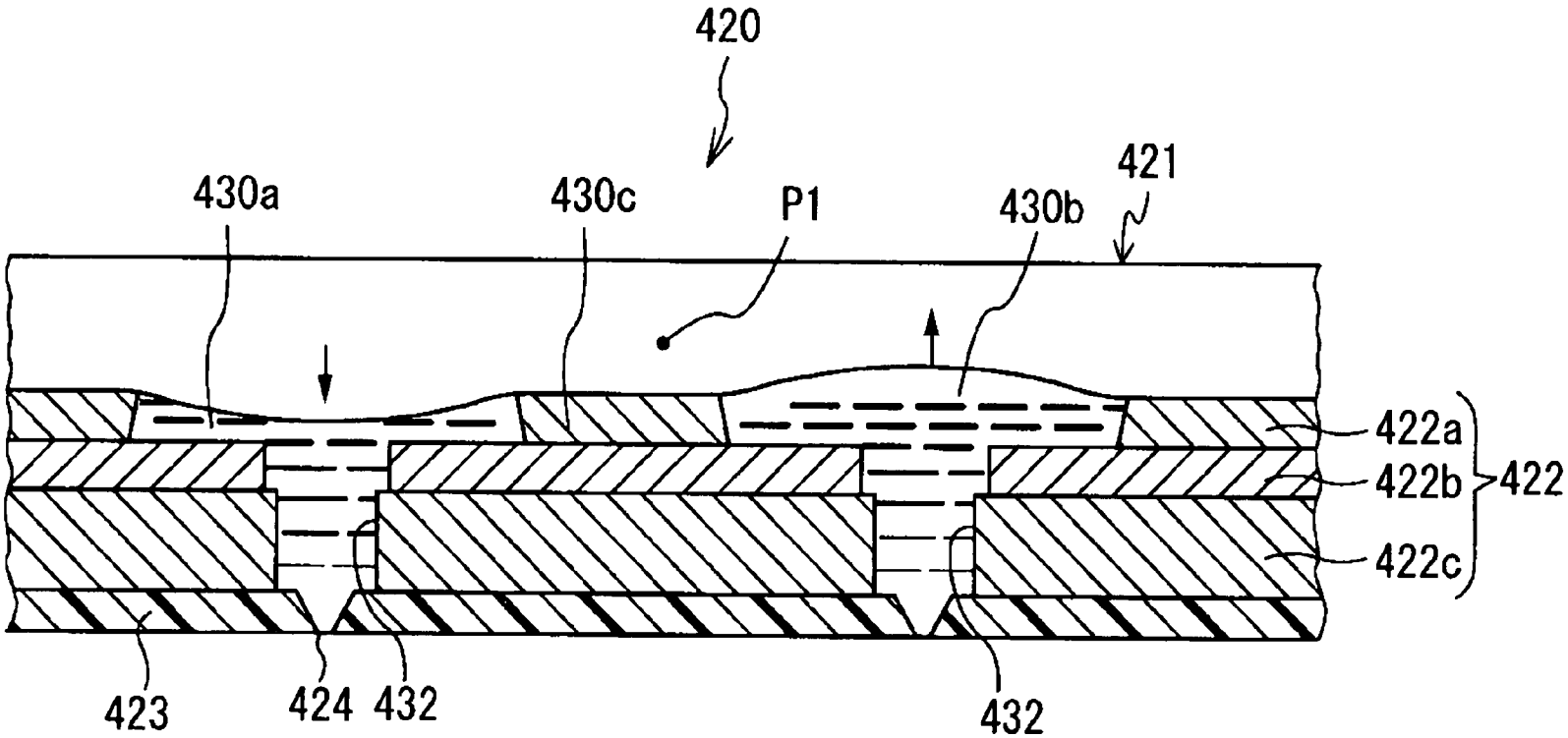
FIG. 48 is a sectional view showing a state in which the piezoelectric actuator plate 421 of FIG. 47 is deformed.

As shown in FIG. 46B, in a piezoelectric actuator 750 having an insulation layer 754 which is formed of ceramic or resin, a plurality of operation portions O, each of which is made of piezoelectric material, may be formed individually from one another. The plurality of piezoelectric operation portions O are arranged in the planar direction over the insulation layer 754 separately from one another in the planar direction. A pair of electrodes 755 is provided in each of second portions S of each of the operation portion O such that the pair of the electrodes 755 sandwiches each of the second portions S therebetween in each of the operation portions O to form an active portion 740. In this embodiment, although the cavity plate 710 makes contact with a surface of the insulation layer 754, the cavity plate 710 may make contact with surfaces of the plurality of piezoelectric active portions O.

What is claimed is:

1. A liquid transporting apparatus comprising:

a plate-shaped body including first and second surfaces which are separated from each other by a predetermined distance in a thickness direction and which extend in a predetermined planar direction substantially perpendicular to the thickness direction, and an operation portion having a first portion and a pair of second portions disposed symmetrically on either side of the first portion with respect to the planar direction;

at least one electrode located in each of the second portions, the at least one electrode including at least one pair of electrodes to sandwich an active portion, the active portion being defined in each of the second portions between the pair of electrodes and located nearer to the first surface than the second surface in the thickness direction, at least the active portion in the plate-shaped body being formed from piezoelectric material, the at least one pair of electrodes generating an electric field for deforming the active portion in the planar direction, thereby archingly deforming each of the second portions in a direction from one to the other of the first and second portions, and consequently archingly deforming the first portion in an opposite direction from the other to the one of the first and second portions, thereby deforming the operation portion in the thickness direction;

a fluid accommodating plate disposed to face one of the first surface and the second surface of the plate-shaped body, the fluid accommodating plate forming a fluid accommodating chamber, the operation portion of the plate-shaped body confronting the fluid accommodating chamber, volume of the fluid accommodation chamber changing in association with the deformation of the first portion and of the pair of second portions to transport fluid in the fluid accommodation chamber;

a hole-defining portion defining an ejection hole in fluid communication with the fluid accommodating chamber, change in volume of the fluid accommodation chamber transporting the fluid in the fluid accommodation chamber through the ejection hole;

wherein a value of A/(W/2) is not less than 0.33 and not more than 0.75 when W is a length in a radial direction of the fluid accommodating chamber, and A is a length in the radial direction of a portion of the at least one electrode, the portion being formed at an area which overlaps with one side portion in the radial direction of the at least one electrode and an edge portion of the fluid accommodating chamber, the edge portion being other than a central portion of the fluid accommodating chamber.

2. The liquid transporting apparatus according to claim 1, wherein the value of A/(W/2) is not less than 0.41 and not more than 0.69.

3. The liquid transporting apparatus according to claim 1, wherein the value of A/(W/2) is not less than 0.41 and not more than 0.55.

4. The liquid transporting apparatus according to claim 1, wherein the fluid accommodating chamber has a shape long in a predetermined direction; and the at least one electrode is formed at two areas which are included in the area overlapping with the edge portion of the fluid accommodating chamber and which extend substantially in parallel in the predetermined direction.

5. The liquid transporting apparatus according to claim 1, wherein the pair of electrodes in each of the second portions are disposed in confrontation with each other to sandwich the active portion therebetween in a predetermined direction, the predetermined direction being either one of the planar direction and the thickness direction, the active portion being polarized in a direction parallel to the predetermined direction, the electric field generated between the confronting electrodes in the predetermined direction changing a length of the active portion in the planar direction, thereby bending the corresponding second portions in the direction from one to the other of the first surface and the second surface, and consequently bending the first portion in the opposite direction from the other to the one of the first surface and the second surface, thereby deforming the operation portion in the thickness direction;

wherein the plate-shaped body includes a piezoelectric layer which is formed of a piezoelectric material and which defines the first surface, and the pair of electrodes which is formed to sandwich the piezoelectric layer therebetween to define the active portion in the piezoelectric layer sandwiched between the electrodes;

wherein the pair of electrodes in each of the second portions includes a first surface electrode and a second surface electrode, the first surface electrode being disposed on the first surface, the second surface electrode of the pair of electrodes in each of the pair of second portions being integrated with a metal layer formed of metal, and the metal layer defining the second surface on a surface of the metal layer opposite to the other surface thereof facing the piezoelectric layer; and wherein the active portion is defined in each of the second portions at a location between the first surface electrode and the second surface electrode, the first surface electrode and the second surface electrode generating the electric field for deforming the active portion in the planar direction.

6. The liquid transporting apparatus according to claim 1, wherein the pair of electrodes in each of the second portions are disposed in confrontation with each other to sandwich the active portion therebetween in a predetermined direction, the predetermined direction being either one of the planar direction and the thickness direction, the active portion being polarized in a direction parallel to the predetermined direction, the electric field generated between the confronting electrodes in the predetermined direction changing a length of the active portion in the planar direction, thereby bending the corresponding second portions in the direction from one to the other of the first surface and the second surface, and consequently bending the first portion in the opposite direction from the other to the one of the first surface and the second surface, thereby deforming the operation portion in the thickness direction;

wherein the plate-shaped body includes a plurality of operation portions made of a plurality of piezoelectric material portions, the piezoelectric material portions being arranged in the planar direction separately from one another in the planar direction, the piezoelectric material portions defining the first surface;

wherein the pair of electrodes in each of the second portions includes a first surface electrode and a second surface electrode, the first surface electrode being disposed on the first surface, the second surface electrode of the pair of electrode in each of the pair of second portions being integrated with a metal layer formed of metal, and the metal layer defining the second surface on a surface of the metal layer opposite to the other surface thereof facing the piezoelectric material portions; and wherein the active portion is defined in each of the second portions at a location between the first surface electrode and the second surface electrode, the first surface electrode and the second surface electrode generating the electric field for deforming the active portion in the planar direction.

7. A liquid transporting apparatus comprising:

a channel unit having a plurality of pressure chambers each of which is arranged along a plane; and a piezoelectric actuator which selectively changes volumes of the pressure chambers to apply pressure to a liquid in the pressure chambers;

wherein the piezoelectric actuator includes:

a vibration plate joined to the channel unit to cover the pressure chambers;

a piezoelectric layer which is arranged on a side of the vibration plate opposite to the pressure chambers and which is formed to overlap with the pressure chambers as viewed in a direction perpendicular to the plane;

a plurality of individual electrodes each of which is formed at an area of the piezoelectric layer, the area being in one surface of the piezoelectric layer and overlapping with an edge portion of one of the pressure chambers as viewed in the direction perpendicular to the plane, the edge portion being other than a central portion of one of the pressure chambers; and a common electrode which is formed on the other surface of the piezoelectric layer;

wherein a value of A/(W/2) is not less than 0.33 and not more than 0.75 when W is a length in a radial direction of the pressure chambers, and A is a length of portions of the individual electrodes in the radial direction, the portions being formed at areas each overlapping with one side portion, in the radial direction, of the edge portion of one of the pressure chambers.

8. The liquid transporting apparatus according to claim 7, wherein the value of A/(W/2) is not less than 0.41 and not more than 0.69.

9. The liquid transporting apparatus according to claim 7, wherein the value of A/(W/2) is not less than 0.41 and not more than 0.55.

10. The liquid transporting apparatus according to claim 7, wherein each of the pressure chambers has a shape long in a predetermined direction; and each of the individual electrodes is formed at least at two areas which are included in the area overlapping with the edge portion of one of the pressure chambers and which extend substantially in parallel to the predetermined direction.

11. The liquid transporting apparatus according to claim 7, wherein the vibration plate is formed of a metallic material and serves as the common electrode.

12. The liquid transporting apparatus according to claim 7, wherein the vibration plate is insulative at least on a surface of the vibration plate opposite to the pressure chambers; and the common electrode is formed on the surface of the vibration plate opposite to the pressure chambers.

13. The liquid transporting apparatus according to claim 7, wherein the vibration plate is insulative at least on a surface of the vibration plate opposite to the pressure chambers; and the individual electrodes are formed on the surface of the vibration plate opposite to the pressure chambers.

14. The liquid transporting apparatus according to claim 7, wherein the piezoelectric layer is formed to overlap entirely with the pressure chambers as view of in the direction perpendicular to the plane.

15. A method for producing a liquid transporting apparatus provided with a channel unit having a plurality of pressure chambers each of which is arranged along a plane; and a piezoelectric actuator including a vibration plate which covers the pressure chambers, a piezoelectric layer arranged on a side of the vibration plate opposite to the pressure chambers, a plurality of individual electrodes each of which is formed at an area of the piezoelectric layer, the area being in one surface of the piezoelectric layer and overlapping with an edge portion of one of the pressure chambers as viewed in a direction perpendicular to the plane, the edge portion being other than a central portion of one of the pressure chambers, and a common electrode which is formed on the other surface of the piezoelectric layer, the method comprising:

an electrode length determination step of determining a length A in a radial direction of the individual electrodes based on a relationship between an amount of deformation of the vibration plate when a voltage is applied to the individual electrodes and a value of A/(W/2) in which W is a length in the radial direction of the pressure chambers, and A is a length in the radial direction of portions of the individual electrodes, the portions being formed at areas each overlapping with one side portion, in the radial direction, of the edge portion of one of the pressure chambers; and an individual electrode formation step of forming the individual electrodes having the length A determined in the electrode length determination step.

16. The method according to claim 15, comprising a piezoelectric layer formation step of forming the piezoelectric layer so as to entirely cover the pressure chambers.

17. The method according to claim 15, comprising:

a vibration plate thickness measurement step of measuring a thickness of the vibration plate;

a piezoelectric layer formation step of forming the piezoelectric layer at areas on a surface of the vibration plate opposite to the pressure chambers, each of the areas overlapping with the edge portion of one of the pressure chambers, such that a plurality of openings are formed at locations overlapping with central portions of the pressure chambers respectively as viewed in the direction perpendicular to the plane;

a piezoelectric layer thickness measurement step of measuring a thickness of the piezoelectric layer; and an opening length measurement step of measuring a length in the radial direction of the openings, each of the openings overlapping with one of the pressure chambers and being an area in which the piezoelectric layer is partially absent as viewed in the direction perpendicular to the plane, wherein in the electrode length determination step, the relationship between the amount of deformation of the vibration plate when the voltage is applied to the individual electrodes and the value of A/(W/2) is determined based on the thickness of the vibration plate, the thickness of the piezoelectric layer, and the length in the radial direction of the openings; and the length A in the radial direction of the individual electrodes is determined based on the determined relationship.

18. A liquid transporting apparatus comprising:

a plate-shaped body including first and second surfaces which are separated from each other by a predetermined distance in a thickness direction and which extend in a predetermined planar direction substantially perpendicular to the thickness direction, and an operation portion having a first portion and a pair of second portions disposed symmetrically on either side of the first portion with respect to the planar direction;

at least one electrode located in each of the second portions, the at least one electrode including at least one pair of electrodes to sandwich an active portion, the active portion being defined in each of the second portions between the pair of electrodes and located nearer to the first surface than the second surface in the thickness direction, at least the active portion in the plate-shaped body being formed from piezoelectric material, the at least one pair of electrodes generating an electric field for deforming the active portion in the planar direction, thereby archingly deforming each of the second portions in a direction from one to the other of the first and second portions, and consequently archingly deforming the first portion in an opposite direction from the other to the one of the first and second portions, thereby deforming the operation portion in the thickness direction;

a fluid accommodating plate disposed to face one of the first surface and the second surface of the plateshaped body, the fluid accommodating plate forming a fluid accommodating chamber, the operation portion of the plateshaped body confronting the fluid accommodating chamber, volume of the fluid accommodation chamber changing in association with the deformation of the first portion and of the pair of second portions to transport fluid in the fluid accommodation chamber;

a hole-defining portion defining an ejection hole in fluid communication with the fluid accommodating chamber, change in volume of the fluid accommodation chamber transporting the fluid in the fluid accommodation chamber through the ejection hole;

wherein a value of A/(W/2) is not less than 0.33 and not more than 0.75 when W is a length in a radial direction of the fluid accommodating chamber, and A is a length in the radial, direction of a portion of the piezoelectric material, the portion being formed at an area which overlaps with one side portion in the radial direction of the active portion and an edge portion of the fluid accommodating chamber, the edge portion being other than a central portion of the fluid accommodating chamber.

19. The liquid transporting apparatus according to claim 18, wherein the value of A/(W/2) is not less than 0.41 and not mare than 0.69.

20. The liquid transporting apparatus according to claim 18, wherein the value of A/(W/2) is not less than 0.41 and not more than 0.55.

21. The liquid transporting apparatus according to claim 18, wherein the fluid accommodating chamber has a shape long in a predetermined direction; and wherein the at least one electrode is formed at two areas which are included in the area overlapping with the edge portion of the fluid accommodating chamber and which extend substantially in parallel in the predetermined direction.

22. A liquid transporting apparatus comprising:

a channel unit having a plurality of pressure chambers each of which is arranged along a plane; and a piezoelectric actuator which selectively changes volumes of the pressure chambers to apply pressure to a liquid in the pressure chambers;

wherein the piezoelectric actuator includes:

a vibration plate joined to the channel unit to cover the pressure chambers;

a piezoelectric layer which is arranged on a side of the vibration plate opposite to the pressure chambers and which is formed to overlap with the pressure chambers as viewed in a direction perpendicular to the plane;

a plurality of individual electrodes each of which is formed at an area of the piezoelectric layer, the area being in one surface of the piezoelectric layer and overlapping with an edge portion of one of the pressure chambers as viewed in the direction perpendicular to the plane, the edge portion being other than a central portion of one of the pressure chambers; and a common electrode which is formed on the other surface of the piezoelectric layer; wherein the piezoelectric layer has driving zones each of which is provided between the common electrode and one of the individual electrodes and deforms by itself when a drive voltage is applied to the one of the individual electrodes, a value of A/(W/2) is not less than 0.33 and not more than 0.75 when W is a length in a radial direction of the pressure chambers, and A is a length of portions of the driving zones in the radial direction, the portions being formed at areas each overlapping with one side portion, in the radial direction, of the edge portion of one of the pressure chambers.

23. The liquid transporting apparatus according to claim 22, wherein the value of A/(W/2) is not less than 0.41 and not more than 0.69.

24. The liquid transporting apparatus according to claim 22, wherein the value of A/(W/2) is not less than 0.41 and not more than 0.55.

25. The liquid transporting apparatus according to claim 22, wherein each of the pressure chambers has a shape long in a predetermined direction; and each of the driving zones is formed at least at two areas which are included in the area overlapping with the edge portion of one of the pressure chambers and which extend substantially in parallel to the predetermined direction.

26. The liquid transporting apparatus according to claim 22, wherein the vibration plate is formed of a metallic material and serves as the common electrode.

27. The liquid transporting apparatus according to claim 22, wherein the vibration plate is insulative at least on a surface of the vibration plate opposite to the pressure chambers; and the common electrode is formed on the surface of the vibration plate opposite to the pressure chambers.

28. The liquid transporting apparatus according to claim 22, wherein the vibration plate is insulative at least on a surface of the vibration plate opposite to the pressure chambers; and the individual electrodes are formed on the surface of the vibration plate opposite to the pressure chambers.

29. The liquid transporting apparatus according to claim 22, wherein the piezoelectric layer is formed to overlap entirely with the pressure chambers as view of in the direction perpendicular to the plane.

* * * * *